US007821471B2

(12) United States Patent
Yoshioka et al.

(10) Patent No.: US 7,821,471 B2
(45) Date of Patent: Oct. 26, 2010

(54) ASYMMETRICAL FLAT ANTENNA, METHOD OF MANUFACTURING THE ASYMMETRICAL FLAT ANTENNA, AND SIGNAL-PROCESSING UNIT USING THE SAME

(75) Inventors: Masahiro Yoshioka, Tokyo (JP); Takashi Nakanishi, Tokyo (JP); Seiji Wada, Kanagawa (JP); Tetsujiro Kondo, Tokyo (JP)

(73) Assignee: Sony Corporation, Tokyo (JP)

( * ) Notice: Subject to any disclaimer, the term of this patent is extended or adjusted under 35 U.S.C. 154(b) by 302 days.

(21) Appl. No.: 11/677,286

(22) Filed: Feb. 21, 2007

(65) Prior Publication Data

US 2007/0200767 A1 Aug. 30, 2007

(30) Foreign Application Priority Data

Feb. 28, 2006 (JP) ..... 2006-053732

(51) Int. Cl.
*H01Q 1/50* (2006.01)
*H01Q 1/38* (2006.01)

(52) U.S. Cl. ..... 343/850; 343/700 MS

(58) Field of Classification Search ..... 343/700 MS, 343/702, 893, 850, 853, 860, 862, 863, 864, 343/846

See application file for complete search history.

(56) References Cited

U.S. PATENT DOCUMENTS

| | | | | |
|---|---|---|---|---|
| 6,292,154 | B1 * | 9/2001 | Deguchi et al. | 343/806 |
| 6,496,148 | B2 * | 12/2002 | Ngounou Kouam et al. | 343/700 MS |
| 7,116,276 | B2 * | 10/2006 | Lee | 343/700 MS |
| 7,339,533 | B2 * | 3/2008 | Kurashima et al. | 343/702 |
| 2005/0052322 | A1 | 3/2005 | Park et al. | |
| 2007/0069959 | A1 * | 3/2007 | Wu | 343/700 MS |
| 2008/0316108 | A1 * | 12/2008 | Chen et al. | 343/700 MS |

FOREIGN PATENT DOCUMENTS

| | | |
|---|---|---|
| JP | 2004-220264 | 8/2004 |
| JP | 2005-192183 | 7/2005 |

* cited by examiner

*Primary Examiner*—Hoang V Nguyen
*Assistant Examiner*—Robert Karacsony
(74) *Attorney, Agent, or Firm*—Oblon, Spivak, McClelland, Maier & Neustadt, L.L.P.

(57) ABSTRACT

An asymmetrical flat antenna contains an insulation layer. The antenna also contains a conductive power supply pattern that is provided on the insulation layer and a conductive antenna pattern that extends from the power supply pattern and is provided on the insulation layer. The conductive antenna pattern has an asymmetrical configuration with respect to the power supply pattern.

20 Claims, 32 Drawing Sheets

FIG. 30A D11
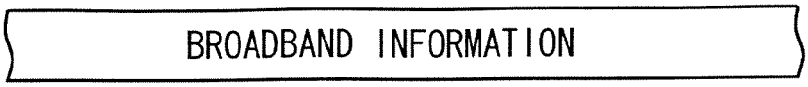
FIG. 30B D12
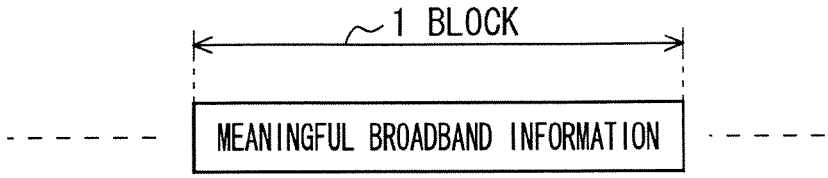
FIG. 30C D13
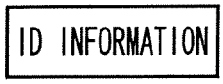
FIG. 30D D14
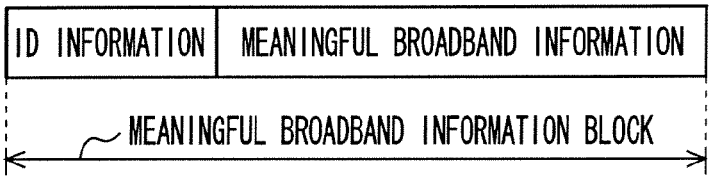
SIGNAL PROCESSING
FIG. 30E D14a
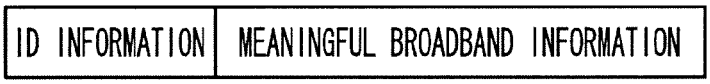
FIG. 30F D13a
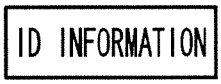
FIG. 30G D12a
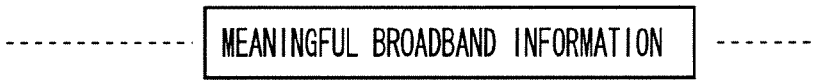
FIG. 30H D11a
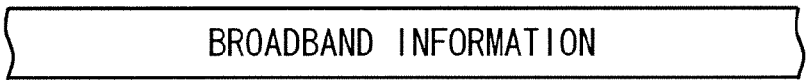

FIG. 33A D21
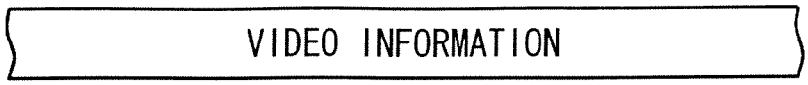
FIG. 33B D22
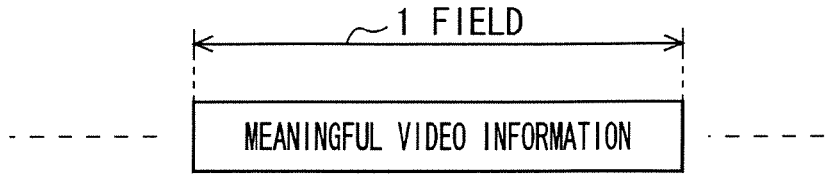
FIG. 33C D23
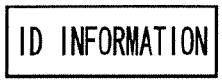
FIG. 33D D24
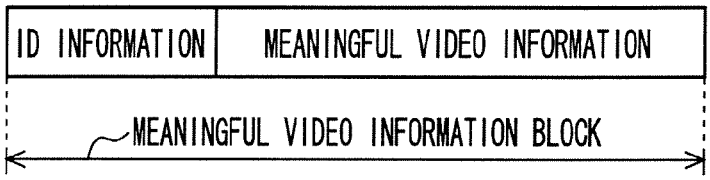
SIGNAL PROCESSING
FIG. 33E D24a
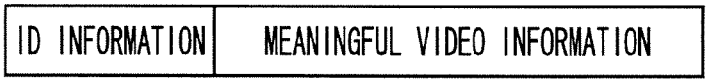
FIG. 33F D23a
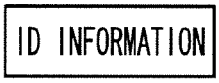
FIG. 33G D22a
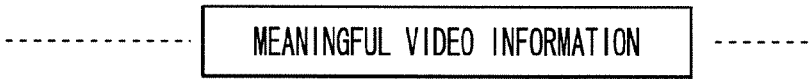
FIG. 33H D21a
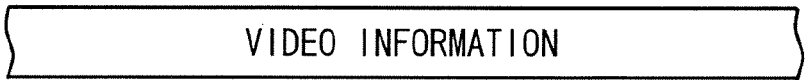

ASYMMETRICAL FLAT ANTENNA, METHOD OF MANUFACTURING THE ASYMMETRICAL FLAT ANTENNA, AND SIGNAL-PROCESSING UNIT USING THE SAME

CROSS-REFERENCE TO RELATED APPLICATION

The present invention contains subject matter related to Japanese Patent Application JP 2006-053732 filed in the Japanese Patent Office on Feb. 28, 2006, the entire contents of which being incorporated herein by reference.

BACKGROUND OF THE INVENTION

1. Field of the Invention

The present invention relates to an asymmetrical flat antenna, a method of manufacturing the asymmetrical flat antenna, and a signal-processing unit using this antenna.

2. Description of Related Art

An antenna has been often designed and developed so that it is suitably used in an electronic device having portability, a communication device that is used in a home where it is difficult to wire a communication cable therein or is used for a long distance in a precinct or a building, and the like. That is, the development and design of the antenna have been often carried out aiming at how efficiently to emit radio wave to a long distance and for its basic design, emission of radio wave to a long distance has been considered. As a design having broadband performance in such antenna development, an antenna which indicates constant impedance throughout wide frequencies can turn to an antenna having broadband performance so that self-similar antenna, self-complementary antenna and the like have been developed.

Generally, the antenna is preferred to pick up radio wave from a certain direction with an excellent sensitivity based on its directivity while avoiding picking of radio waves from other directions. However, radio wave emitted from a transmission antenna or radio wave emitted from other electronic component induces multi-reflection of radio wave under an environment substantially surrounded by metals, thereby producing multipath.

For example, under an environment in which the antenna and a signal-processing board including the antenna or large scale integrated (LSI) circuit device are substantially surrounded by metals, signal deterioration due to multipath may often occur. If a receiving antenna receives radio wave under such the multipath, the receiving antenna may mix radio wave received directly with it, thereby resulting in deterioration of signal quality because the receiving antenna fails to recognize a preferred one of their waveforms.

FIG. 1 shows a configuration of a rectangular patch antenna 10 as a related art example. The rectangular patch antenna 10 shown in FIG. 1 includes multilayered board 8 overlaid with a grounding layer, not shown, (hereinafter referred to GND layer) and an insulator layer 7, and a rectangular antenna pattern 6 thereon. The rectangular patch antenna 10 indicates narrow band performance because it has the GND layer on the bottom layer of the antenna pattern 6 via the insulator layer 7. The antenna pattern 6 has a length of $\lambda/2$ at a longitudinal direction thereof where the wavelength of frequency to be used is $\lambda$. If the antenna pattern 6 is divided into two parts each having a length of $\lambda/4$ on both of the right and left sides with respect to the center of power supply pattern 1, a shape of the part having a length of $\lambda/4$ on the left side and that of the part having a length of $\lambda/4$ on the right side are identical to each other.

Japanese Patent Application Publication No. 2005-192183 has disclosed an antenna for ultra-wide band communication in association with this kind of the rectangular patch antenna 10. Such the antenna is constructed to have a patch and a ground area on its substrate. The patch is formed smaller than the substrate. When supplied with current via a feeder, the patch is excited to emit any energy. The ground area is formed by removing area on the surface of the substrate other than the patch to have broadband performance.

Japanese Patent Application Publication No. 2004-220264 has disclosed an electronic device equipped with the rectangular patch antenna 10. The electronic device has a main body case and this main body case contains a mother board having a device composition unit. It also has a daughter board constituting other device composition units and each of the device composition units is provided with a broadband communication chip. The interior of the main body case is covered with radio wave absorption body to absorb electromagnetic wave which may induce communication noise between the device composition units.

SUMMARY OF THE INVENTION

In a past signal-processing unit, in order to control any signal deterioration by the multipath, it is conceivable to perform wireless communication by bringing an antenna close to a signal-processing board in the vicinity thereof.

When the patch antenna 10 having the narrow band performance shown in FIG. 1 is used as it is, it is difficult to control the signal deterioration in an environment in which any metal substantially encloses an antenna and a signal-processing board including the antenna or an LSI device, or an environment in which a signal-processing board equipped with the rectangular patch antenna 10 or plural LSI devices are provided so that any metal can enclose substantially them. In these environments, the metal reflects radio wave so as to cause the signal deterioration due to multipath.

The rectangular patch antenna 10 having the narrow band performance is designed on an assumption of transmitting radio wave over a long distance. That is, the rectangular patch antenna 10 is basically evaluated and designed using the far field and is not produced assuming use under a condition in which the antenna performs wireless communication by bringing an antenna close to a signal-processing board in the vicinity thereof. Thus, if such the rectangular patch antenna 10 is used under the above condition, it is difficult to keep any desired antenna characteristics that have been designed in a mutual relationship between the antenna and the metal.

In the flat patch antenna as disclosed in Japanese Patent Application Publication No. 2005-192183, a matching circuit is often disposed between the antenna pattern and the power line, thereby preventing power from being supplied from the pins of the LSI directly to the antenna.

To operate the LSI device stably, generally, a method of securing a relatively large area for the GND layer of the LSI device is often adopted. However, if it is intended to mount (form) an antenna pattern on the LSI device taking into consideration high density mounting, the structure described in Japanese Patent Application Publication No. 2005-192183 may require the GND area to be cut out. Thus, it is difficult to provide the antenna pattern and the LSI device on an identical plane or dispose the antenna pattern above the LSI device.

Further, if any metal approaches a board or LSI device loaded with the antenna, the characteristics may be deteriorated thereby. This causes a unidirectional antenna to be used therefor. In case of performing broadband wireless communication processing using a broadband communication chip as described in Japanese Patent Application Publication No. 2004-220264, radio wave which turns to communication noise can be absorbed to some extent by a radio wave absorption body. If, however, the working frequency of an electronic device rises so that an amount of information handled by wireless communication can be increased, such the information may be transmitted at real time in a short time if considering continuity of, for example, transmitted images.

Thus, to transmit a large amount of information at the time of wireless communication, it may be necessary to provide the unidirectional antenna with broadband performance to allow transmission of multimedia among the composition units.

Accordingly, it is desirable to provide an asymmetrical flat antenna in which the band of its flat antenna can be expanded as compared with the band of a rectangular patch antenna with reference to its ratio of bandwidth while the frequency resonance point in antenna reflection characteristic can be improved by devising the configuration of the flat antenna, a method of manufacturing the asymmetrical flat antenna, and a signal-processing unit using the asymmetrical flat antenna.

According to an embodiment of the invention, there is provided an asymmetrical flat antenna containing an insulation layer, a conductive power supply pattern that is provided on an insulation layer, and a conductive antenna pattern that extends from the power supply pattern and is provided on the insulation layer. The antenna pattern has an asymmetrical configuration with respect to the power supply pattern.

In the embodiment of the asymmetrical flat antenna according to the present invention, the conductive power supply pattern is provided on the insulation layer so that the conductive antenna pattern extends from this power supply pattern. On this premise, the antenna pattern has the asymmetrical configuration on the right and left sides with respect to the power supply pattern.

This asymmetrical configuration enables the frequency resonance point in the reflection characteristic of antenna to be changed, thereby allowing the band of the asymmetrical flat antenna as the embodiment of the present invention to be expanded as compared with the band of the rectangular patch antenna with respect to its ratio of bandwidth. The asymmetrical flat antenna as the embodiment of the present invention can be connected with the LSI device on a board on which the LSI device is mounted or within the LSI device and can have broadband performance whose ratio of bandwidth is 11% or more and some extend of directivity in which the asymmetrical flat antenna as the embodiment of the present invention operates under a condition other than far field with a matching circuit possessed in the antenna pattern. Such the antenna characteristic enables the lamination structure and the antenna pattern of the antenna to exert effects on multipath. This allows freedom of antenna arrangement in an electronic device to be secured and any cost accompanying wiring to be reduced.

According to another embodiment of the invention, there is provided a method of manufacturing an asymmetrical flat antenna. The method includes the steps of forming an insulation layer, forming a conductive power supply pattern on the insulation layer, and forming on the insulation layer a conductive antenna pattern that extends from the conductive power supply pattern and has an asymmetrical configuration with respect to the conductive power supply pattern.

By the embodiment of the method of manufacturing the asymmetrical flat antenna according to the present invention, it is possible to manufacture the asymmetrical flat antenna having antenna reflection characteristic whose frequency resonance point can be changed. That is, according to this embodiment of the present invention, the asymmetrical flat antenna having an asymmetrical configuration can be manufactured in which a broadband antenna pattern, which can be laid out, is provided on an ordinary multilayered board constituted of glass epoxy, Teflon (trade mark), ceramics or the like and the insulation layer includes an conductive grounding sub-layer through an insulation sub-layer.

According to further embodiment of the invention, there is provided a signal-processing unit that performs signal processing and has an asymmetrical flat antenna. The asymmetrical flat antenna contains an insulation layer, a conductive power supply pattern provided on the insulation layer, and a conductive antenna pattern that extends from the power supply pattern and is provided on the insulation layer. The conductive antenna pattern has an asymmetrical configuration with respect to the power supply pattern.

In the embodiment of the signal-processing unit according to the present invention, the asymmetrical flat antenna is used when the asymmetrical flat antenna is connected in the signal-processing unit in order to perform any signal processing. Accordingly, the reflection characteristic thereof can be improved as compared by that of the signal-processing unit including the rectangular patch antenna. This enables the most efficient near distance wireless communication processing using the asymmetrical flat antenna that is operable under a condition other than the far field to be performed. That is, by the embodiment of the signal-processing unit according to the present invention, it is possible to maintain easy connection with the LSI device on a board on which an available LIS device is mounted or within the LSI device during wireless communication within a casing and to have a broadband antenna whose a ratio of bandwidth is 11% or more. Such the broadband antenna has a matching circuit near its antenna pattern and can execute wireless communication processing with a signal-processing board within a electronic device using the broadband antenna. It is also possible to preclude a step of wiring a signal line between the LSI boards and attain a high speed transmission of information between the LSI boards.

The concluding portion of this specification particularly points out and directly claims the subject matter of the present invention. However those skilled in the art will best understand both the organization and method of operation of the invention, together with further advantages and objects thereof, by reading the remaining portions of the specification in view of the accompanying drawing(s) wherein like reference characters refer to like elements.

BRIEF DESCRIPTION OF THE DRAWINGS

FIGS. 28A, 28B are block diagrams each for showing an inner configuration of the signal-processing board 1040*a*, 1040*b* or the like;

FIGS. 30A-30H are transition diagrams each for showing a processing example of broadband information D11;

FIGS. 33A-33H are transition diagrams each for showing a processing example of video information D21;

DESCRIPTION OF THE PREFERRED EMBODIMENTS

The following will describe the embodiments of an asymmetrical flat antenna, a method of manufacturing the asymmetrical flat antenna, and a signal-processing unit using the asymmetrical flat antenna according to the present invention with reference to the accompanying drawings.

(Asymmetrical Flat Antennas)

Figure 2:
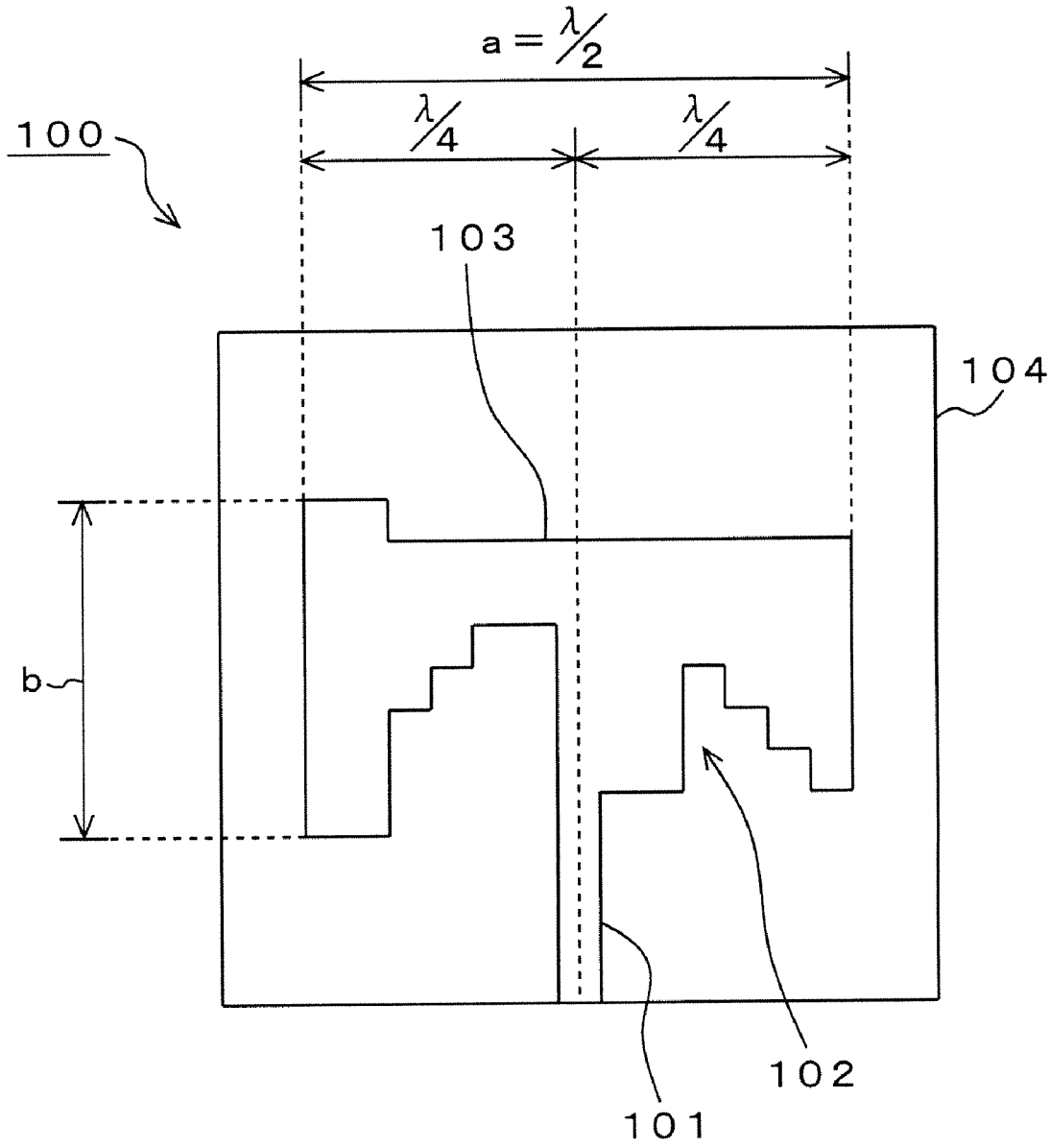
FIG. 2 is a top view of an asymmetrical flat antenna 100 as a first embodiment of the present invention for showing a configuration thereof.

FIG. 2 shows a configuration of an asymmetrical flat antenna 100 as an embodiment of the present invention.

The asymmetrical flat antenna 100 shown in FIG. 2 performs 2-wave resonance type antenna activity having unidirectionality and broadband performance for a near distance and having narrow band performance for a far distance. The asymmetrical flat antenna 100 is preferably applicable for an electronic device having an antenna for communication within a casing and a signal-processing unit which is actuated by working frequency on the order of, for example, GHz.

The asymmetrical flat antenna 100 contains an insulation board 104 (or an insulation layer) and an antenna main body having a shape of almost rotated letter E that is provided thereon. Inventors find out such this shape of the antenna main body that satisfies unidirectionality and broadband performance for a near distance and narrow band performance for a far distance. The antenna main body has a conductive power supply pattern 101, a conductive antenna-matching pattern 102 and a conductive antenna pattern 103.

The conductive antenna pattern 103 has a length "a" of $\lambda/2$ where $\lambda$ is the wavelength of working frequency thereof. The length "a" is a length in the longitudinal direction of the antenna pattern 103 perpendicular to the power supply pattern 101. The conductive antenna pattern 103 has a length "b" in the lateral direction (a>b). When the length "a" of the conductive antenna pattern 103 is divided into two parts, namely, $\lambda/4$ each on the right and left sides thereof with respect to a center of the conductive power supply pattern 101, a staircase shape of the right part thereof is different from that of the left part thereof. Because the working frequency $f=c/\lambda$ of this antenna is available for broadband, any wavelength in the broadband is selected as about $\lambda/4$ of the right or left part. That allows a plurality of selections therefor to be secured.

In this embodiment, the conductive power supply pattern 101 extends at a center of the insulation board 104 substantially from its lower end to its middle portion. The conductive antenna pattern 103 extends upward from the power supply pattern 101. When current is supplied thereto through the conductive power supply pattern 101, it excites the conductive antenna pattern 103 to emit energy (radio wave). The conductive antenna-matching pattern 102 is provided at a portion connecting the conductive power supply pattern 101 and the conductive antenna pattern 103. The conductive antenna pattern 103 has an asymmetrical configuration on the right and left parts with respect to the conductive power supply pattern 101. The conductive power supply pattern 101, the conductive antenna-matching pattern 102, and the conductive antenna pattern 103 are made of metal foil or metal sheet or metal layers of gold, silver, copper, brass, bronze, white copper or the like.

Because the conductive antenna-matching pattern 102 with a predetermined configuration is provided at a portion between the conductive power supply pattern 101 and the conductive antenna pattern 103, it is possible to supply a signal from a semiconductor integrated circuit device (hereinafter referred to as LSI) to the conductive power supply pattern 101 by connecting wire from the LSI to the conductive power supply pattern 101 directly, not through any matching circuit. It is to be noted that the matching circuit mentioned here is a circuit for matching wiring impedance with the conductive antenna pattern 103.

This allows to be made redundant, in the present invention, any matching circuit to be interposed between the asymmetrical flat antenna 100 and the LSI, thereby enabling a length of wire between the asymmetrical flat antenna 100 and the LSI to be made as short as possible. As foundation layer of the conductive antenna pattern 103, a multilayered board or a laminated structure device in which dielectric is sandwiched between metal layers is used. As the multilayered board, a board used in an ordinary electronic device may be used. For the insulation board 104 shown in FIG. 2, an ordinary multilayered board that has a substrate, which is constituted of glass epoxy, Teflon (trade mark), ceramics or the like, containing a grounding layer may be used.

Figure 3:
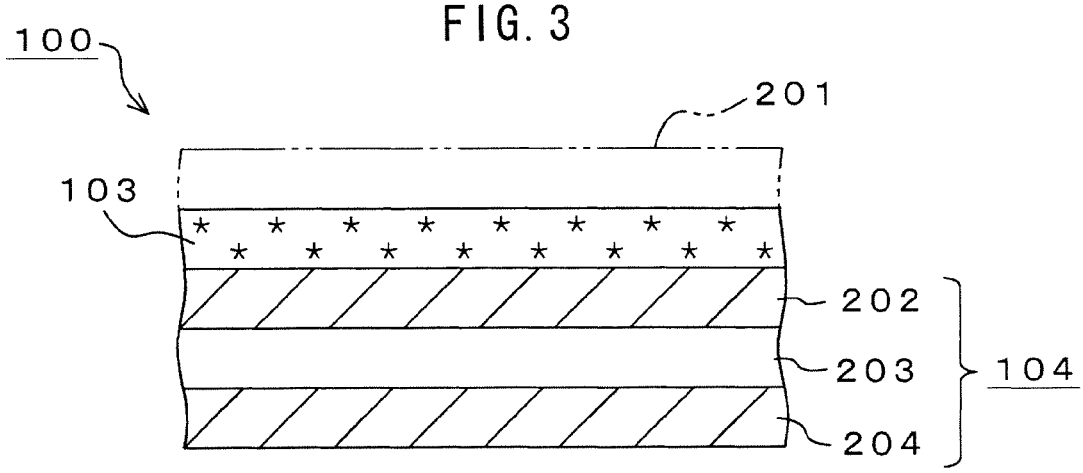
FIG. 3 is a partially sectional view of the asymmetrical flat antenna 100 for showing a laminated configuration of an antenna pattern 103 and an insulation layer 104.

FIG. 3 shows a laminated configuration of the conductive antenna pattern 103 and an insulation layer 104 in the asymmetrical flat antenna 100. The asymmetrical flat antenna 100 shown in FIG. 3 has a three-layer insulation board 104 and the conductive antenna pattern 103 that is provided thereon. The three-layer insulation board 104 contains an insulation layer (a dielectric layer) 202, a grounding layer (hereinafter referred to as GND layer) 203, and an insulation layer 204.

In this embodiment, the insulation layer 202 is provided under the conductive antenna pattern 103 and the GND layer having a larger area is provided under the insulation layer 202. The area of the GND layer 203 is sufficiently larger than that of the conductive antenna pattern 103. This enables the asymmetrical flat antenna 100 to indicate unidirectionality. Accordingly, machinery components such as electronic components and mechanical components on the face in which the conductive antenna pattern 3 parallel to the multilayered insulation board 4 exists can be loaded at a high density without affecting their property.

At this time, the GND layer 203 having a large area acts meaningfully for stability and safety operation of those machinery components. As the GND layer 203, semiconductor GaAs containing impurities, multi-crystal silicon and the like are used as well as the same metal as those used in the conductive antenna pattern 103. This enlarged GND layer 203 can be shared with the GND layer of the LSI so as to function for stabilization of operations of the LSI.

The insulation layer 204 is provided under the GND layer 203. In the meantime, other wiring layer is provided on the insulation layer 202 as well as the conductive antenna pattern 103. The wiring layer extending from this antenna pattern 103 has a feature of being capable of simplifying the structure of the electronic device because it can be replaced with a signal bus, connector or the like. In the FIG. 3, as an insulation layer 201 as the uppermost layer, resist layer, silk layer or the like is used and additionally, air (dielectric constant=1) may be used. That is, it is permissible to replace the conductive antenna pattern 103 (metal layer) with the insulation layer (dielectric layer) 201 and the insulation layer (dielectric layer) 202 with the GND layer 203. Further, the conductive antenna pattern 103 may be developed into a solid configuration.

Figure 4:
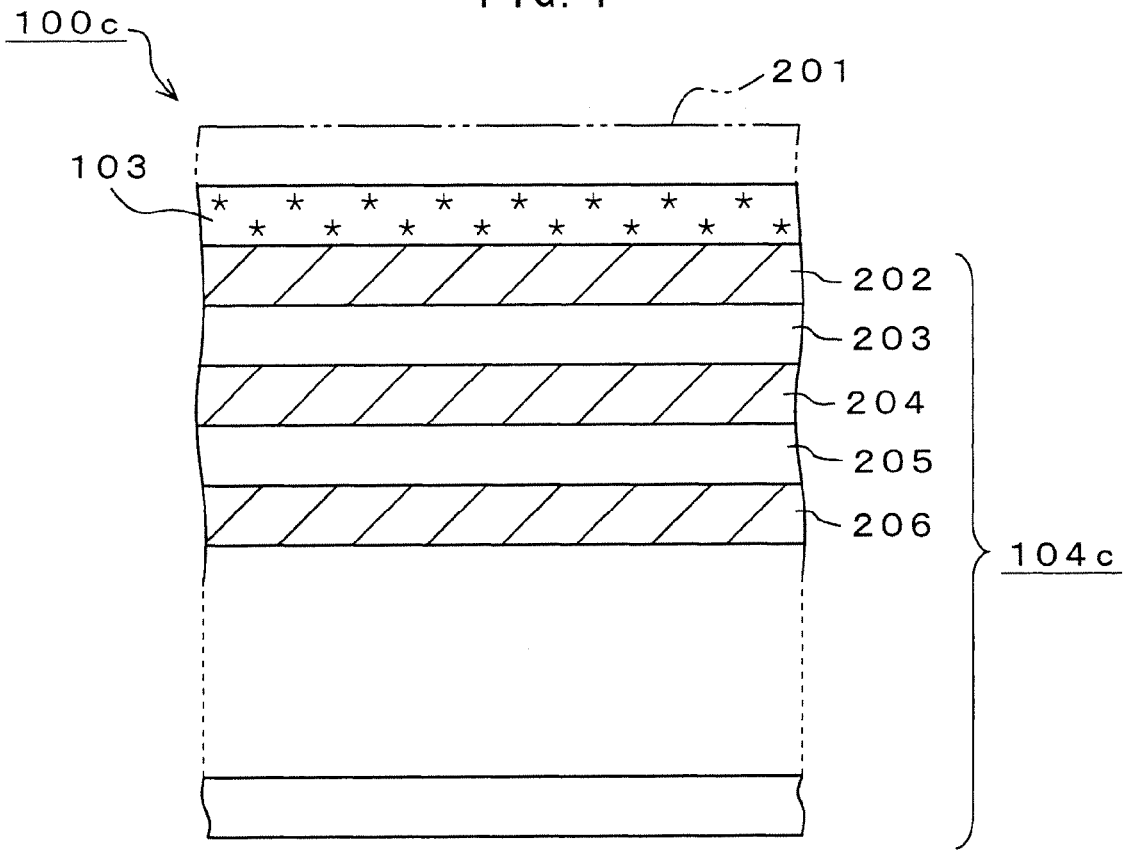
FIG. 4 is a partially sectional view of an asymmetrical flat antenna 100*c* as a second embodiment of the present invention for showing a laminated configuration of the conductive antenna pattern 103 and an insulation layer 104*c;*

FIG. 4 shows a laminated configuration of the conductive antenna pattern 103 and a multilayered insulation board 104*c* in other asymmetrical flat antenna 100*c*. The other asymmetrical flat antenna 100*c* shown in FIG. 4 has the multilayered insulation board 104*c* and the conductive antenna pattern 103 that is provided thereon. The multilayered insulation board 104*c* is used in an ordinary electronic device and contains insulation layer (dielectric layer) 202, GND layer 203, insulation layer 204, wiring layer 205, insulation layer 206 and other layers. For the other layers, materials for any multilayered board used in an ordinary electronic device can be used.

The multilayered insulation board 104*c* has the insulation layer 202 under the conductive antenna pattern 103 and the GND layer 203 having a large area that is provided under this layer 202. This enables the asymmetrical flat antenna 100*c* to maintain its directivity. In this embodiment, the multilayered insulation board 104*c* further has the insulation layer 204 that is provided under the GND layer 203 and a wiring layer 205 that is provided under the insulation layer 204. The wiring layer 205 is a wiring layer that is pulled out from a pin of an LSI device, not shown, or an electrode for connection.

Although in the asymmetrical flat antenna 100, the conductive antenna pattern 103 and the wiring layer are provided on an identical plane, in the asymmetrical flat antenna 100*c*, the conductive antenna pattern 103 and the wiring layer 205 are provided on different planes. The insulation layer 201 shown in FIG. 4 is a resist layer, a silk layer or air like the insulation layer 201 shown in FIG. 3.

The following will describe the asymmetrical flat antennas 100, 100*c* by paying attention to the conductive antenna pattern 103 on the three-layer insulation board 104 shown in FIG. 3 and the conductive antenna pattern 103 on the multi-layered insulation board 104*c* shown in FIG. 4.

Figure 5:
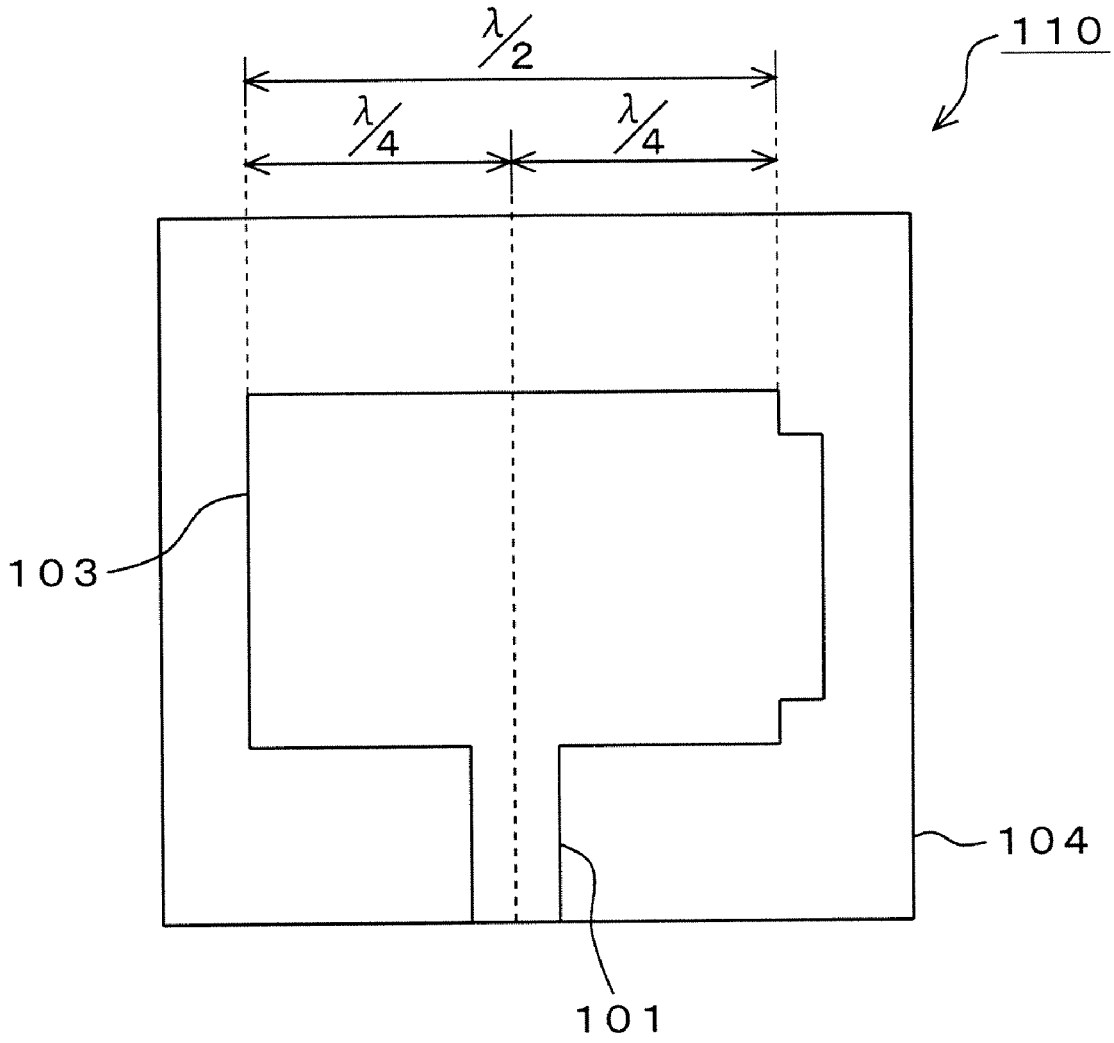
FIG. 5 is a top view of an asymmetrical flat antenna 110 as a third embodiment of the invention, which is also a comparative example to the asymmetrical flat antennas 100, 100*c* and the like as the embodiments of the present invention, for showing a configuration of the asymmetrical flat antenna 110.

FIG. 5 shows a configuration of an asymmetrical flat antenna 110 as a third embodiment of the invention, which is compared with the rectangular patch antenna 10. The asymmetrical flat antenna 100 of embodiments of the present invention is also compared with the rectangular patch antenna 10. Thus, the asymmetrical flat antenna 110 is indirectly compared with the asymmetrical flat antenna 100. The asymmetrical flat antenna 110 shown in FIG. 5 is manufactured by adding components which change the resonance frequency to the rectangular patch antenna 10 shown in FIG. 1.

An antenna pattern 103A has a length of λ/2 in the longitudinal direction where λ is the wavelength of working frequency. When the antenna pattern 103A is divided into two parts, namely, λ/4 each on the right and left sides thereof with respect to a center of the conductive power supply pattern 101, the shape of the right part thereof is different from that of the left part thereof. A projection to the right direction from the right part thereof acts as a component for changing the resonance frequency. To form the antenna pattern asymmetrically, the method is not limited to reducing the quantity of the patterns but adding a pattern is allowed. It is to be noted that because the working frequency f=c/λ of this antenna is available for broadband, any wavelength in the broadband is selected as about λ/4 of the right or left part.

Because the rectangular patch antenna 10 emits two electromagnetic waves from ends of the short side, it is considered to have two emitters. If this is considered in views of reflection characteristic, it can be considered that two resonance frequencies are possessed.

In this embodiment, the antenna pattern 103A of the asymmetrical flat antenna 110 is chipped at the top and bottom of the right end of the short side. Thus, changing the shapes on the right and left sides of the antenna pattern 103A enables the two resonance frequencies (resonance point) of the rectangular patch antenna 10 to move toward, for example, a lower frequency band. That is, the inventors have found that by overlapping two bands capable of emitting electromagnetic waves with a single resonance frequency, the band can be expanded to a band capable of emitting electromagnetic waves with two resonance frequencies.

The inventors have found that a method of changing the resonance frequency with the matching condition between the conductive antenna pattern 103A and the conductive power supply pattern 1 being maintained can be met by adding inductance component L, capacitance component C, and resistance component R to the antenna pattern 103A by any method or reducing these components from the antenna pattern 103A. The following will describe the characteristics of the asymmetrical flat antennas as the embodiments according to the present invention by taking the band of several GHz as an example. The working frequency used in the asymmetrical flat antennas as the embodiments according to the present invention is not restricted to the band used in this description but the antennas may be used in a variety of frequency bands such as a micro wave band and an extremely high frequency band.

Figure 6:
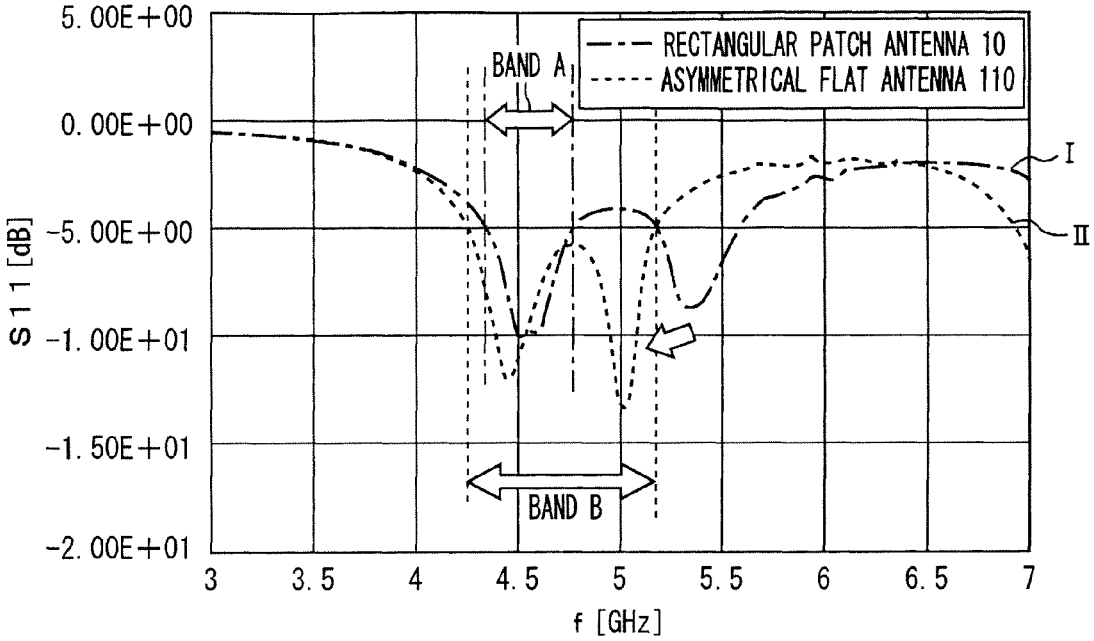
FIG. 6 is a graph for showing a comparative example of reflection characteristics of the rectangular patch antenna 10 as related art and the asymmetrical flat antenna 110 as the third embodiment of the invention.

FIG. 6 is a graph for showing a comparative example of the reflection characteristics of the rectangular patch antenna 10 and the asymmetrical flat antenna 110. A vertical axis shown in FIG. 6 indicates reflection characteristics S11 [dB] of the rectangular patch antenna 10 and the asymmetrical flat antenna 110. A horizontal axis shown in FIG. 6 indicates the working frequencies [GHz] of these antennas. The dot and dash lines indicate the reflection characteristic I of the rectangular patch antenna 10 as related art and the dotted line indicates reflection characteristic II of the asymmetrical flat antenna 110. The reflection characteristic II of this asymmetrical flat antenna 110 is improved to a band B as compared with a band A of the rectangular patch antenna 10 shown in FIG. 1.

In this FIG. 6, resonance frequencies of the rectangular patch antenna 10 indicate 4.5 GHz and 5.3 GHz. Resonance frequencies of the asymmetrical flat antenna 110 indicate 4.4 GHz and 5.0 GHz. In this example, if the carrier frequency is set to 60 GHz or more and it is intended to use the entire band at the time of transmission of information, a case where the ratio of bandwidth is 11% or more is defined as an antenna having broadband performance. The ratio of bandwidth is given by (fb/fc)×100 [%] when the working frequency of carrier is fc and the bandwidth is fb. The bandwidth fb is given by fh-fl where the upper limit frequency and the lower limit frequency are assumed to be fh and hl, respectively, when the reflection characteristic curve of the antenna, for example, passes S11=−5.00 E+00.

As indicated with arrows shown in the FIG. 6, the band B of the asymmetrical flat antenna 110 is expanded as compared with the band A of the rectangular patch antenna 10. In this example, the band A of the rectangular patch antenna 10 is 4.75−4.3=0.45 GHz. The band B of the asymmetrical flat antenna 110 is 5.2−4.2=1.0 GHz.

In the asymmetrical flat antenna 110 thus improved as compared with the rectangular patch antenna 10, the band B can be expanded as compared with the band A by using motion of the resonance point so that the band B can be improved two times or more as compared with the band A. That is, the inventors has found that the resonance frequency can be changed by changing the shape of the rectangular patch antenna 10, thereby enabling the band to alter from the band A to the band B by the changes of the resonance frequency. Then, the inventors executed a number of analyses to change the resonance frequency of the antenna pattern 103 (FIG. 1).

Figure 1:
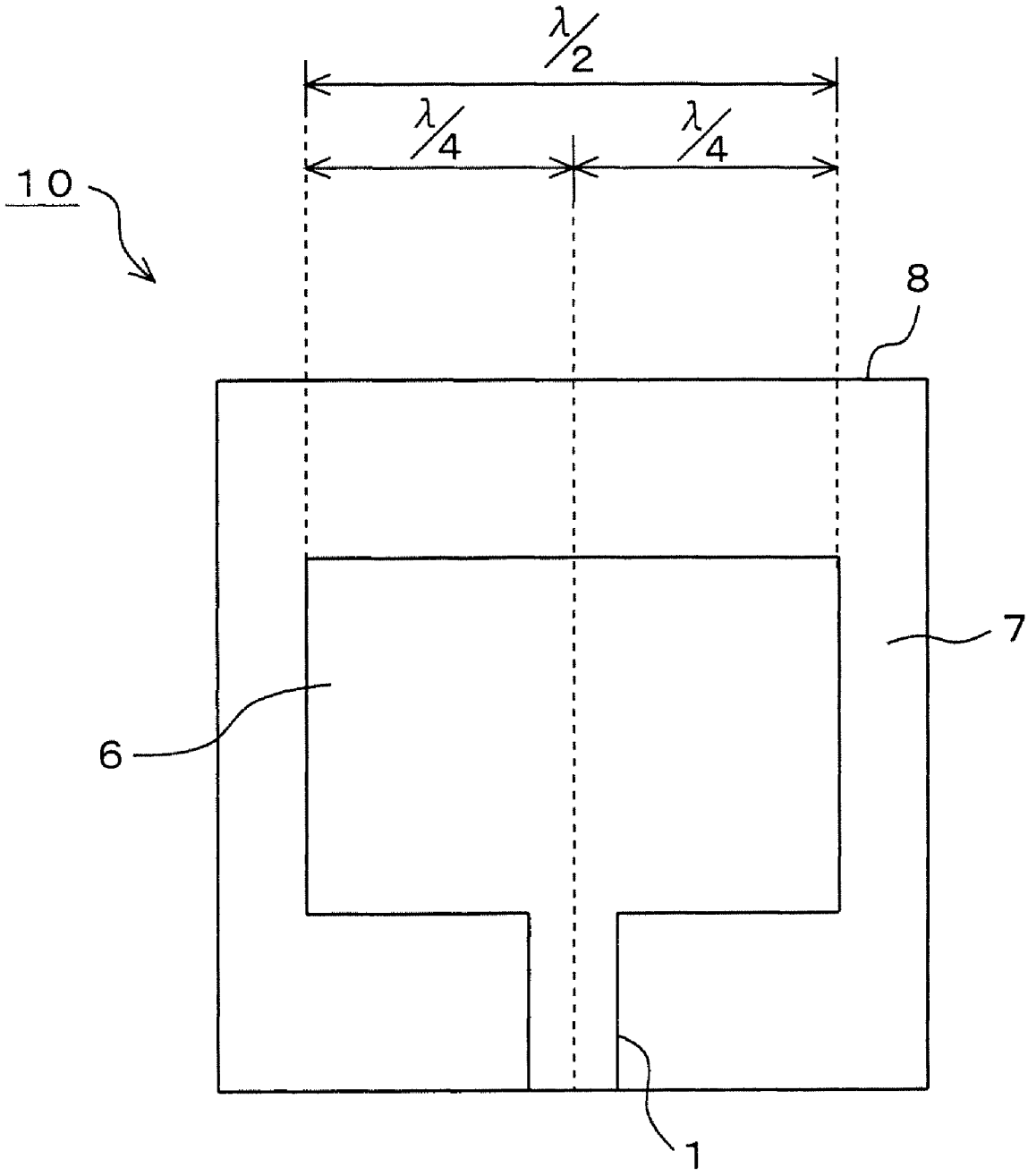
FIG. 1 (RELATED ART)
FIG. 1 is a top view of a rectangular patch antenna 10 as related art for showing a configuration thereof.

According to these analyses, it has been found that the rectangular patch antenna pattern 6 shown in FIG. 1 has a number of the resonance points. Accordingly, it is apparent that the asymmetrical flat antenna 100 or the like having a desired band can be designed by using the multiple resonance points well. As described in the embodiments of the present invention, which will be described, by using the appearance, the inventors find out a condition for designing the asymmetrical flat antenna 100 and the like that have a matching circuit pattern within the antenna, a broadband of 11% or more in the ratio of bandwidth, and unidirectionality of such an extent not affected by electronic devices, mechanical components or the like disposed around the antenna in an operating state other than a far field. Consequently, the asymmetrical flat antenna 10 of the present invention has been achieved.

Figure 7:
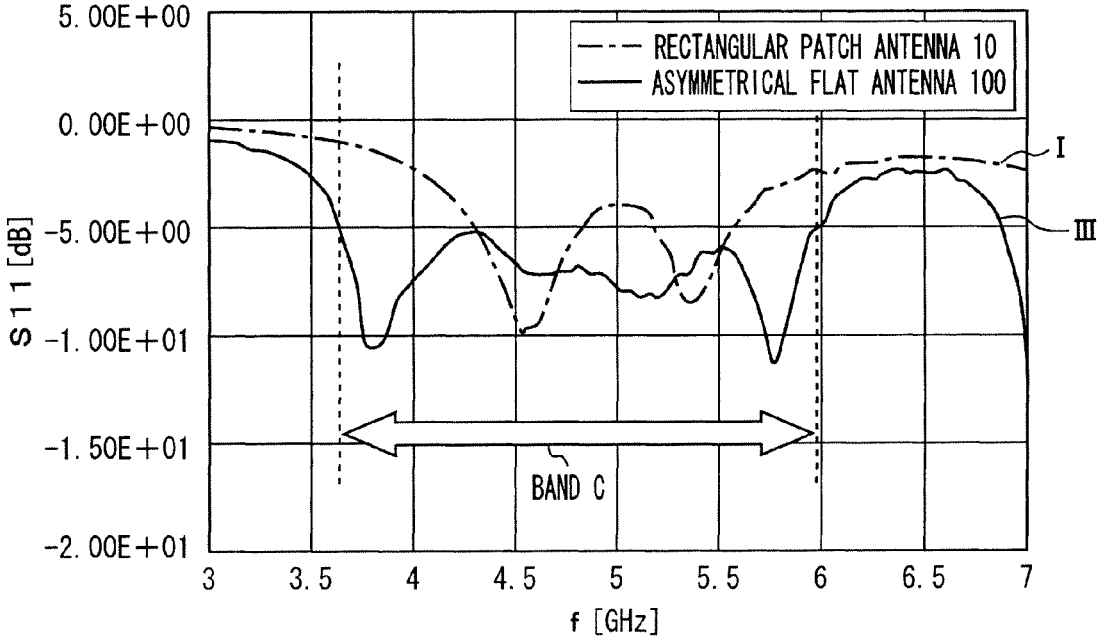
FIG. 7 is a graph for showing a comparative example of reflection characteristics of the rectangular patch antenna 10 as related art and the asymmetrical flat antenna 100 as the first embodiment of the invention.

FIG. 7 is a graph for showing a comparative example of the reflection characteristics of the rectangular patch antenna 10 and the asymmetrical flat antenna 100. A vertical axis shown in FIG. 7 indicates the reflection characteristics S11 [dB] of the rectangular patch antenna 10 and the asymmetrical flat antenna 100. A horizontal axis shown in FIG. 7 indicates the working frequencies [GHz] of these antennas. The dot and dash lines indicate the reflection characteristic I of the rectangular patch antenna 10 as related art and the dotted line indicates the reflection characteristic III of the asymmetrical flat antenna 100. The reflection characteristic III of this asymmetrical flat antenna 100 is improved to a band C as compared with the band A of the rectangular patch antenna 10 shown in FIG. 1 and the band B of the asymmetrical flat antenna 110 shown in FIG. 5. Thus, the asymmetrical flat antenna 100 functions as a broadband antenna. Such the broadband antenna has unidirectionality and broadband performance, and is actuated in any fields other than the far field.

In the FIG. 7, resonance frequencies of the rectangular patch antenna 10 indicate 4.5 GHz and 5.3 GHz. Resonance frequencies of the asymmetrical flat antenna 100 as the first embodiment of the present invention indicate 3.8 GHz and 5.8 GHz. According to the reflection characteristic III of the asymmetrical flat antenna 100, the upper limit frequency fh and the lower limit frequency fl are 6.0 [GHz] and 3.6 [GHz], respectively, when its characteristic curve passes S11=−5.00 E+00 and thus, the band C (=bandwidth fb) is 2.4 [GHz].

As indicated with arrows shown in FIG. 7, the band C can be improved as compared with the band A. This example indicates that the band C is expanded to 2.4 times more than the band B shown in FIG. 6 and is expanded to 5.3 times more than the band A shown therein. Thus, the asymmetrical flat antenna 100 as the first embodiment of the present invention can expand the bandwidth fb of the band C as compared with the bands A, B of the rectangular patch antenna 10 as related art and the asymmetrical flat antenna 110 of the comparative example by using motion of the resonance points.

The following will describe how to form the asymmetrical antenna pattern 103 in the asymmetrical flat antenna 100. FIGS. 8A, 8B, 9A, 9B, 10A, and 10B are process diagrams for showing examples of formation (1-3) of the asymmetrical antenna pattern 103 in the asymmetrical flat antenna 100.

According to this embodiment, the asymmetrical flat antenna 100 that has the reflection characteristic in broadband as shown in FIG. 7 and is improved to a better matching condition can be formed by optimizing the design (formation) method of the asymmetrical antenna pattern 103.

Figure 8A:
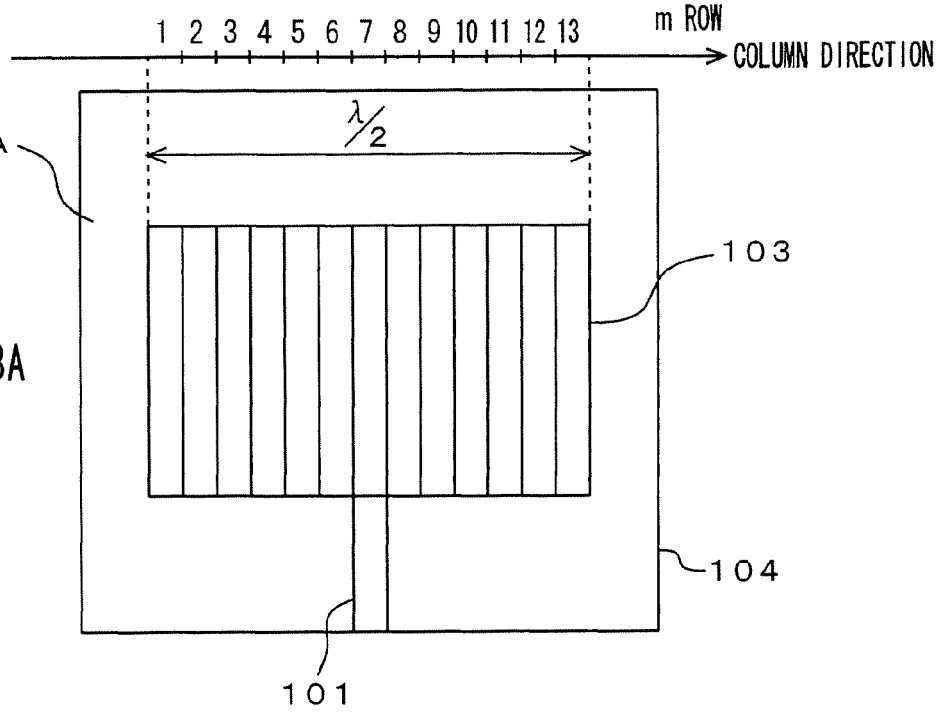
FIGS. 8A, 8B are process diagrams each for showing an example of formation (1) of the conductive asymmetrical antenna pattern 103 in the asymmetrical flat antenna 100.

First, two pieces of the rectangular patch antennas 10A each having a length of λ/2 in the longitudinal direction as shown in FIG. 8A are prepared. Each of the rectangular patch antennas 10A contains the insulation board 104 (insulation layer) as well as the power supply pattern 101 and the antenna pattern 103 that are formed as T shape and provided on the insulation board 104. The power supply pattern 101 and the antenna pattern 103 are formed on the insulation board 104 by using T-shaped remainder of copper foil left on the insulation board 104. Of course, the power supply pattern 101 and the antenna pattern 103 are not restricted to the copper foil but it is permissible to use those formed of metal foil or metal sheet or metal layers of gold, silver, brass, bronze, white copper or the like.

Next, the antenna pattern 103 extending from the power supply pattern 101 is formed as being asymmetrical with respect to the power supply pattern 101 as shown in FIG. 2. For example, the rectangular patch antenna 10A is divided into strip-shape blocks and the area of the strip is changed. This is because by adding or reducing components for changing the resonance frequency, an antenna which satisfies the design items can be searched by changing the resonance frequency.

Figure 8B:
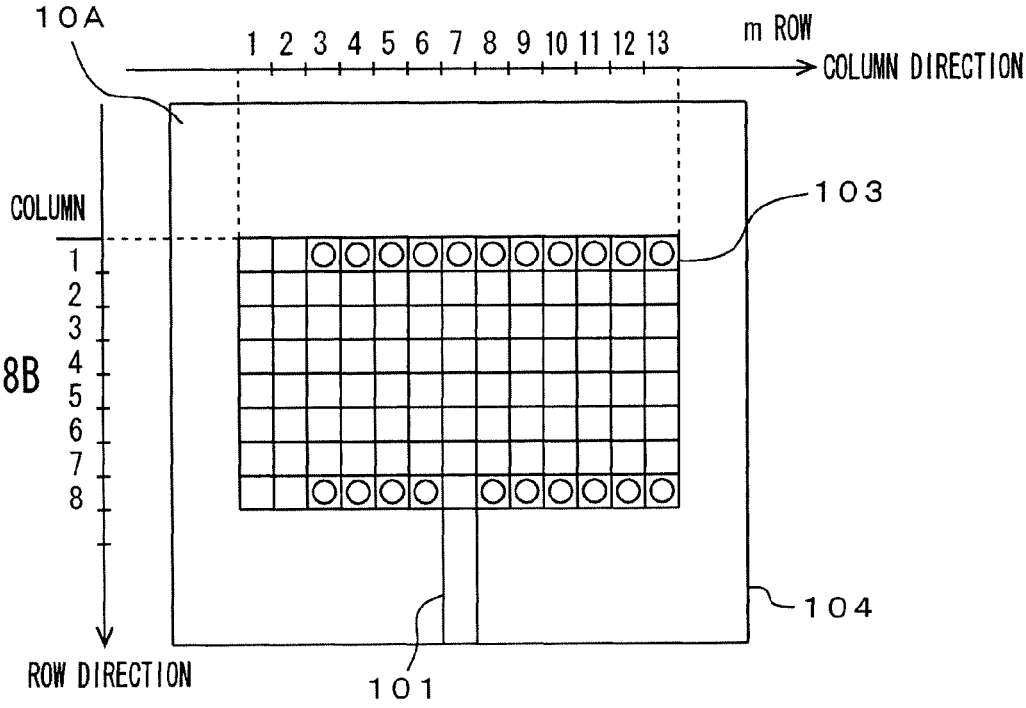

For example, the rectangular patch antenna 10A is divided into the strip-shape blocks by dividing the column direction thereof by m=13. After that, each of the strip-shape blocks is divided into grid-shape small patches by dividing the row direction thereof by n=8, as shown in FIG. 8B. Then, the resonance frequency can be moved by a method of removing any small patches of m×n=104 asymmetrically (pattern-searching method).

The divided position of each of the small patches is indicated by pmn (m=1 to 8, n=1 to 13). The small patches at positions p13-*p*113 indicated with circles as shown in FIG. 8B are first removed from the m×n small patches indicated in FIG. 8B. A total of 21 small patches at positions p83-*p*86 and p88-*p*813 are removed therefrom. The small patches are removed by establishing their areas and melting and peeling copper foil on their areas with etching fluid or shaving the copper foil on their areas with a blade.

Figure 9A:
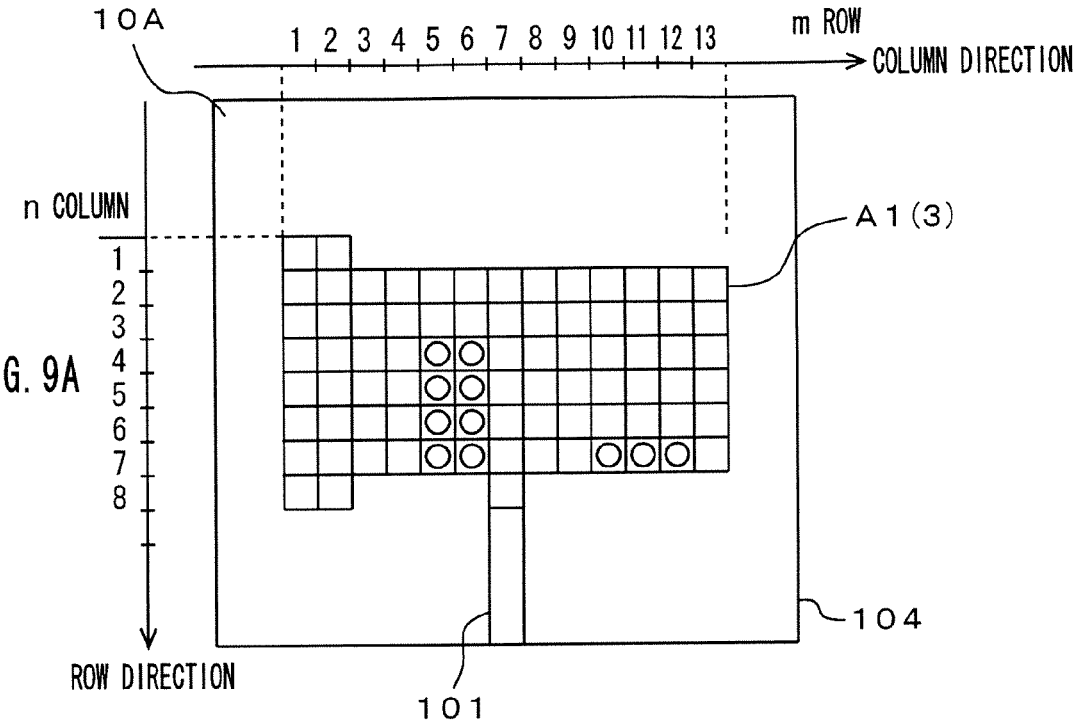
FIGS. 9A, 9B are process diagrams each for showing an example of formation (2) of the conductive asymmetrical antenna pattern 103 in the asymmetrical flat antenna 100.

Consequently, an asymmetrical antenna pattern A1(3) on a halfway stage shown in FIG. 9A is obtained. The reflection characteristic of this asymmetrical antenna pattern A1(3) is measured. To measure the reflection characteristic, the other asymmetrical flat antenna from which the small patches of the same positions are removed is set at an opposing position thereof, carrier of an arbitrary working frequency (for example, 3 GHz to 7 GHz) is supplied to one of the asymmetrical flat antennas, and a receiving gain is measured on the other asymmetrical flat antenna to verify that the resonance frequency is moved (see FIG. 11).

Figure 9B:
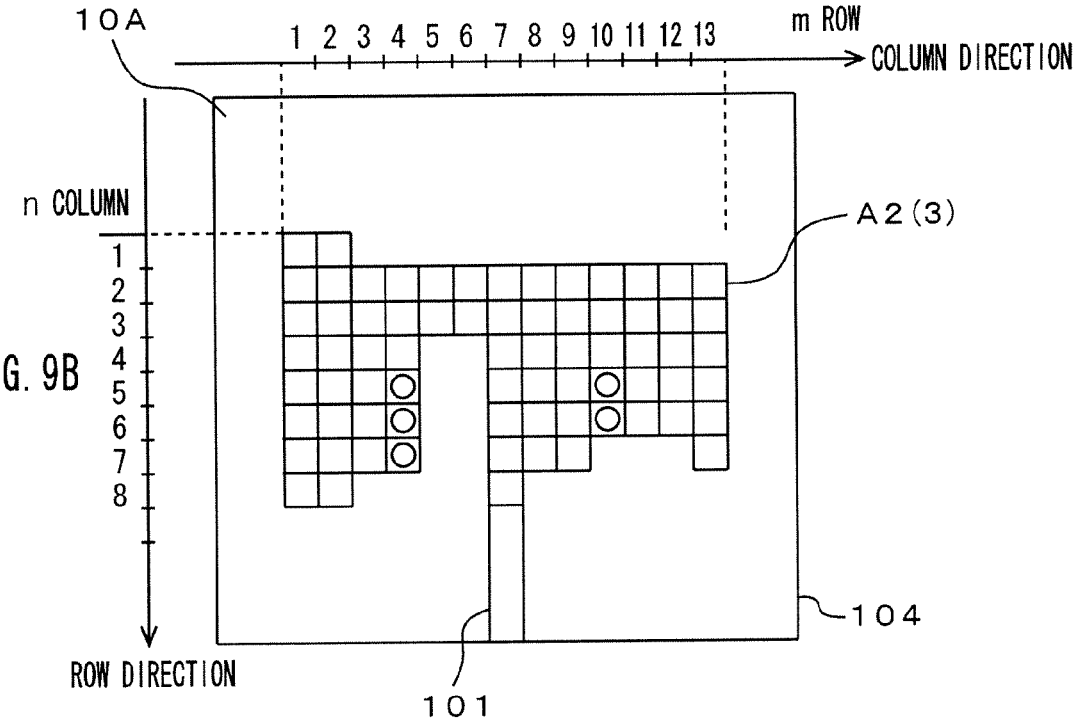

Further, a total of 11 small patches at positions p45, p46, p55, p56, p65, p66, p75, p76 and p710 to p712 indicated with circles shown in the FIG. 9A are removed from 83 small patches in the asymmetrical antenna pattern A1(3) shown in FIG. 9A in the above-described manner. Consequently, the asymmetrical antenna pattern A2(3) shown in FIG. 9B is obtained. The reflection characteristic of this asymmetrical antenna pattern A2(3) is measured.

Figure 10A:
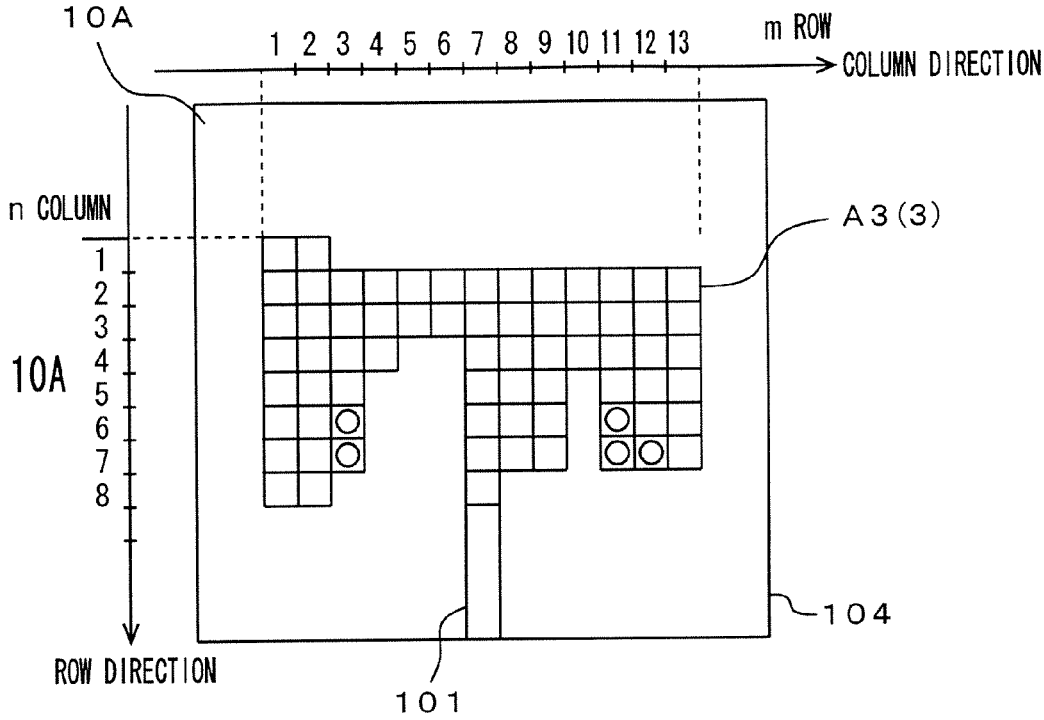
FIGS. 10A, 10B are process diagrams each for showing an example of formation (3) of the conductive asymmetrical antenna pattern 103 in the asymmetrical flat antenna 100.

A total of five small patches at positions p54, p510, p64, p610 and p74 indicated with circles in FIG. 9B are removed from 72 small patches in the asymmetrical antenna pattern A2(3) shown in FIG. 9B. Consequently, the asymmetrical antenna pattern A3(3) shown in FIG. 10A is obtained. The reflection characteristic of this asymmetrical antenna pattern A3(3) is measured.

Further, a total of five small patches at positions p63, p611, p73, p711 and p712 indicated with circles in the FIG. 10A are removed from 67 small patches in the asymmetrical antenna pattern shown in FIG. 10A in the above mentioned manner. Consequently, the asymmetrical flat antenna 100 having the asymmetrical antenna pattern 103 shown in FIG. 10B, namely, in FIG. 2 is obtained.

Figure 10B:
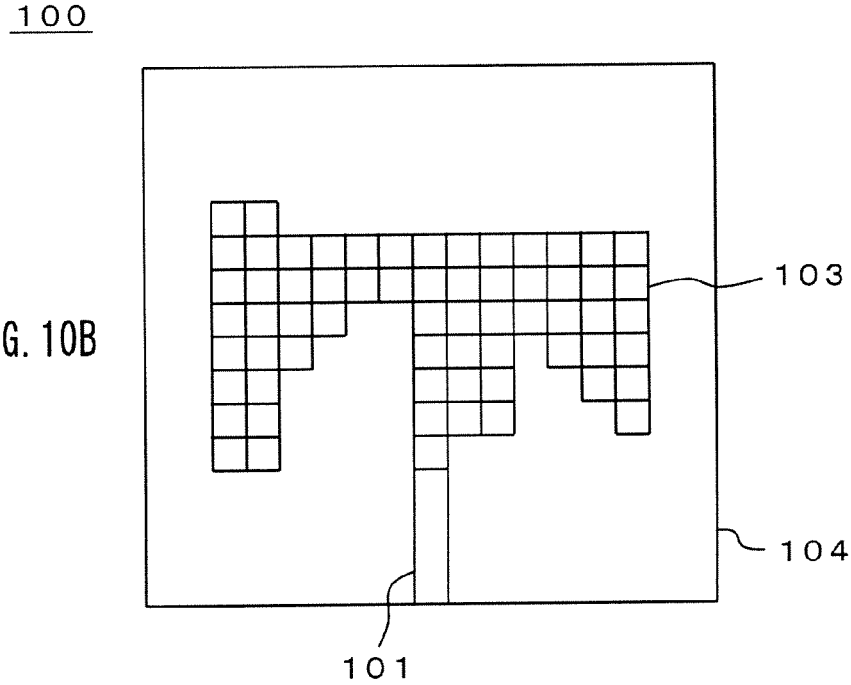

In the asymmetrical flat antenna 100 shown in FIG. 10B, 48 small patches at desired positions are removed from m×n=104 small patches shown in FIG. 8B with a total of 64 small patches at positions p11, p12, p21-*p*213, p31-*p*313, p41-*p*44, p47-*p*413, p51-*p*53, p57-*p*59, p511-*p*513, p61, p62, p67-*p*69, p612-*p*613, p71, p72, p77-*p*79, p613, p81, p82 and p87 left, thereby presenting an asymmetrical configuration. The reflection (transmission) characteristic of this asymmetrical antenna pattern 103 is measured.

Figure 11:
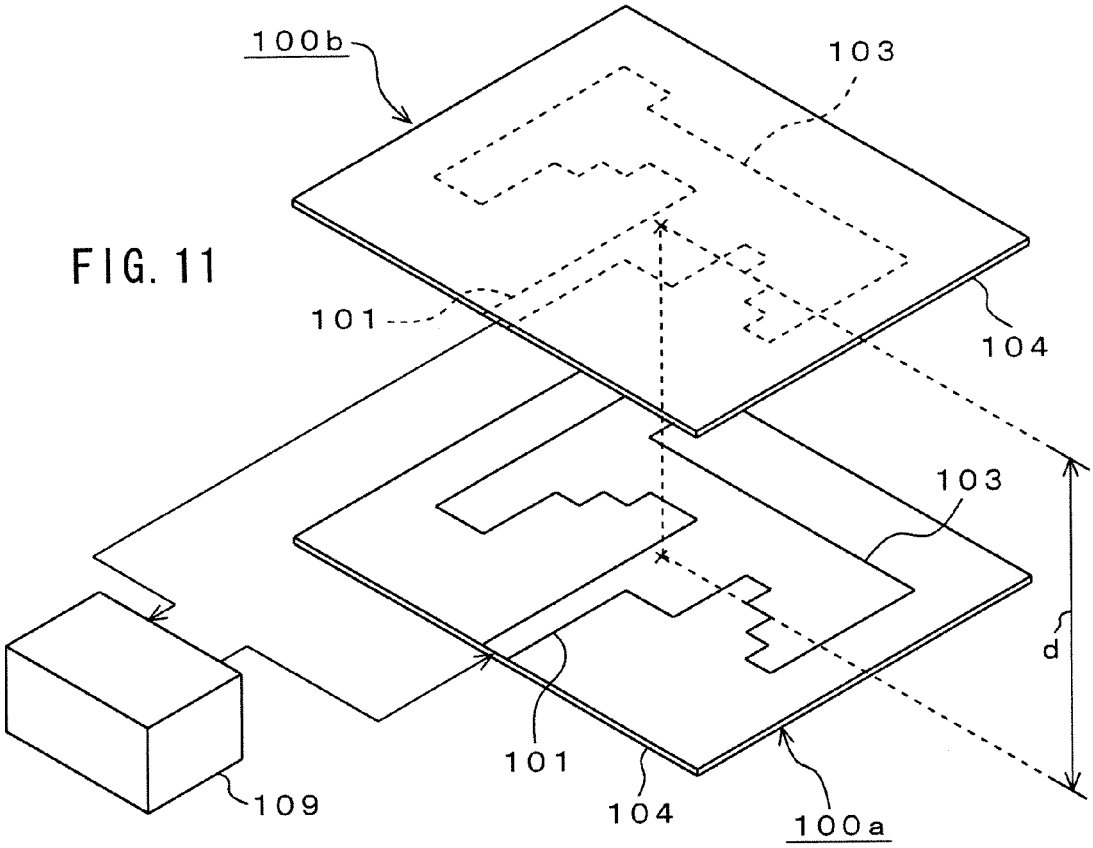
FIG. 11 is a perspective view of a pair of asymmetrical flat antennas 100*a*, 100*b* for showing a measurement example of transmission characteristic of the asymmetrical flat antenna 100*b;*

FIG. 11 shows a measurement example of transmission characteristic of the asymmetrical flat antenna 100. In the measurement example of the transmission characteristic of the asymmetrical flat antenna 100 shown in FIG. 10B, two asymmetrical flat antennas 100*a*, 100*b* shown in FIG. 11 from which small patches at the same positions are removed are placed at opposing positions. For example, the two asymmetrical flat antennas 100*a*, 100*b* as the first embodiment of the present invention are disposed plane-symmetrically with a separation distance "d" as shown in FIG. 11.

Then, the asymmetrical flat antenna 100*a* is connected to an output terminal (not shown) of an antenna-measuring device 109 and carrier of arbitrary working frequency (for example, 3 GHz to 7 Ghz) is supplied from the output terminal to the asymmetrical flat antenna 100*a*. The other asymmetrical flat antenna 100*b* is connected to an input terminal of the antenna-measuring device 109. When distance "d" between the antennas is changed, the antenna-measuring device 109 measures the receiving gain of the other asymmetrical flat antenna 100*b* to verify that the resonance frequency is moved so that the bandwidth fc can be expanded. The above mentioned design method of the asymmetrical flat antenna as the embodiments according to the present invention can be achieved by establishing the shape of FIG. 8A and measuring environment of FIG. 11 on a simulator and using an algorithm for searching an optimum characteristic, for example, combinational problem or the like.

Figure 12:
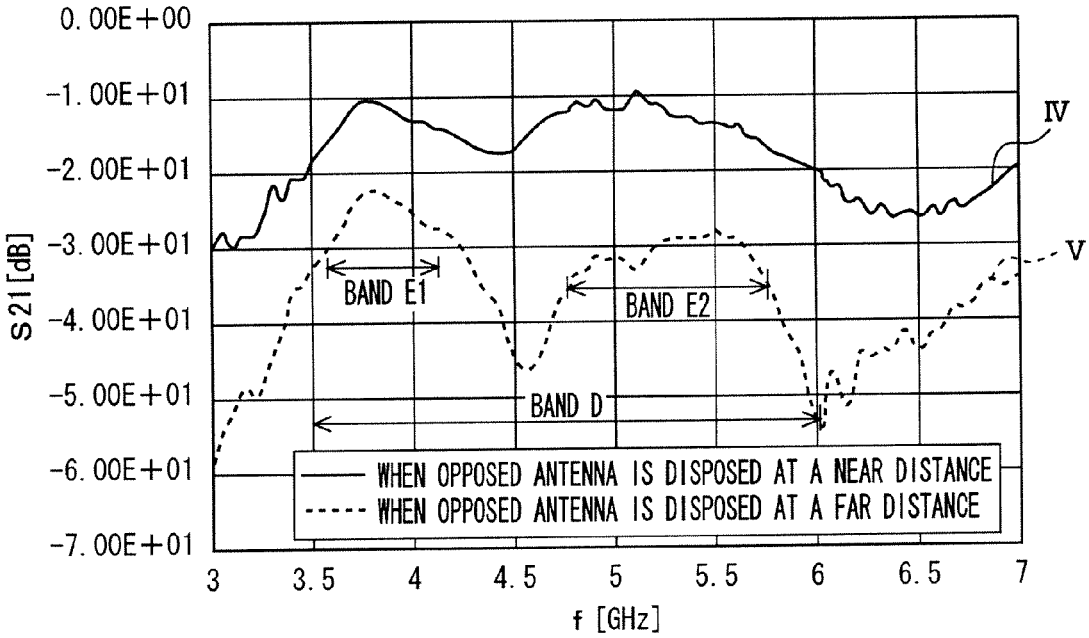
FIG. 12 is a graph for showing an example of transmission characteristic of the asymmetrical flat antenna 100*b;*

FIG. 12 shows a measurement example of the transmission characteristic of the asymmetrical flat antenna 100*b*. The transmission characteristic shown in FIG. 12 indicates transmission characteristics IV, V of the asymmetrical flat antenna 100*b* when the two asymmetrical flat antennas 100*a*, 100*b* as the first embodiment of the present invention are disposed plane-symmetrically and the distance "d" between the antennas is changed.

The vertical axis shown in FIG. 12 indicates transmission characteristic S21 [dB] of the asymmetrical flat antenna 100*b*. The horizontal axis shown in FIG. 12 indicates the working frequency [GHz] of these antennas 100*a*, 100*b*. The solid line indicates transmission characteristic IV in a case where the asymmetrical flat antenna 100*a* is fixed while the opposed asymmetrical flat antenna 100*b* is disposed at a near distance. The near distance mentioned here means the distance d between the antennas that is set to several tens mm or less although depending on the working frequency [GHz]. The dotted line indicates transmission characteristic V in a case where the asymmetrical flat antenna 100*a* is fixed while the opposed asymmetrical flat antenna 100*b* is disposed at a far distance. The far distance mentioned here means the distance "d" between the antennas that is set to other than the near distance.

As evident from FIG. 12, if the distance "d" between the antennas is increased by taking the asymmetrical flat antenna 100*b* away from the asymmetrical flat antenna 100*a*, a large convex vertical damping area occurs in a range of the band D in the transmission characteristic V shown in FIG. 11 so that pass band is reduced. That is, in the asymmetrical flat antenna 100*b*, the pass band is changed by increasing the distance "d" between the antennas.

If the asymmetrical flat antenna 100*b* is taken away from the asymmetrical flat antenna 100*a* in this example, the two bands E1, E2 that are excellent in transmission characteristics appear so that each of the respective asymmetrical flat antennas 10*a*, 10*b* indicates narrow band performance. When an area in which the pass band is changed relative to the distance "d" between the antennas is assumed to be "far field", an area in which the pass band is not changed is defined as "other than the far field".

Figure 13:
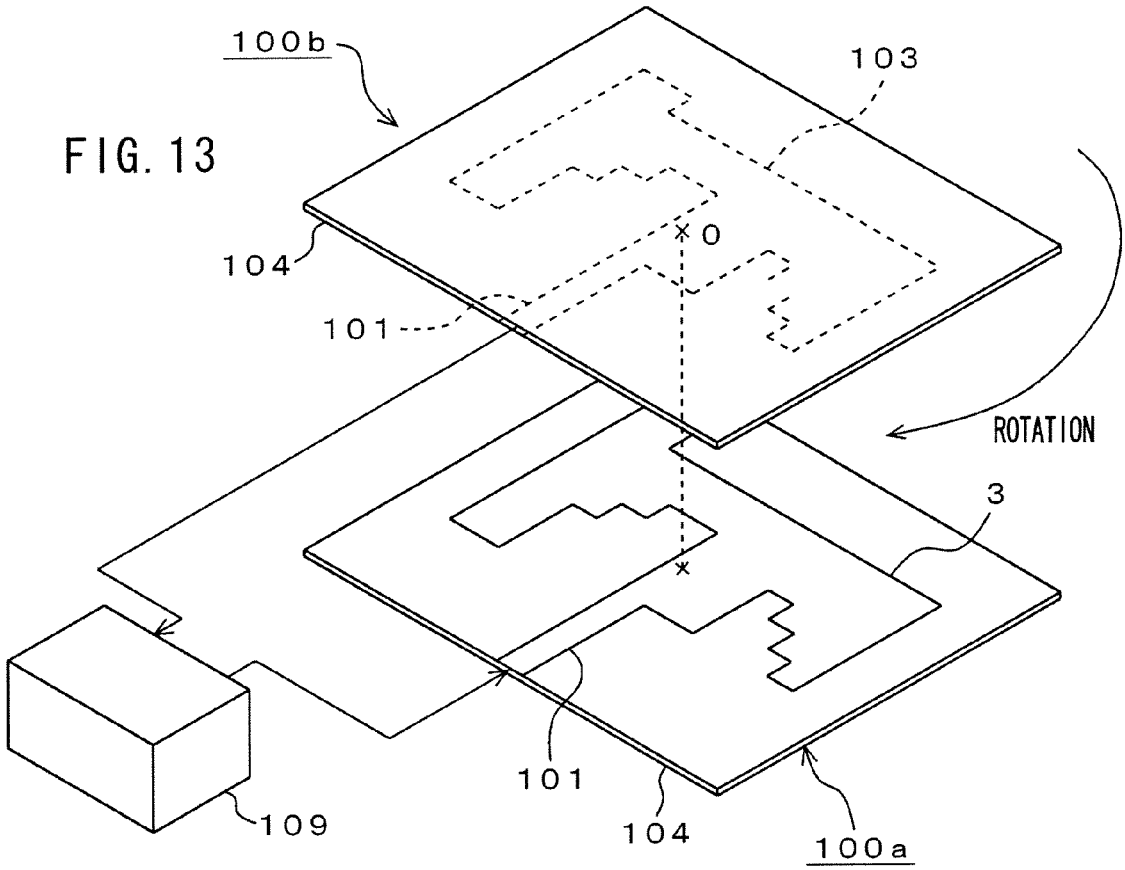
FIG. 13 is a diagram for showing a measurement example of transmission characteristic of the asymmetrical flat antenna 100*b* when the asymmetrical flat antennas 100*a*, 100*b* are rotated with them being opposed to each other.
Figure 14:
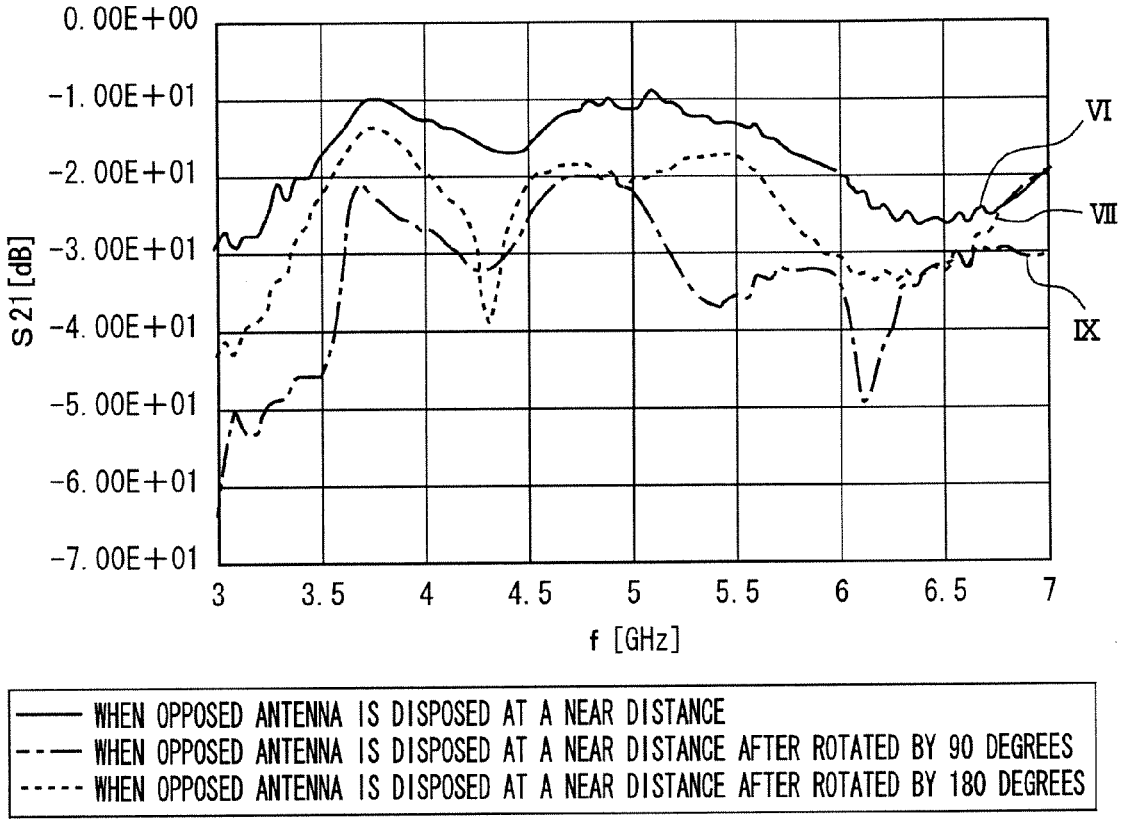
FIG. 14 is a graph for showing an example of transmission characteristic of the asymmetrical flat antenna 100*b* when the asymmetrical flat antennas 100*a*, 100*b* are rotated.

FIG. 13 shows a measurement example of the transmission characteristic when the asymmetrical flat antennas 100*a*, 100*b* are rotated with them being opposed to each other. In this measurement example, the asymmetrical flat antennas 100*a*, 100*b* shown in FIG. 13 are disposed plane-symmetrically. Further, the asymmetrical flat antenna 100*a* is fixed and the distance "d" between the antennas is fixed. Then, when the asymmetrical flat antenna 100*b* is rotated at degrees 0°, 90°, 180° in the same plane around a home position "O" in the FIG. 13, the antenna measuring device 9 measures the receiving gain of the asymmetrical flat antenna 100*b* to verify whether the resonance frequency is moved or the bandwidth fc is expanded. FIG. 14 indicates the transmission characteristic at that time.

FIG. 14 shows an example of the transmission characteristic when the asymmetrical flat antenna 100*b* is rotated. In the example of the transmission characteristic shown in FIG. 14, a vertical axis indicates transmission characteristic S21 [dB] of the asymmetrical flat antenna 100*b*. A horizontal axis shown in FIG. 14 indicates the working frequency [GHz] of these antennas 100*a*, 100*b*.

The solid line shown in FIG. 14 indicates transmission characteristic VI in a case where the asymmetrical flat antenna 100*a* is fixed at degree 0° while the opposed asymmetrical flat antenna 100*b* is disposed at a near distance. The dot and dash lines indicate transmission characteristic VII in a case where the asymmetrical flat antenna 100*a* is fixed while the opposed asymmetrical flat antenna 100*b* is disposed at a near distance and rotated at 90°. The dotted line indicates transmission characteristic IX in a case where the asymmetrical flat antenna 100*a* is fixed and the opposed asymmetrical flat antenna 100*b* is disposed at a near distance and rotated at 180°.

According to the example of transmission characteristic when the asymmetrical flat antennas 100*a*, 100*b* are rotated shown in FIG. 14, it is apparent that the broadest band is used when a rotation angle indicated in the transmission characteristic VI is 0°. Further, when the rotation angle indicated in the transmission characteristic VII is 180°, the band capable of transmission is reduced greatly. When the rotation angle indicated in the transmission characteristic IX is 90°, the band capable of transmission is also reduced.

In the asymmetrical flat antenna 100 and the like as the embodiments according to the invention, the conductive power supply pattern 101 is provided on the insulation board 104 or the insulation layer and the conductive antenna pattern 103 extends from this conductive power supply pattern 101. On this premise, the conductive antenna pattern 103 has asymmetrical configuration on the right and left sides with respect to the conductive power supply pattern 101.

Because the frequency resonance point in the antenna reflection characteristic can be adjusted by this structure, the band C of the asymmetrical flat antenna 100 can be expanded as compared with the band A based on the ratio of bandwidth of the rectangular patch antenna 10. Accordingly, the reflection characteristic III can be improved as compared with the reflection characteristic I of the rectangular patch antenna 10, and thus, it is possible to provide the asymmetrical flat antenna 100 having a single directivity, which is capable of being activated under condition of "other than the far field".

When the two asymmetrical flat antennas 100*a*, 100*b* are disposed plane-symmetrically, the broadest band performance is given. When the asymmetrical flat antennas 100*a*, 100*b* are disposed at each different angle and the two asymmetrical flat antennas are not disposed plane symmetrically, the bandwidth is reduced and each of the asymmetrical flat antennas 100*a*, 100*b* can be operated as two narrow band antennas. Further, the asymmetrical flat antennas 100*a*, 100*b* can perform the most effective communication when the two antennas are disposed with them being opposed to each other plane symmetrically.

The asymmetrical flat antenna 100 can suppress signal deterioration accompanying with multipath of electromagnetic wave due to reflection, refraction, diffraction or the like from components such as electronic components and mechanical components which affect the antenna characteristic because the asymmetrical flat antenna 100 has unidirectionality. This enables the signal deterioration accompanying with the multipath to be reduced.

Further, the asymmetrical flat antenna 100 and the like as the embodiments according to the present invention have unidirectionality so that it is possible to load components such as the electronic components and mechanical components on a plane of the multilayered board in which the antenna pattern 103 parallel to the multilayered board exists at a high density within a range not affecting the characteristic of the antenna because it has unidirectionality. Further, the asymmetrical flat antenna 100 and the like can be used in an environment in which multipath fading in wireless communication occurs because it has unidirectionality. For example, the asymmetrical flat antenna 100 can be used in an environment where it is surrounded by metal.

According to the asymmetrical flat antenna 100 shown in FIG. 2, it is capable for being formed in other shape on a plane by using the formation (design) method as an embodiment of the present invention, so that with a higher efficiency/broadband antenna can be created.

In the meantime, the asymmetrical flat antenna 100 as the embodiment of the present invention includes the antenna which has an antenna-matching pattern within the antenna main body regardless of the shape of the flat pattern in order to perform broadband wireless communication at a near distance and narrow band wireless communication at a far distance between the antennas within an electronic device casing, and has a broadband performance with a ratio of bandwidth of 11% or more in other than the far field and unidirectionality of an extent not affected by electronic component or mechanical component disposed around the antenna, thereby functioning as a broadband antenna in other than the far field and as a narrow band antenna in the far field. The asymmetrical flat antenna 100 exerts an antenna characteristic effective in an environment in which multipath fading occurs by its directivity in wireless transmission processing.

Because those skilled in the art can develop the antenna pattern configuration of the asymmetrical flat antenna 100 and the like as the embodiments according to the present invention to a three-dimensional structured one, the antenna which has an antenna-matching pattern (circuit) within an antenna main body in order to perform communication at a near distance between the antennas and has a broadband with a ratio of bandwidth of 11% or more and unidirectionality of an extent not affected by electronic and mechanical components disposed around the antenna, using the asymmetrical antenna pattern similar to that of embodiments according to the present invention which is developed to three-dimensions operable in other than the far field is also included in the asymmetrical flat antenna 100 as the embodiment of the present invention. The three-dimensional structured antenna having the same characteristic as that of the asymmetrical flat antenna 100 as the embodiment of the present invention by using the design method of an embodiment of the present invention in its three-dimensional structure is also included in the asymmetrical flat antenna 100 as the embodiment of the present invention.

(Signal-Processing Units)

The following will describe a signal-processing unit as embodiments according to the present invention. In each embodiment, an example of connection between the asymmetrical flat antenna 100 as the first embodiment of the present invention and the LSI device for signal processing will be described. The asymmetrical flat antenna 100, which is operable at a near distance, namely, other than the far field, can be used as a main portion of a signal-processing unit or an electronic device because it can be formed by the pattern search method shown in FIGS. 8A through 10B. Further, the asymmetrical flat antenna 100 can be loaded within the casing with its antenna characteristic designed to emit radio wave to a far distance being maintained.

Figure 15:
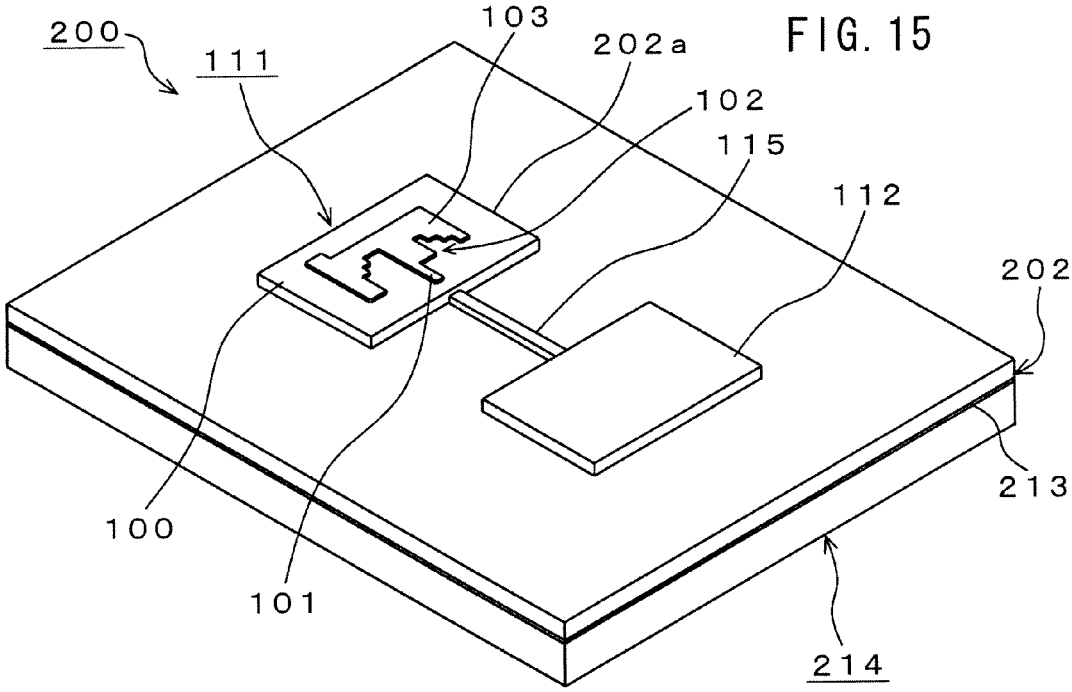
FIG. 15 is a perspective view of a signal-processing unit 200 as a fourth embodiment of the invention to which the asymmetrical flat antenna 100 is applied, for showing a configuration thereof.

FIG. 15 shows a configuration of a signal-processing unit 200 as a fourth embodiment of the invention to which the asymmetrical flat antenna 100 is applied. In this embodiment, the antenna pattern 103 is laid out (disposed) on a lamination structured device in which an ordinary multilayered board or dielectric is sandwiched between metal layers so as to form an antenna 111. This antenna 111 is connected to an LSI device 112 for signal processing through a transmission path 115. That is, in this structure, the dielectric is sandwiched between the antenna pattern 103 and the GND layer 213.

In the signal-processing unit 200 shown in FIG. 15, the signal-processing board is constituted to have the antenna 111 and the LSI device 112 on the multilayered board 214. The antenna 111 and the LSI device 112 are connected via the transmission path 115 so as to perform any signal processing. As the LSI device 112, one having a wireless IC (semiconductor integrated circuit) internally is used.

As the antenna 111, the asymmetrical flat antenna 100 as the first embodiment of the present invention is used. The asymmetrical flat antenna 100 has an insulation layer 202*a*, a conductive power supply pattern 101 provided on the insulation layer 202*a*, a conductive antenna-matching pattern 102 extending from this power supply pattern 101, and a conductive antenna pattern 103 extending from the antenna-matching pattern 102. For the power supply pattern 101, the antenna-matching pattern 102, and the antenna pattern 103, copper foil can be used. Materials of these patterns 101, 102, 103 are not restricted to the copper foil, metal foil, metal sheet or metal layers of gold, silver, brass, bronze, white copper or the like may be used.

The multilayered board 214 has the insulation layer 202 on the uppermost layer and the GND layer 213, which has an area larger than a projection area of the antenna pattern 103, provided under the insulation layer 202. The GND layer 213 is provided so that the antenna 111 can have unidirectionality. The insulation layer 204, the wiring layer 205, the insulation layer 206 and the like are overlaid under the GND layer 213 as shown in FIG. 3 like an ordinary multilayered board.

The LSI device 112 is provided on the insulation layer 202 adjacent to the antenna 111. The antenna pattern 103 and the LSI device 112 are connected through the transmission path 115, the power supply pattern 101 and the antenna-matching pattern 102. The antenna pattern 103 has an asymmetrical configuration with respect to the power supply pattern 101. Loading such an asymmetrical flat antenna enables any rapid information transmission processing using the asymmetrical flat antenna having antenna reflection characteristic whose frequency resonance point is adjusted to be realized.

The following will describe a method of manufacturing the signal-processing unit 200. First, the multilayered board 214 including the GND layer 213 is formed. In this embodiment, the multilayered board 214 is formed by using a double-sided copper foil board in which the copper foils are formed on both faces of the board (prepreg insulation board) or a single-sided copper foil board in which the copper foil is formed on a single face of the board. In the multilayered board 104*c* shown in FIG. 4, the insulation layer 206 and the wiring layer 205 are formed by using the insulation layer and the copper foil of the single-sided copper foil insulation board. For example, resist is patterned on the copper foil using a mask including a wiring pattern, exposed to light and developed and then, the wiring layer 205 with a desired configuration (not shown) is obtained by removing the copper foil at an unnecessary portion.

The insulation layer 204 and the GND layer 203 are formed by using the insulation layer and the copper foil of the single-sided copper foil insulation board. For example, resist is patterned on the copper foil using a mask including a ground pattern, exposed to light and developed and then, the GND layer 203 with a desired configuration (not shown) is obtained by removing the copper foil at an unnecessary portion. The multilayered board 214 can be formed by overlaying the aforementioned two single-sided copper foil insulation boards.

Next, the antenna 111 and the LSI device 112 are formed on the multilayered board 214. For example, the antenna 111 and the LSI device 112 are separately prepared and they are then bonded on the multilayered board 214. Relative to the antenna 111, the insulation layer 202*a*, the conductive power supply pattern 101, the antenna-matching pattern 102, and the conductive antenna pattern 103 are formed using the insulation layer and the copper foil of the single-sided copper foil insulation board. The conductive power supply pattern 101, the antenna-matching pattern 102, and the conductive antenna pattern 103 are formed based on the asymmetrical configuration found according to the pattern search method shown in FIGS. 8A through 10B. In the meantime, the antenna-matching pattern 102 is formed at a portion between the conductive power supply pattern 101 and the conductive antenna pattern 103 at the same time as the conductive power supply pattern 101 and the conductive antenna pattern 103 are formed. A configuration of antenna-matching pattern 102 is searched and defined at the same time as that of the conductive antenna pattern 103 is searched and defined.

Under these conditions, resist is patterned on the copper foil using, for example, a mask including the conductive power supply pattern 101, the antenna-matching pattern 102, and the conductive antenna pattern 103, exposed to light and developed. The copper foil at an unnecessary portion is removed to obtain the antenna 111 (the asymmetrical flat antenna 100) having the asymmetrical antenna pattern 103 as shown in FIG. 15. Thus, the conductive antenna pattern 103 extending from the conductive power supply pattern 101 formed on the insulation layer 202*a*, which has an asymmetrical configuration with respect to the conductive power supply pattern 101, can be formed.

In this embodiment, the antenna 111 is adhered to the multilayered board 214 using adhesive agent. As the LSI device 112, a semiconductor chip type unit or a package type unit prepared for any corresponding signal processing preliminarily is used. The LSI device 112 is physically adhered to the multilayered board 214 using adhesive agent. At this time, the I/O pins of the LSI device 112 are electrically connected (bonded) to the wiring layer of the multilayered board 214 using a connection method with a contact hole, a via hole, bump, wire or the like.

Next, the conductive antenna pattern 103 and the LSI device 112 are connected via the transmission path 115. For example, the conductive power supply pattern 101 of the antenna 111 and the wiring layer of the transmission path 115 are connected to each other via contact holes or via holes. The interior of each of the contact holes, the via holes or the like is, for example, filled with conductive material and heat-treated. Consequently, the signal-processing unit 200 in which the LSI device 112 for signal processing and the antenna 111 as the embodiments of the present invention are disposed on one face of the multilayered board 214 can be formed.

In the signal-processing unit 200 as the fourth embodiment of the invention, when the antenna 111 and the LSI device 112 are connected via the transmission path 115 so as to perform any signal processing, the asymmetrical flat antenna 100 as the first embodiment of the present invention and the like are applied as the antenna 111.

Thus, the signal-processing unit 200 can carry out the most efficient near distance wireless communication processing using the asymmetrical flat antenna 100 or the like operating under a condition of other than the far field, the bandwidth in the reflection characteristic of which is improved about five times as compared with the rectangular patch antenna 10. Additionally, because the antenna 111 to which the asymmetrical flat antenna 100 or the like is applied is provided with the antenna-matching pattern 2 which serves as a matching circuit for wiring impedance at a portion between the conductive power supply pattern 101 and the conductive antenna pattern 103, the wiring layer 205 (see FIG. 4) or the LSI device 112 can be connected to the antenna 111 directly. Thus, a step of placing signal wire between the LSI device and the board can be omitted and further, broadband information can be transmitted rapidly between the LSI device and the board.

Although, in this embodiment, a case of forming the insulation layer 202*a* under the layer of the antenna pattern 103 has been described, the present invention is not restricted to this. The insulation layer 202*a*, the conductive power supply pattern 101, the antenna-matching pattern 102, the conductive antenna pattern 103 and the wiring layer for the transmission path 115 are formed at the same time by using the insulation layer and the copper foil of the single-sided copper foil insulation board. For example, resist is patterned on the copper foil using a mask including the conductive power supply pattern 101, the antenna-matching pattern 102, the conductive antenna pattern 103, the wiring pattern for transmission path 115 and the LSI I/O electrode pattern, exposed to light and developed. The copper foil at an unnecessary portion is removed so as to obtain the conductive power supply pattern 101, the antenna-matching pattern 102, the conductive antenna pattern 103, the wiring pattern for transmission path 115, and the LSI I/O electrode pattern, having a desired configuration as shown in FIG. 15. Consequently, because these can serve as the insulation layer 202 at the same time, the insulation layer 202*a* under the layer of the conductive antenna pattern 103 of the antenna 111 and the like can be omitted.

Figure 16:
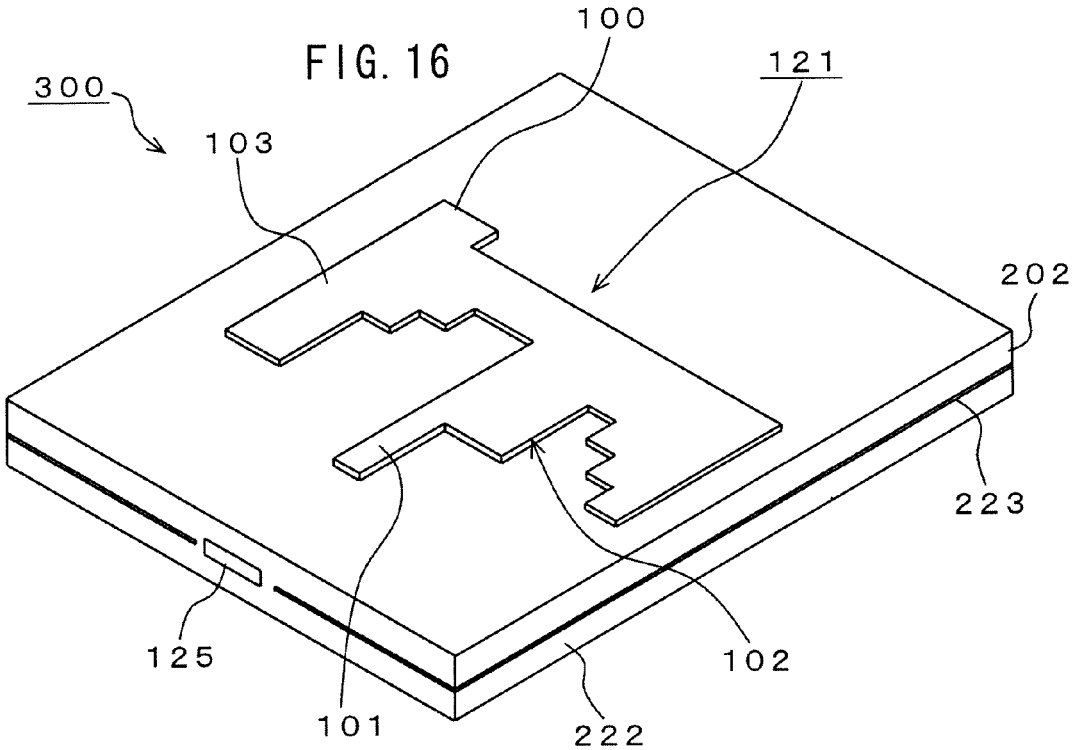
FIG. 16 is a perspective view of a signal-processing unit 300 as a fifth embodiment of the invention to which the asymmetrical flat antenna 100 is applied, for showing a configuration thereof.

FIG. 16 shows a configuration of a signal-processing unit 300 as a fifth embodiment of the invention to which the asymmetrical flat antenna 100 is applied.

In the signal-processing unit 300 of this embodiment, part of the LSI device 122 constitutes the asymmetrical flat antenna 121 and is connected to this antenna 121 to perform any signal processing. In this embodiment, the conductive antenna pattern 103 is disposed on the uppermost layer (metal wiring layer) of the signal processing LSI and the wiring layer thereunder is used as the GND layer 223, such that the signal processing LSI and the antenna 21 are connected to each other through via holes or the transmission path 125. In the meantime, a layer in which the GND layer 223 and the antenna 121 are laid out may be formed as a multilayered board or a lamination structure device in which dielectric is sandwiched between metal layers.

The signal-processing unit 300 shown in FIG. 16 constitutes a signal processing LSI and the antenna 121 is provided on the insulation layer 202. To the antenna 121, the asymmetrical flat antenna 100 as the embodiments of the present invention is applied. The asymmetrical flat antenna 100 has the conductive power supply pattern 101, the conductive antenna-matching pattern 102 extending from this power supply pattern 101, and the conductive antenna pattern 103 extending from the antenna-matching pattern 102, which are respectively provided on the insulation layer 202. The conductive antenna pattern 103 has an asymmetrical configuration with respect to the conductive power supply pattern 101. The conductive power supply pattern 101, the conductive antenna-matching pattern 102, and the conductive antenna pattern 103 are formed of copper foil and the like as in the fourth embodiment.

The GND layer 223 is provided under the insulation layer 202 and a semiconductor integrated circuit layer 222 is provided under this GND layer 223. As the semiconductor integrated circuit layer 222, a transistor circuit composed of GaAs compound semiconductor device, Si device or the like or an integration board of circuit devices for signal processing is used. A flattened protective insulation layer (not shown), which corresponds to the insulation layer 204 shown in FIGS. 3, 4, is provided on the uppermost layer of these circuit devices. This protective insulation layer is used instead of the insulation layer 204 shown in FIGS. 3, 4. As the semiconductor integrated circuit layer 222, one having the wireless IC (semiconductor integrated circuit) is used.

The GND layer 223 having a larger area than the antenna pattern 103 is provided on the semiconductor integrated circuit layer 222 so that the antenna 121 can have unidirectionality as in the fourth embodiment. The insulation layer 202 is overlaid on the GND layer 223. The transmission path 125 is buried in the insulation layer 202. The antenna 121 and the semiconductor integrated circuit layer 222 are connected to each other through the transmission path 125. Thus, loading such an asymmetrical flat antenna allows information rapid transmission processing using the asymmetrical flat antenna having the antenna reflection characteristic whose frequency resonance point is adjusted to be realized without placing the wire therein.

The following will describe a method of manufacturing the signal-processing unit 300. In this embodiment, an intermediate board having the antenna 121 and the GND layer 223 and the semiconductor integrated circuit layer 222 are separately prepared as well as the intermediate board and the semiconductor integrated circuit layer 222 are then bonded together.

First, a functional board including the insulation layer 202, the GND layer 223 provided on one face of the insulation layer 202, and the antenna pattern 103 provided on the other face of the insulation layer 202 is prepared.

In this embodiment, the double-sided copper foil insulation board in which the copper foils are formed on both sides of the board is used. For example, resist is patterned on the copper foil on one face of the double-sided copper foil insulation board using a mask including a wiring pattern for transmission path, ground pattern for GND and the like, exposed to light and developed. The copper foil at an unnecessary portion is then removed so as to obtain wiring layer (not shown) and the GND layer 223.

Further, resist is patterned on the copper foil of the other face of the double-sided copper foil insulation board using a mask including the conductive power supply pattern 101, the conductive antenna-matching pattern 102, and the conductive antenna pattern 103, exposed to light and developed. The copper foil at an unnecessary portion is then removed so as to obtain the antenna 121 (the asymmetrical flat antenna 100) having the asymmetrical antenna pattern 103 indicated in FIG. 16. Thus, the conductive antenna pattern 103 extending from the conductive power supply pattern 101 formed on the insulation layer 202, which has an asymmetrical configuration with respect to the power supply pattern 101, can be formed.

Further, as the semiconductor integrated circuit layer 222, a semiconductor chip type one or package type one prepared for any signal processing preliminarily is used. A flattened protective insulation layer, which corresponds to the insulation layer 204 shown in FIGS. 3, 4 is provided on the uppermost layer of the semiconductor integrated circuit layer 222. Electrodes each connected to the transmission path 125 are exposed from the protective insulation layer. This semiconductor integrated circuit layer 222 is adhered to the functional board having the antenna pattern 103 or the like on one face thereof while having the GND layer 223 and the transmission path 125 on the other face thereof using adhesive agent.

The GND layer side of the functional board is matched and adhered to the uppermost layer side of the semiconductor integrated circuit layer 222. At this moment, the I/O pins of the semiconductor integrated circuit layer 222 are connected to the transmission path 125 of the functional board by using solder bumps or the like. Of course, the connection method is not restricted to this example but they may be connected by filling the contact hole, the via hole or the like with conductive material and heat-treating. Thus, the signal-processing unit (the signal processing LSI) 300 having the GND layer 223 and the antenna 121 can be formed on the semiconductor integrated circuit layer 222 by bonding the aforementioned two components by overlaying.

In the meantime, the uppermost layer of the semiconductor integrated circuit layer 222 is not limited to the protective insulation layer but may be of multilayer wiring structure. The GND layer 223, the insulation layer 202, and the antenna pattern 103 may be introduced into this multilayer wiring structure. If the GND layer 223, the insulation layer 202, and the antenna pattern 103 are formed in an identical semiconductor process, bonding step of bonding multiple components can be omitted.

In the signal-processing unit 300 of this embodiment, when the antenna 121 and the semiconductor integrated circuit layer 222 are connected through the transmission path 125 to perform any signal processing, the asymmetrical flat antenna 100 or the like as the embodiment of the present invention is applied to the antenna 121.

Consequently, the signal-processing unit 300 can carry out the most efficient near distance wireless communication processing using the asymmetrical flat antenna 100 or the like operating under other conditions than the far field, the bandwidth in reflection characteristic of which is improved about five times as compared with the rectangular patch antenna 10.

Further, because in the antenna 121 to which the asymmetrical flat antenna 100 or the like is applies, the conductive antenna-matching pattern 102 which serves as a matching circuit for wiring impedance is provided at a portion between the conductive power supply pattern 101 and the conductive antenna pattern 103, the semiconductor integrated circuit layer 222 can be connected directly to the antenna 121. Consequently, not only the wiring length between the antenna 121 and the semiconductor integrated layer 222 can be reduced as much as possible but also a step of placing the signal wire for the signal processing LSI can be omitted. This enables broadband information to be transmitted rapidly between one signal processing LSI and another in an electronic device which combines plural signal processing LSIs.

In the method of manufacturing the signal-processing unit 300, a case of connecting the asymmetrical flat antenna 100 or the like as the embodiments of the present invention with the semiconductor integrated circuit layer 222 through the transmission path 125 or the via hole in a lamination order from the uppermost layer of the semiconductor integrated circuit layer 222, the GND layer 223, the insulation layer 202 to the conductive antenna pattern 103 has been described above, however the present invention is not restricted to this example. As a modification thereof, it is permissible to connect the asymmetrical flat antenna 100 or the like as the embodiments of the present invention with the I/O pin of an LSI package through the transmission path 125 or the via hole in a lamination order from the top of the LSI package, the GND layer 223, the insulation layer 202 to the conductive antenna pattern 103.

Figure 17:
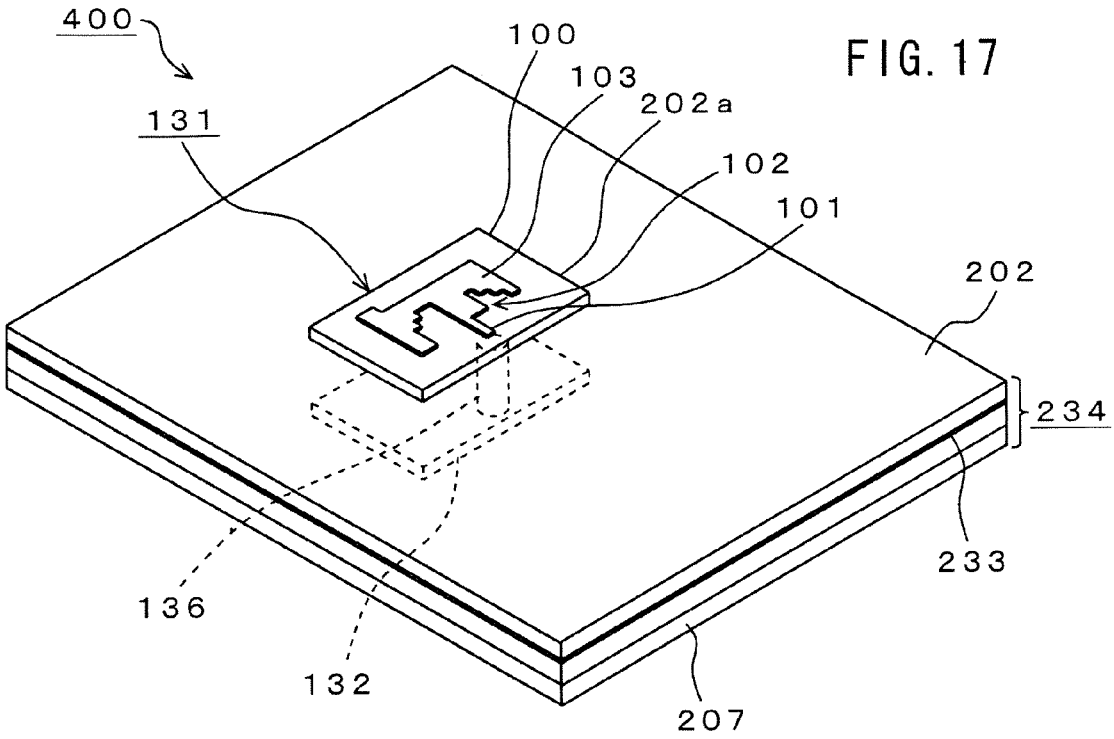
FIG. 17 is a perspective view of a signal-processing unit 400 as a sixth embodiment of the invention to which the asymmetrical flat antenna 100 is applied, for showing a configuration thereof.

FIG. 17 shows a configuration of a signal-processing unit 400 as a sixth embodiment of the invention to which the asymmetrical flat antenna 100 is applied. In this embodiment, a LSI device 132 for signal processing is disposed on one face of the integration structure device in which an ordinary multilayered board or dielectric is sandwiched between metal layers and an antenna 131 is disposed on the other face thereof.

A signal-processing unit 400 shown in FIG. 17 is provided with the antenna 131 on the surface of a multilayered board 234. The asymmetrical flat antenna 100 or the like as the embodiments of the invention is applied to the antenna 31. The asymmetrical flat antenna 100 has the conductive power supply pattern 1 provided on the insulation layer 202*a*, the conductive antenna-matching pattern 102 extending from this power supply pattern 101, and the conductive antenna pattern 103 extending from the antenna-matching pattern 102. The conductive antenna pattern 103 has an asymmetrical configuration with respect to the conductive power supply pattern 101. The conductive power supply pattern 101, the conductive antenna-matching pattern 102, and the conductive antenna pattern 103 are formed of copper foil or the like as in the forth embodiment.

The multilayered board 234 has the insulation layer 202 on its uppermost layer and the insulation layer 207 on its bottommost layer. The GND layer 233 having a larger area than the projection area of the conductive antenna pattern 103 is provided between this insulation layer 202 and the insulation layer 207. The GND layer 233 is provided such that the antenna 31 has unidirectionality.

The LSI device 132 for signal processing is provided on the rear face of the multilayered board 234. The lamination structure device in which the multilayered board 234 or dielectric is sandwiched between metal layers has an area larger than that of the antenna 131 or the LSI device 132 for signal processing. In sixth to eleventh embodiments, the size of the multilayered board, the lamination structure device or the like to their antenna, their LSI device and the like is the same. The antenna 131 and the LSI device 132 are connected to each other through a contact hole 136 (or via hole) passing through the multilayered board 234.

The following will describe a method of manufacturing the signal-processing unit 400. First, the multilayered board 234 including the GND layer 233 and the contact hole 136 is formed. In this embodiment, the multilayered board 234 is formed using the double-sided copper foil insulation board, single-sided copper foil insulation board or the like as in the fourth embodiment.

Next, the antenna 131 is formed on a face of the multilayered board 234. For example, as described in the fourth embodiment, the conductive power supply pattern 101, the conductive antenna-matching pattern 102, and the conductive antenna pattern 103 are formed on the insulation layer 202*a* using the insulation layer and the copper foil of the single-sided copper foil insulation board. Thus, the conductive antenna pattern 103 extending from the conductive power supply pattern 101, which has an asymmetrical configuration with respect to the conductive power supply pattern 101, is formed on the insulation layer 202*a*.

In this embodiment, the antenna 131 is adhered to the multilayered board 234 using adhesive agent. Further, as the LSI device 132, a semiconductor chip type one or package type one prepared for signal processing preliminarily is used as in the fourth embodiment. The LSI device 132 is adhered physically to the other face of the multilayered board 234 using adhesive agent. At this moment, the antenna I/O pins of the LSI device 132 are connected to the contact hole 136 by solder bonding or the like after positioning. Thus, the signal-processing unit 400 in which the LSI device 132 for signal processing is provided on one face of the multilayered board 234 while the antenna 131 is disposed on the other face thereof can be formed.

In the signal-processing unit 400 of this embodiment, when the antenna 131 and the LSI device 132 for signal processing are connected for signal processing, the LSI device 132 for signal processing is disposed on one face of the multilayered board 234 including the GDN layer 233 while the antenna 131 is disposed on the other face thereof so that the asymmetrical flat antenna 100 or the like as the embodiments of the present invention is applied to the antenna 131.

Consequently, the signal-processing unit 400 can carry out the most efficient near distance wireless communication processing using the asymmetrical flat antenna 100 or the like operating under other condition than the far field, the bandwidth in reflection characteristic of which is improved about five times as compared with the rectangular patch antenna 10.

Further, because in the antenna 131 to which the asymmetrical flat antenna 100 or the like is applied, the conductive antenna-matching pattern 102 which serves as a matching circuit for wiring impedance is provided at a portion between the conductive power supply pattern 101 and the conductive antenna pattern 103, the LSI device 132 can be connected to the antenna 131 directly through the contact hole 136. Consequently, the wiring length between the antenna 131 and the LSI device 132 can be reduced as much as possible and a step of placing signal wire for the LSI device 132 can be omitted. This allows broadband information to be transmitted rapidly between the signal-processing units in an electronic device combining a plurality of signal-processing units 400.

Figure 18:
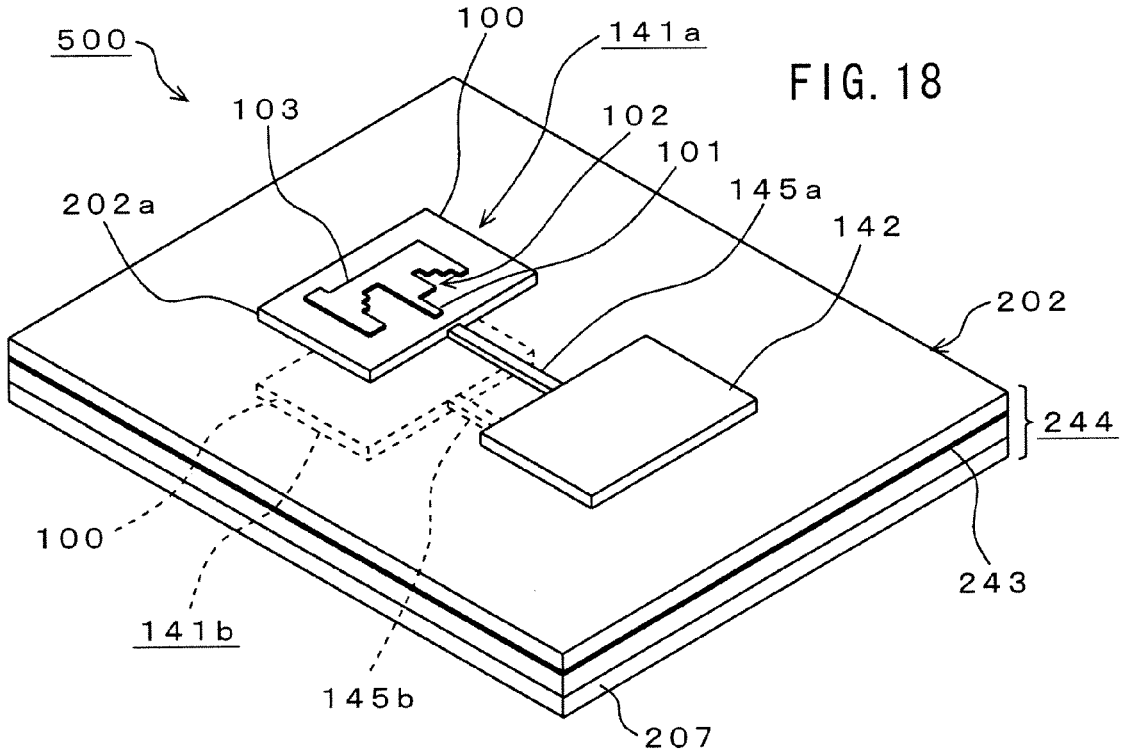
FIG. 18 is a perspective view of a signal-processing unit 500 as a seventh embodiment of the invention to which a pair of the asymmetrical flat antennas 100 is applied, for showing a configuration thereof.

FIG. 18 shows a configuration of a signal-processing unit 500 according to a seventh embodiment to which a pair of the asymmetrical flat antennas 100 is applied.

Although in the fourth embodiment, only one face of the multilayered board 114 has been provided with the antenna 111, according to this seventh embodiment, the both faces of the multilayered board 244 is also provided with antennas 141*a*, 141*b*, respectively.

In the signal-processing unit 500 shown in FIG. 18, a first antenna (first asymmetrical flat antenna) 141*a* is provided on a surface of the multilayered board 244 and a second antenna (second asymmetrical flat antenna) 141*b* is provided on a rear face of the multilayered board 244. The asymmetrical flat antenna 100 or the like as the embodiments of the present invention is applied to the antennas 141*a*, 141*b*. The asymmetrical flat antenna 100 has the conductive power supply pattern 101 provided on the insulation layer 202*a*, the conductive antenna-matching pattern 102 extending from this power supply pattern 101, and the conductive antenna pattern 103 extending from the antenna-matching pattern 102. The conductive antenna pattern 103 has an asymmetrical configuration with respect to the conductive power supply pattern 101. The conductive power supply pattern 101, the conductive antenna-matching pattern 102, and the conductive antenna pattern 103 are formed of copper foil or the like as in the fourth embodiment.

As in the sixth embodiment, the multilayered board 244 has the insulation layer 202 on its uppermost layer and the insulation layer 207 on its bottommost layer. The GND layer 243 having a larger area than a projection area of the conductive antenna pattern 103 is provided between this insulation layer 202 and the insulation layer 207. The GND layer 243 is provided so that the antennas 141*a*, 141*b* can have unidirectionality. The LSI device 142 for signal processing is provided on the surface of the multilayered board 244 adjacent to the antenna 141*a*.

The antenna 141*a* and the LSI device 142 are connected through a transmission path 145*a* on the insulation layer 202. For example, the LSI device 142 is provided with a plurality of pads. The transmission path 145*a* is wired from one of these pads directly to the antenna 141*a* on the insulation layer 202.

The other antenna 141*b* and the LSI device 142 are connected via a transmission path 145*b* provided in the insulation layer 207 and a contact hole (or via hole), not shown, passing through the multilayered board 244. For example, the other one of the plurality of pads provided on the LSI device 142 is connected to the contact hole passing through the multilayered board 244, the transmission path 145*b* is wired to this contact hole, and further, this transmission path 145*b* is connected to the antenna 141*b*.

The following will describe a method of manufacturing the signal-processing unit 500. First, the multilayered board 244 including the GND layer 243 and the contact hole is formed. In this embodiment, the multilayered board 244 is formed using the double-sided copper foil insulation board, the single-sided copper foil insulation board or the like as in the fourth embodiment.

Next, the first antenna 141*a* is formed on one face of the multilayered board 244. For example, as described in the fourth embodiment, the conductive power supply pattern 101, the conductive antenna-matching pattern 102, and the conductive antenna pattern 103 are formed on the insulation layer 202*a* using the insulation layer and the copper foil of the single-sided copper foil insulation board. Consequently, the first antenna 141*a* that contains the conductive antenna pattern 103 extending from the conductive power supply pattern 101, which has the asymmetrical configuration with respect to the conductive power supply pattern 101, is formed on the insulation layer 202*a*, Likewise, the second antenna 141*b* is formed on the other face of the multilayered board 244.

In this embodiment, the antennas 141*a*, 141*b* and the like are adhered to the front and rear faces of the multilayered board 244 using adhesive agent. Consequently, the antennas 141*a*, 141*b* and the like can be formed at the same time when the transmission path and the IC are disposed. As the LSI device 142, a semiconductor chip type one or package type one prepared for signal processing preliminarily is used as in the fourth embodiment. The LSI device 142 is adhered physically to the antenna 141*a* on one face of the multilayered board 244 using adhesive agent. At this moment, the antenna I/O pins of the LSI device 142 are positioned and connected to contact holes (not shown) of the multilayered board 244 by solder bonding or the like. Thus, the signal-processing unit 500 in which the antenna 141*a* and the LSI device 142 for signal processing are disposed on one face of the multilayered board 244 while the antenna 141*b* is disposed on the other face thereof can be formed.

In the signal-processing unit 500 of this embodiment, when the antennas 141*a*, 141*b* are respectively connected to the LSI device 142 for signal processing to perform any signal processing, the antenna 141*a* and the LSI device 142 are disposed on one face of the multilayered board 244 including the GND layer 243 while the antenna 141*b* is disposed on the other face thereof. In this moment, the asymmetrical flat antenna 100 or the like as the embodiments of the present invention is applied to the antennas 41*a*, 41*b*.

Thus, the signal-processing unit 500 can carry out the most efficient near distance wireless communication processing using the asymmetrical flat antenna 100 or the like operating under other condition than the far field, the bandwidth in reflection characteristic of which is improved about five times as compared with the rectangular patch antenna 10. Further, because the antennas 141*a*, 141*b* to which the asymmetrical flat antenna 100 or the like is applied are provided with the conductive antenna-matching pattern 102 which serves as a matching circuit for wiring impedance at a portion between the conductive power supply pattern 101 and the conductive antenna pattern 103, the LSI device 142 can be directly connected to the antennas 141*a*, 141*b*, respectively, through the transmission paths 145*a*, 145*b* and the contact holes. Consequently, not only the length of wiring between the antennas 141*a*, 141*b* and the LSI device 142 can be reduced as much as possible but also a step of placing signal wire for the LSI device 142 can be omitted. This allows broadband information to be transmitted rapidly between the signal-processing units 500 in an electronic device combining a plurality of the signal-processing units 500.

Figure 19:
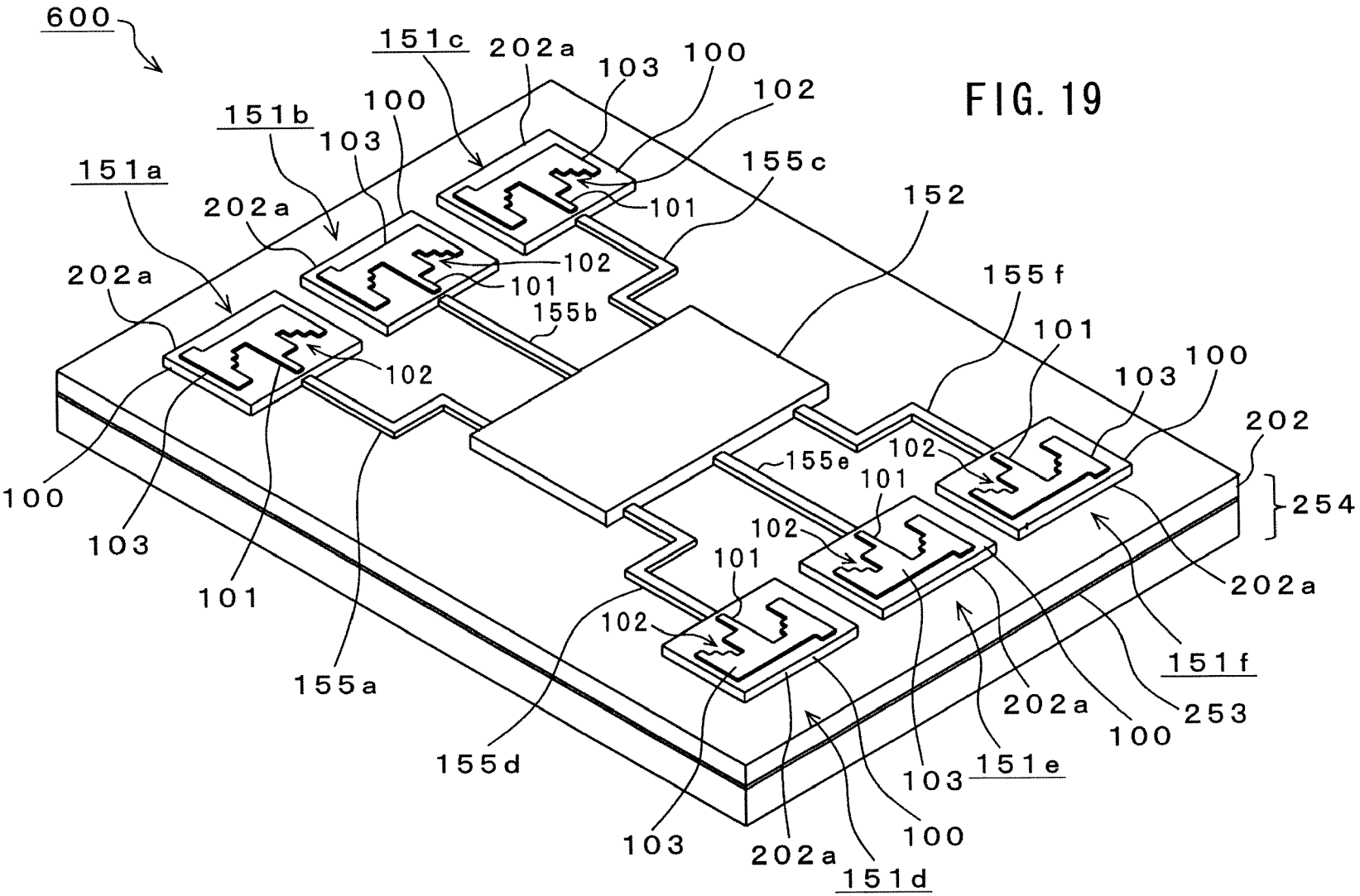
FIG. 19 is a perspective view of a signal-processing unit 600 as an eighth embodiment of the invention to which the plural asymmetrical flat antennas 100 are applied, for showing a configuration thereof.

FIG. 19 shows a configuration of a signal-processing unit 600 as an eighth embodiment to which a plurality of the asymmetrical flat antennas 100 is applied.

Although in the fourth embodiment, one antenna 111 has been provided on one face of the multilayered board 114, according to this eighth embodiment, a plurality of antennas 151*a*-151*c* and 151*d*-151*f* are provided on both sides of a multi-terminal type LSI device 152.

In the signal-processing unit 600 shown in FIG. 19, a multi-terminal type LSI device 152 for signal processing is provided on the surface of the multilayered board 254. An antenna I/O pad (not shown) is provided on one side of the LSI device 152 and another antenna I/O pad is also provided on the other side thereof. The LSI device 152 is provided, for example, in a center of the multilayered board 254. Three antennas 151*a*-151*c* and three antennas 151*d*-151*f* are respectively provided on both sides of this LSI device 152. These respective antennas 151*a*-151*f* are connected to the antenna I/O pads of the LSI device 152.

The asymmetrical flat antenna 100 or the like as the embodiments of the present invention is applied to these six antennas 151*a*-151*f*. The asymmetrical flat antenna 100 has the conductive power supply pattern 101 provided on the insulation layer 202*a*, the conductive antenna-matching pattern 102 extending from this power supply pattern 101, and the conductive antenna pattern 103 extending from the antenna-matching pattern 102. The conductive antenna pattern 103 has an asymmetrical configuration with respect to the conductive power supply pattern 101. The conductive power supply pattern 101, the conductive antenna-matching pattern 102, and the conductive antenna pattern 103 are formed of copper foil or the like as in the fourth embodiment.

The multilayered board 254 has the insulation layer 202 on the uppermost layer thereof as in the fourth embodiment and a GND layer 253 shared by the six antennas 151*a*-151*f* and provided under the insulation layer 202. The GND layer 253 has an area larger than a projection area of the conductive antenna pattern 103. The GND layer 53 is provided so that each of the antennas 151*a*-151*f* can have unidiriectivity.

The antennas 151*a*-151*c* on one side are respectively connected to the LSI device 152 through three transmission paths 155*a*-155*b* provided on the insulation layer 202. For example, from one of a plurality of pads provided on one side of the LSI device 152, the transmission path 155*a* is wired directly to the antenna 151*a* on the insulation layer 202. The transmission path 155*b* is wired directly to the antenna 151*b* in the same way. The transmission path 155*c* is wired directly to the antenna 151*c*.

The antennas 151*d*-151*f* on the other side are connected to the LSI device 152 through transmission paths 155*d*-155*f* provided on the insulation layer 202. For example, from one of the plurality of pads provided on the other side of the LSI device 152, the transmission path 155*d* is wired directly to the antenna 151*d* on the insulation layer 202. The transmission path 155*e* is wired directly to the antenna 151*e* in the same way. The transmission path 155*f* is wired directly to the antenna 151*f*.

The following will describe a method of manufacturing the signal-processing unit 600. In this embodiment, the LSI device 152 has a plurality of antenna I/O terminals (pin or pad) and this LSI device 152 is connected to the plural asymmetrical flat antennas 100 or the like as the embodiments of the present invention provided on the multilayered board 254 through plural wiring patterns (transmission paths) and the plural pads of the LSI device 152.

First, the multilayered board 254 including the GND layer 253 and the transmission paths 155*a*-155*f* is formed. In this embodiment, the multilayered board 254 including the GND layer 253 and the transmission paths 155*a*-155*f* is formed using the double-sided copper foil insulation board or the single-sided copper foil insulation board as in the fourth embodiment. Next, the LSI device 152 and the six antennas 151*a*-151*f* are formed on one face of the multilayered board 254.

For example, as described previously in the fourth embodiment, in association with each of the antennas 151*a*-151*f*, the conductive power supply pattern 101, the conductive antenna-matching pattern 102, and the conductive antenna pattern 103 are formed on the insulation layer 202*a* using the insulation layer and the copper foil of the single-sided copper foil insulation board. Consequently, the conductive antenna pattern 103, which extends from the conductive power supply pattern 101 and has an asymmetrical configuration with respect to the conductive power supply pattern 101, is formed on the insulation layer 202*a* of each of the antennas 151*a*-151*f*.

In this embodiment, the antennas 151*a*-151*f* and the like are adhered to the surface of the multilayered board 254 using adhesive agent. As the LSI device 152, a semiconductor chip type one or package type one prepared for signal processing preliminarily is used as in the fourth embodiment. The LSI device 152 has a plurality of pads for antenna I/O (not shown). The LSI device 152 is physically adhered to one face of the multilayered board 254 using adhesive agent with it being arranged between the three antennas 151*a*-151*c* and the three antennas 151*d*-151*f*.

At this time, the antenna I/O pads, not shown, of the LSI device 152 are positioned and bonded to the transmission paths 155*a*-155*c* and the transmission paths 155*d*-155*f* on the multilayered board 254 by solder bonding or the like. Consequently, the signal-processing unit 600 in which the LSI unit 152 is sandwiched between the antennas 151*a*-151*c* and 151*d*-151*f* on the right and left sides can be formed on an identical plane of the multilayered board 254.

When in the signal-processing unit 600 of this embodiment, the plural the antennas 151*a*-151*f* and the multi-terminal type LSI device 152 for signal processing are connected to perform any signal processing, the antennas 151*a*-151*f* and the LSI device 152 for signal processing are arranged on an identical plane of the multilayered board 254 including the GND layer 253 and the asymmetrical flat antenna 100 or the like as the embodiments of the present invention is applied to each of the antennas 151*a*-151*f*.

Consequently, the signal-processing unit 600 can carry out the most efficient near distance wireless communication processing using the asymmetrical flat antenna 100 or the like operating under other condition than the far field, the bandwidth in reflection characteristic of which is improved about five times as compared with the rectangular patch antenna 10. Further, because in the antennas 151*a*-151*f* each to which the asymmetrical flat antenna 100 or the like is applied, the conductive antenna-matching pattern 102 which serves as a matching circuit for wiring impedance is provided at a portion between the conductive power supply pattern 101 and the conductive antenna pattern 103, the LSI device 152 can be connected directly to each of the antennas 151*a*-151*c* at one side thereof through the transmission paths 155*a*-155*c*. The LSI device 152 can be also connected to each of the antennas 151*d*-151*f* at the other side thereof through the transmission paths 155*d*-155*f*.

Consequently, not only the length of wiring between the antennas 151*a*-151*c* and the LSI device 152 and between the antennas 151*d*-151*f* and the LSI device 152 can be reduced as much as possible but also a step of placing signal wire for the LSI device 152 can be omitted. This allows broadband information to be transmitted rapidly between the signal-processing units 600 in an electronic device combining a plurality of the signal-processing units 600.

A signal-processing unit which combines the seventh embodiment with the eighth embodiment can be constituted. For example, the antennas 151*a*-151*c* on one side of the multi-terminal type LSI device 152 and/or the antennas 151*d*-151*f* on the other side thereof are disposed on the rear face of the multilayered board 254 (or lamination structure device in which dielectric is sandwiched between metal layers) and the antennas 151*a*-151*c* and/or the antennas 151*d*-151*f* disposed on the rear face thereof are connected to the LSI device 152 via contact holes (via holes) and/or the transmission paths 155*a*-155*c* and the transmission paths 155*d*-155*f*. By constituting the unit by combining the embodiments of the signal-processing units appropriately, wireless signal processing can be executed using the plural antennas 151*a*-151*f* on the front and rear faces of the signal-processing unit.

Figure 20:
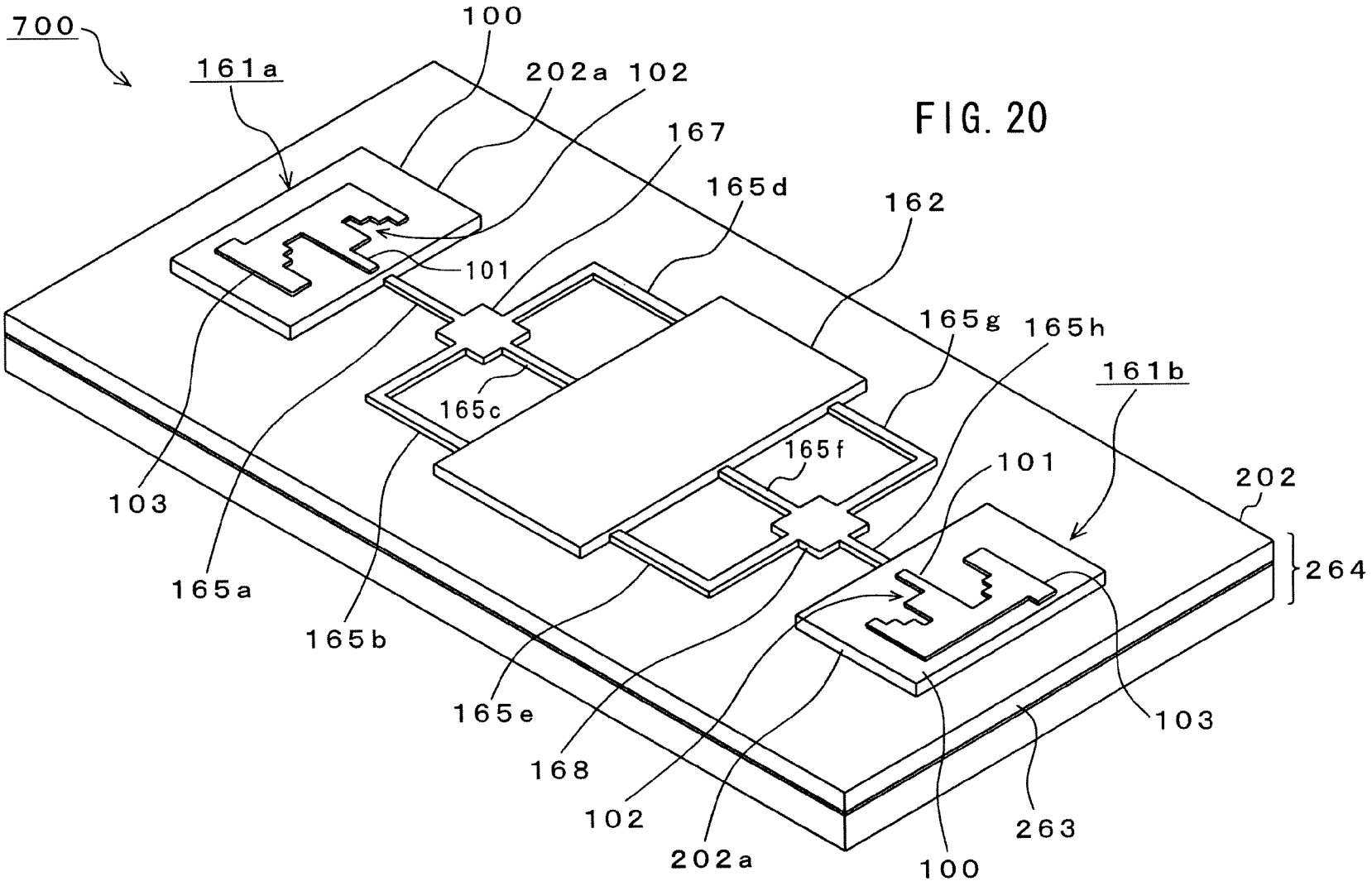
FIG. 20 is a perspective view of a signal-processing unit 700 as a ninth embodiment of the invention to which the asymmetrical flat antennas 100 are applied, for showing a configuration thereof.

FIG. 20 shows a configuration of the signal-processing unit 700 as a ninth embodiment of the invention to which the asymmetrical flat antennas 100 or the like are applied. In this embodiment, a multi-terminal type LSI device 162 for signal processing is connected to an antenna 161*a* for reception through a branching circuit 167 and the LSI device 162 is also connected to an antenna 161*b* for transmission through a synthesizing circuit 168.

The signal-processing unit 700 shown in FIG. 20 is provided with the multi-terminal type LSI device 162 for signal processing on the surface of the multilayered board 264. The multi-terminal type LSI device 162 has a plurality of pads, for example, 3 pads, (not shown) for antenna I/O on one side thereof and a plurality of pads, for example, 3 pads, (not shown) for antenna I/O on the other side thereof. The multi-terminal type LSI device 162 is provided in the center of the multilayered board 264. The single antenna 161*a* for reception is provided on a side of this LSI device 162 and the single antenna 161*b* for transmission is provided on the other side of this LSI device 162. The antennas 161*a*, 161*b* are respectively connected to three pads for antenna I/O of the multi-terminal type LSI device 162.

The asymmetrical flat antennas 100 or the like as the embodiments of the present invention are applied to these two antennas 161*a*, 161*b*. The asymmetrical flat antenna 100 has the conductive power supply pattern 101 provided on the insulation layer 202*a*, the conductive antenna-matching pattern 102 extending from this power supply pattern 101, and the conductive antenna pattern 103 extending from the antenna-matching pattern 102. The conductive antenna pattern 103 has an asymmetrical configuration with respect to the conductive power supply pattern 101. The conductive power supply pattern 101, the conductive antenna-matching pattern 102, and the conductive antenna pattern 103 are formed of copper foil or the like as in the fourth embodiment.

The multilayered board 264 has the insulation layer 202 on its uppermost layer as in the fourth embodiment and a GND layer 263 that has a larger area than a projection area of the conductive antenna pattern 103 and is shared by the two antennas 161*a*, 161*b* under the insulation layer 202. The GND layer 263 is provided so that each of the antennas 161*a*, 161*b* can have unidirectionality.

The antenna 161*a* for reception and the multi-terminal type LSI device 162 are connected to each other through a transmission path 165*a*, the branching circuit 167, and three wiring layers 165*b*-165*d*, which are provided on the insulation layer 202. For example, the antenna 161*a* on the insulation layer 202 is connected to the branching circuit 167 through the transmission path 165*a*. The branching circuit 167 is connected to one of the three pads for antenna input provided on the input side of the multi-terminal type LSI device 162 through the wiring layer 165*b*. Likewise, the branching circuit 167 is connected to remaining pads, respectively, for antenna input on the input side of the multi-terminal type LSI device 162 through the wiring layers 165*c* and 165*d*.

In the signal-processing unit 700, wire is placed from the conductive power supply pattern 101 of the single antenna 161*a* for reception to the transmission path 165*a* and the branching circuit 167 and the wiring layers 165*b*-165*d* are connected to the multiple terminals of the multi-terminal type LSI device 162 through this branching circuit 167. For example, when broadband information is received from any adjacent other signal-processing unit, the branching circuit 167 receives and divides (branches) the broadband information (signal) received by the antenna 161*a* for single reception. The branching circuit 167 then transmits the divided broadband information to each of the multiple terminals of the multi-terminal type LSI device 162. In the meantime, the branching circuit 167 may be incorporated in the multi-terminal type LSI device 162.

Further, the antenna 161*b* for transmission and the multi-terminal type LSI device 162 are connected to each other through three wiring layers 165*e*-165*g*, the synthesizing circuit 168, and a single transmission path 165*h*, which are provided on the insulation layer 202. For example, one of the three pads for antenna output provided on the output side of the multi-terminal type LSI device 162 is connected to the synthesizing circuit 168 through the wiring layer 165*e*. Likewise, the remaining pads for antenna output provided on the output side of the multi-terminal type LSI device 162 is connected to the synthesizing circuit 168 through the wiring layers 165*f* and 165*g*. This synthesizing circuit 168 is connected to the antenna 161*b* provided on the insulation layer 202 through the transmission path 165*h*.

In the signal-processing unit 700, wire is placed from the multiple terminals of the multi-terminal type LSI device 162 to the synthesizing circuit 168 via the wiring layers 165*e*-165*g* and the synthesizing circuit 168 is connected to the conductive power supply pattern 101 of the single antenna 161*b* for transmission through the transmission path 165*h*. For example, when broadband information is sent to any adjacent other signal-processing unit, the synthesizing circuit 168 receives and synthesizes the broadband information (signal) from the multiple terminals of the multi-terminal type LSI device 162 and transmits the synthesized information to the adjacent other signal-processing unit using the antenna 161*b* for transmission. In the meantime, the synthesizing circuit 168 may be incorporated in the multi-terminal type LSI device 162.

The following will describe a method of manufacturing the signal-processing unit 700. In this embodiment, the multi-terminal type LSI device 162 has a plurality of terminals (pins or pads) for antenna I/O and is connected to the asymmetrical flat antennas 100 or the like as the embodiments of the present invention each allocated for receiving or sending on the multilayered board 264 through the plurality of wiring patterns (transmission paths) and the plurality of pads of the multi-terminal type LSI device 162.

First, the multilayered board 264 including the GND layer 263, the transmission paths 165*a*, 165*h*, and the wiring layers 165*b*-165*g* is formed. In this embodiment, the multilayered board 264 including the GND layer 263, the transmission paths 165*a*, 165*h*, and the wiring layers 165*b*-165*g* is formed using the double-sided copper foil insulation board, the single-sided copper foil insulation board or the like as in the fourth embodiment. Next, the single multi-terminal type LSI device 162 and the two antennas 161*a*, 161*b* are formed on one face of the multilayered board 264.

For example, as described in the fourth embodiment, for the respective antennas 161*a*, 161*b*, the conductive power supply pattern 101, the conductive antenna-matching pattern 102, and the conductive antenna pattern 103 are formed on the insulation layer 202*a* using the insulation layer and the copper foil of the single-sided copper foil insulation board. Consequently, the antennas 161*a* and 161*b* each including the conductive antenna pattern 103, which extends from the conductive power supply pattern 101 and has an asymmetrical configuration with respect to the conductive power supply pattern 101, can be formed.

In this embodiment, the antennas 161*a*, 161*b* are adhered to the surface of the multilayered board 264 using adhesive agent. As the multi-terminal type LSI device 162, a semiconductor chip type one or a package type one prepared for signal processing preliminarily is used as in the fourth embodiment. The multi-terminal type LSI device 162 has a plurality of pads for antenna I/O (not shown). The multi-terminal type LSI device 162 is physically adhered to one face of the multilayered board 264 using adhesive agent with it being arranged between the antenna 161*a* for reception and the antenna 161*b* for transmission.

At this moment, the pads, not shown, for antenna I/O of the multi-terminal type LSI device 162 are positioned and wired to the wiring layers 165*b*-165*d* and 165*e*-165*g* of the multilayered board 264 by solder bonding or the like. Consequently, the signal-processing unit 700 in which the multi-terminal type LSI device 162 for signal processing is sandwiched between the antennas 161*a*, 161*b* on the right and left sides thereof on an identical plane of the multilayered board 264 can be formed.

In the signal-processing unit 700 of this embodiment, when the two antennas 161*a*, 161*b* for reception and transmission are connected to the multi-terminal type LSI device 162 for signal processing in order to execute any signal processing, the antennas 161*a*, 161*b* and the LSI device 162 are arranged on an identical plane of the multilayered board 264 including the GND layer 263. In this moment, the asymmetrical flat antenna 100 or the like as the embodiments of the present invention is applied to each of the antennas 61*a*, 61*b*.

Consequently, the signal-processing unit 700 can carry out the most efficient near distance wireless communication processing using the asymmetrical flat antenna 100 or the like operating under other condition than the far field, the bandwidth in reflection characteristic of which is improved about five times as compared with the rectangular patch antenna 10. Further, because in the antennas 161*a*, 161*b* each to which the asymmetrical flat antenna 100 or the like is applied, the conductive antenna-matching pattern 102 which serves as a matching circuit for wiring impedance is provided at a portion between the conductive power supply pattern 101 and the conductive antenna pattern 103, the antenna 161*a* can be connected simply to the input side of the multi-terminal type LSI device 162 through the transmission path 165*a*, the branching circuit 167, and the wiring layers 165*b*-165*d* and the antenna 161*b* can be connected simply to the output side of the multi-terminal type LSI device 162 through the wiring layers 165*e*-65*g*, the synthesizing circuit 168, and the transmission path 165*h*.

Consequently, not only the lengths of wire between the antenna 161*a* and the multi-terminal type LSI device 162 and between the LSI device 162 and the antenna 161*b* can be reduced as much as possible, but also the step of placing the signal wire for the multi-terminal type LSI device 162 can be omitted. This allows broadband information to be transmitted rapidly between the signal-processing units 700 in an electronic device which combines a plurality of the signal-processing units 700.

In the meantime, a signal-processing unit which combines the seventh embodiment with the ninth embodiment can be constituted. For example, the antenna 161*a* and the antenna 161*b* on both sides of the multi-terminal type LSI device 162 shown in FIG. 20 are disposed on the rear face of the multilayered board 264 (or lamination structure device in which dielectric is sandwiched between metal layers) and the antenna 161*a* and the antenna 161*b* disposed on the rear face thereof are connected through the contact holes (via holes), the transmission path 165*a* and the transmission path 165*h*. By constituting the unit by combining the embodiments of the signal-processing units appropriately, wireless signal processing can be executed using the plural antennas 161*a*, 161*b* provided on the front and rear faces of the signal-processing unit.

Figure 21:
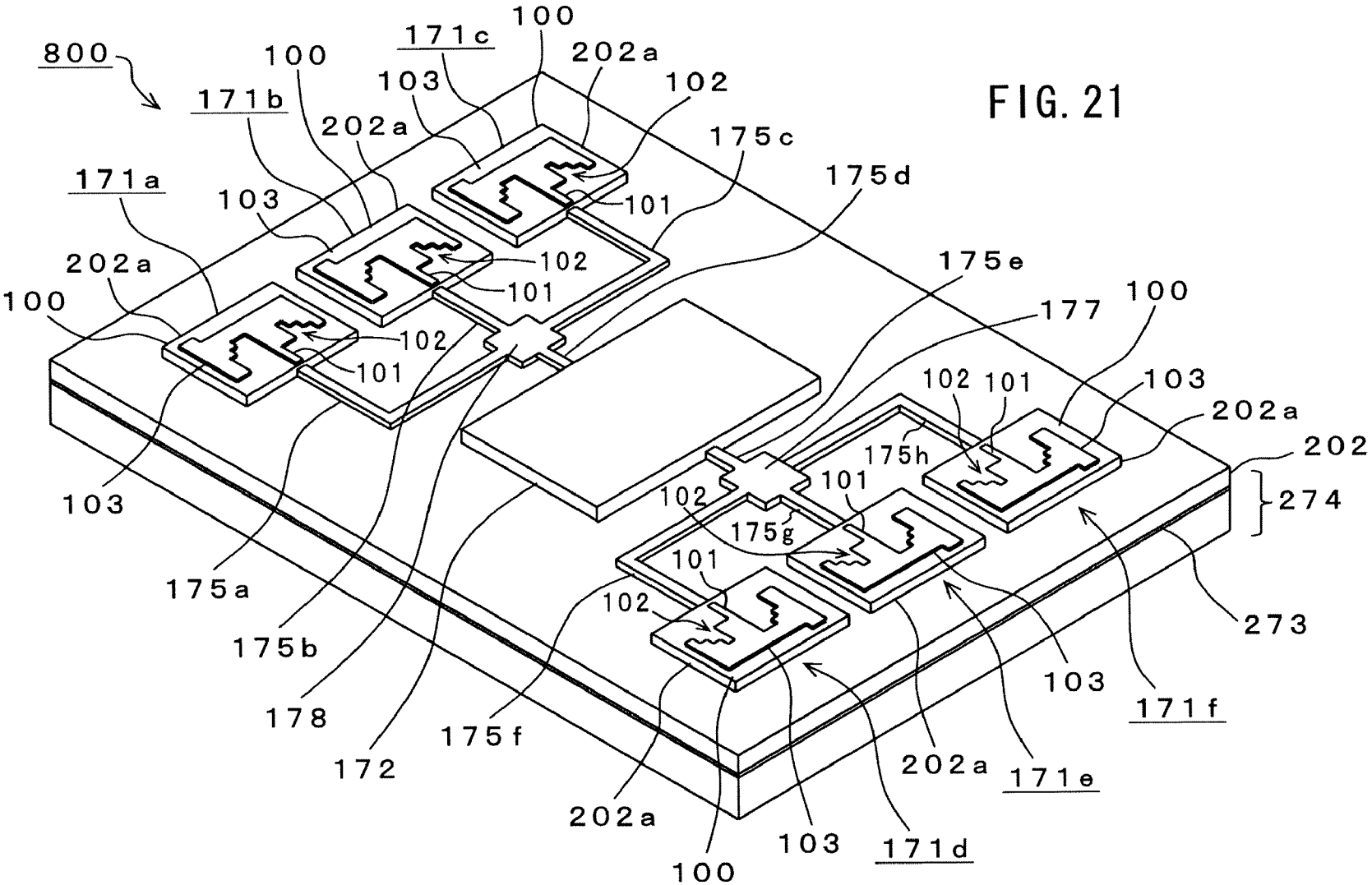
FIG. 21 is a perspective view of a signal-processing unit 800 as a tenth embodiment of the invention to which the asymmetrical flat antennas 100 are applied, for showing a configuration thereof.

FIG. 21 shows a configuration of a signal-processing unit 800 as a tenth embodiment of the invention to which the asymmetrical flat antennas 100 or the like are applied. In this embodiment, a LSI device 172 for signal processing and three antennas 171*a*-171*c* for reception are connected to each other through a synthesizing circuit 178 and the LSI device 172 and three antennas 171*d*-171*f* are connected to each other through a branching circuit 177.

In the signal-processing unit 800 shown in FIG. 21, the LSI device 172 for signal processing is provided on the surface of the multilayered board 274. A pad for antenna input (not shown) is provided on one side of the LSI device 172 and a pad for antenna output (not shown) is provided on the other side thereof. The LSI device 172 is provided, for example, in a center of the multilayered board 274. The three antennas 171*a*-171*c* for reception are provided on a side of the LSI device 172 and the three antennas 171*d*-171*f* for transmission are provided on the other side thereof. The three antennas 171*a*-171*c* are connected to the pad for antenna input of the LSI device 172 through the synthesizing circuit 178 and the pad for antenna output of the LSI device 172 is connected to the three antennas 171*d*-171*f* through the branching circuit 177.

The asymmetrical flat antenna 100 or the like as the embodiments of the present invention is applied to each of these six antennas 171*a*-171*c*, 171*d*-171*f*. The asymmetrical flat antenna 100 has the conductive power supply pattern 101 provided on the insulation layer 202*a*, the conductive antenna-matching pattern 102 extending from this power supply pattern 101, and the conductive antenna pattern 103 extending from the antenna-matching pattern 102. The conductive antenna pattern 103 has an asymmetrical configuration with respect to the conductive power supply pattern 101. The conductive power supply pattern 101, the conductive antenna-matching pattern 102, and the conductive antenna pattern 103 are formed of copper foil or the like as in the fourth embodiment.

The multilayered board 274 has the insulation layer 202 on its uppermost layer as in the fourth embodiment and a GND layer 273, which has a larger area than a projection area of the conductive antenna pattern 103 and is shared by the six antennas 171*a*-171*f*, under the insulation layer 202. The GND layer 73 is provided so that each of the antennas 171*a*-171*f* can have unidirectionality.

The three antennas 171*a*-171*c* for reception and the LSI device 172 are connected to each other through three transmission paths 175*a*-175*c*, the synthesizing circuit 178, and a wiring layer 175*d*, which are provided on the insulation layer 202. For example, the antennas 171*a*-171*c* on the insulation layer 202 are connected to the synthesizing circuit 178 through the respective transmission paths 175*a*-175*c*. The synthesizing circuit 178 is connected to a pad for antenna input provided on the input side of the LSI device 172 through the wiring layer 175*d*.

In the signal-processing unit 800, wire is placed from the conductive power supply pattern 101 of each of the three antennas 171*a*-171*c* for reception to the transmission paths 175*a*-175*c* and the synthesizing circuit 178 and this multiplexing circuit 178 is connected to the antenna input terminal of the LSI device 172 through the wiring layer 175*d*. For example, when broadband information is received from any adjacent other signal-processing unit, the synthesizing circuit 178 receives and synthesizes the broadband information (signal) received by the three antennas 171*a*-171*c* for reception and supplies the synthesized information to the antenna input terminal of the LSI device 172. In the meantime, the synthesizing circuit 178 may be incorporated in the LSI device 172.

The three antennas 171*d*-171*f* for transmission and the LSI device 172 are connected to each other through a wiring layer 175*e*, the branching circuit 177, and the three transmission paths 175*f*-175*h*, which are provided on the insulation layer 202. For example, a pad for antenna output provided on the output side of the LSI device 172 is connected to the branching circuit 77 through the wiring layer 175*e*. This branching circuit 177 is connected to the respective antennas 171*d*-171*f* on the insulation layer 202 through the three transmission paths 175*f*-175*h*.

In the signal-processing unit 800, wire is place from the antenna output terminal of the LSI device 172 to the branching circuit 177 through the wiring layer 175*e* and this branching circuit 177 is connected to the conductive power supply pattern 101 of each of the antennas 171*d*-171*f* for transmission through the three transmission paths 175*f*-175*h*. For example, when broadband information is transmitted to any adjacent other signal-processing unit, the branching circuit 177 divides the broadband information (signal) from the antenna output terminal of the LSI device 172 into three and transmits three-divided information to the adjacent other signal-processing unit using the three antennas 171*d*-171*f* for transmission. In the meantime, the branching circuit 177 may be incorporated in the LSI device 172.

The following will describe a method of manufacturing the signal-processing unit 800. In this embodiment, the LSI device 172 has each terminal (pin or pad) for antenna input and antenna output and is also connected to each of the asymmetrical flat antennas 100 or the like as the embodiments of the present invention, which are allocated for reception and transmission, through the branching circuit 177, the synthesizing circuit 178, and the plural transmission paths 175*a*-75*c*, 175*f*-175*h*.

First, the multilayered board 274 including the GND layer 273, the transmission paths 175*a*-175*c*, 175*f*-175*h*, the branching circuit 177, the synthesizing circuit 178, and the wiring layers 175*d*, 175*e* is formed. In this embodiment, the multilayered board 274 including the GND layer 273, the transmission paths 175*a*-175*c*, 175*f*-175*h*, the branching circuit 177, the synthesizing circuit 178, the wiring layers 175*d*, 175*e* is formed using the double-sided copper foil insulation board, single-sided copper foil insulation board or the like. Next, one LSI device 172 and six antennas 171*a*-171*c*, 171*d*-171*f* are formed on one face of the multilayered board 274.

As described in the fourth embodiment, in each of the antennas 171*a*-171*c*, 171*d*-171*f*, the conductive power supply pattern 101, the conductive antenna-matching pattern 102, and the conductive antenna pattern 103 are formed on the insulation layer 202*a* using the insulation layer and the copper foil of the single-sided copper foil insulation board. Consequently, the antennas 171*a*-171*c*, 171*d*-171*f* each including the conductive antenna pattern 103, which extends from the conductive power supply pattern 101 on the insulation layer 202*a* and has an asymmetrical configuration with respect to the conductive power supply pattern 101, are formed.

In this embodiment, the six antennas 171*a*-171*f* are adhered to the surface of the multilayered board 274 using adhesive agent. As the LSI device 172, a semiconductor chip type one or a package type one prepared for signal processing preliminarily is used as in the fourth embodiment. The LSI device 172 has pads for antenna input and antenna output (not shown). The LSI device 172 is physically adhered to one face of the multilayered board 274 using adhesive agent with it being arranged between the antennas 171*a*-171*c* for reception and the antennas 171*d*-171*f* for transmission.

The antenna input and antenna output pads, not shown, of the LSI device 172 are positioned and adhered to the wiring layers 175*d*, 175*e* of the multilayered board 274 by solder bonding or the like. Consequently, the signal-processing unit 800 in which the LSI device 172 for signal processing is sandwiched between the branching circuit 177 and the antennas 171*a*-171*c* of left side thereof and the synthesizing circuit 178 and the antennas 171*d*-171*f* on the right side thereof on an identical plane of the multilayered board 274, can be formed.

In the signal-processing unit 800 of this embodiment, when the six antennas 171*a*-171*f* for reception and transmission and the LSI device 172 for signal processing are connected to each other to perform any signal processing, the antennas 171*a*-171*c*, 171*d*-171*f* for reception and transmission and the LSI device 172 for signal processing are arranged on an identical plane of the multilayered board 274 including the GDN layer 273. In this moment, the asymmetrical flat antenna 100 or the like as the embodiments of the present invention is applied to each of the antennas 171*a*-171*f*.

Therefore, the signal-processing unit 800 can carry out the most efficient near distance wireless communication processing using the asymmetrical flat antenna 100 or the like operating under other condition than the far field, the bandwidth in reflection characteristic of which is improved about five times as compared with the rectangular patch antenna 10. Further, because in the antennas 171*a*-171*f* each to which the asymmetrical flat antenna 100 or the like is applied, the conductive antenna-matching pattern 102 which serves as a matching circuit for wiring impedance is provided at a portion between the conductive power supply pattern 101 and the conductive antenna pattern 103, the antennas 171*a*-171*c* can be connected simply to the input side of the LSI device 172 through the transmission paths 175*a*-175*c*, the synthesizing circuit 178, and the wiring layer 175*d* and the antennas 171*d*-171*f* can be connected simply to the output side of the LSI device 172 through the wiring layer 175*e*, the branching circuit 177, and the transmission paths 175*f*-175*h*.

Consequently, not only the lengths of wires between the antennas 171*a*-171*c* and the LSI device 172 and between the LSI device 172 and the antennas 171*d*-171*f* can be reduced as much as possible but also the step of placing signal wire for the LSI device 172 can be omitted. This allows broadband information to be transmitted rapid between the signal-processing units 800 in an electronic device combining the plural signal-processing units 800.

A signal-processing unit which combines the seventh embodiment with the tenth embodiment can be constituted. For example, the antennas 171*a*-171*f* on both sides of the LSI device 172 shown in FIG. 21 are disposed on the rear face of the multilayered board 274 (or lamination structure device in which dielectric is sandwiched between metal layers) and the antennas 171*a*-171*f* disposed on the rear face are connected to the LSI device 172 through the contact holes (via holes), the transmission paths 175*a*-175*c* and the transmission paths 175*f*-175*h* and the transmission paths 175*d*, 175*e*. By constituting the unit by combining the embodiments of the signal-processing units appropriately, wireless signal processing can be performed using the plural antennas 171*a*-171*f* on both the front and rear faces of the unit.

Figure 22:
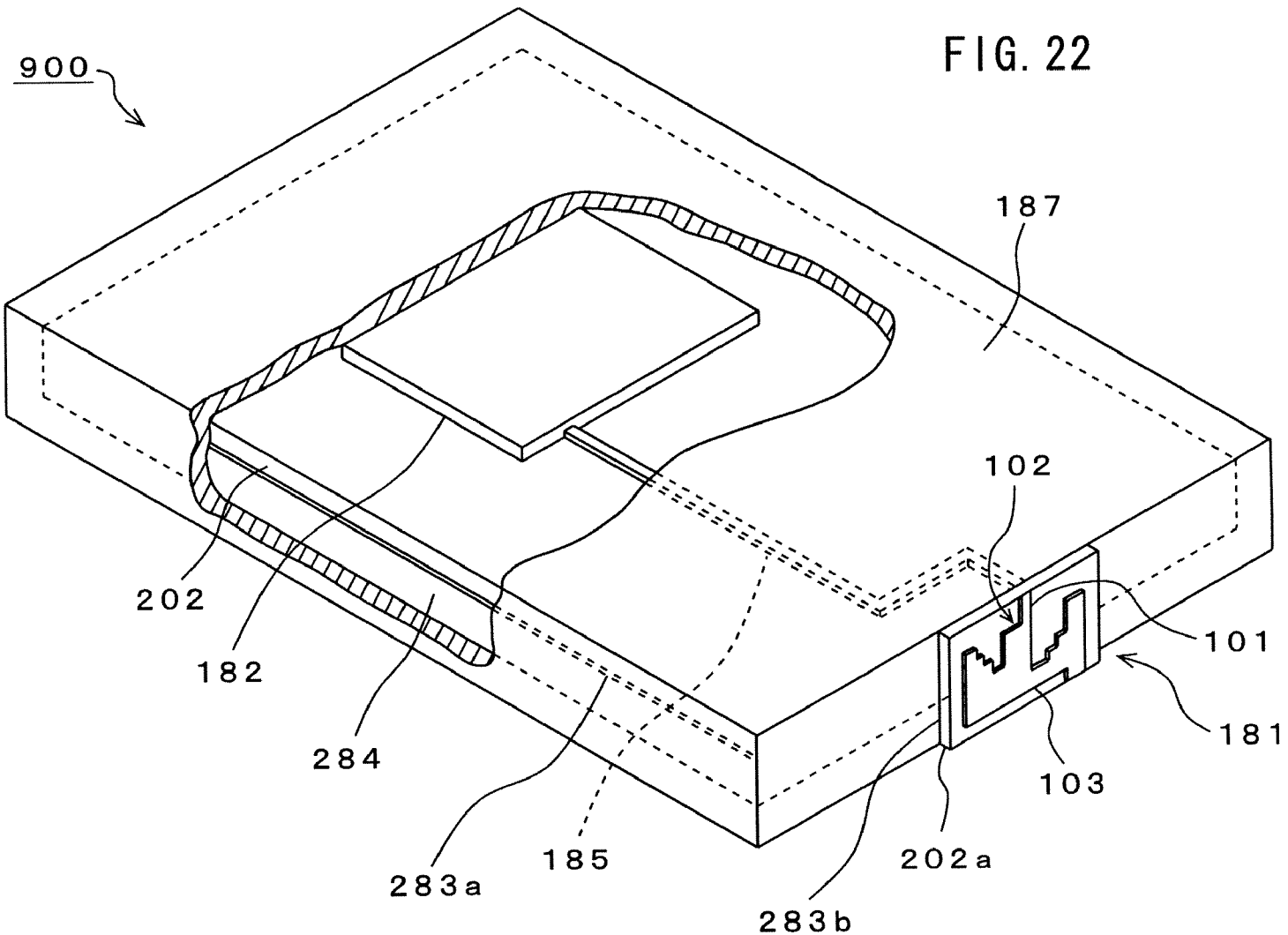
FIG. 22 is a perspective view of a signal-processing unit 900 as an eleventh embodiment of the invention to which the asymmetrical flat antennas 100 are applied, for showing a configuration thereof.

FIG. 22 shows a configuration of a signal-processing unit 900 as an eleventh embodiment of the invention to which the asymmetrical flat antenna 100 or the like is applied. In this embodiment, an LSI device 182 is disposed on a lamination structure device in which an ordinary multilayered board or dielectric is sandwiched between metal layers, a casing encloses the multilayered board or lamination structure on which this LSI device 182 is mounted, and an antenna 181 in which the conductive antenna pattern 103 is laid out (disposed) is provided on the side face of this casing.

In the signal-processing unit 900 shown in FIG. 22, a signal-processing board is constituted by providing the LSI device 182 on a multilayered board 284 and this signal-processing board is incorporated in a resin case as an example of the casing. The antenna 181 as the embodiments of the present invention is provided on the side face of this resin case and the antenna 181 and the LSI device 182 are connected to each other through a transmission path 185 to perform any signal processing. The resin case 187 is provided to prevent a user from touching directly any components such as an electronic component and mechanical component. However, if the signal-processing board is covered with a metal case as the casing, the top layer of the antenna pattern 103 is never covered with any metal layer. This is because if the top layer of the antenna pattern 103 is covered with the metal layer, electromagnetic shielding is performed to disable sending/receiving of radio wave. The LSI device 182 which possesses a wireless IC (semiconductor integrated circuit) internally is used.

As the antenna 81, the asymmetrical flat antenna 100 or the like as the embodiments of the present invention is used. The asymmetrical flat antenna 100 has the conductive power supply pattern 101 provided on the insulation layer 202*a*, the conductive antenna-matching pattern 102 extending from this power supply pattern 101, and the conductive antenna pattern 103 extending from the antenna-matching pattern 102. The conductive power supply pattern 101, the conductive antenna-matching pattern 102, and the conductive antenna pattern 103 are formed of copper foil. These patterns 101, 102, 103 are formed of metal foil or metal sheet of gold, silver, brass, bronze, white copper and the like or metal layers without being limited to copper foil.

The multilayered board 284 has the insulation layer 202 on its uppermost layer and a GND layer 283*a*, which has an area larger than a projection area of the conductive antenna pattern 103, under that layer 202. Further, it also has a GND layer 283*b* under the insulation layer 202*a*, The GND layers 283*a*, 283*b* are provided so that the antenna 181 can have unidirectionality. The GND layers 283*a*, 283*b* are connected electrically. The layers under the GND layer 283*a* is constituted of the insulation layer 204, the wiring layer 205, the insulation layer 206 and the like as shown in FIG. 4 as in the ordinary multilayered board.

The LSI device 182 provided on the insulation layer 202 and the conductive antenna pattern 103 of the antenna 181 are connected to each other through the transmission path 185, the conductive power supply pattern 101, and the conductive antenna-matching pattern 102. The conductive antenna pattern 103 has an asymmetrical configuration with respect to the conductive power supply pattern 101. By equipping with such an asymmetrical flat antenna, rapid information transmission processing can be achieved between the casings using the asymmetrical flat antenna having the antenna reflection characteristic whose frequency resonance point is adjusted.

The following will describe a method of manufacturing the signal-processing unit 900. First, the multilayered board 284 including the GND layer 283*a* is formed. In this embodiment, the multilayered board 284 is formed using the double-sided copper foil insulation board (prepreg insulation board) having the copper foil formed on its both faces or the single-sided copper foil insulation board having the copper foil formed on its one face. In the multilayered board 104*c* shown in FIG. 4, the insulation layer 202 and a wiring layer which serves as the transmission path 185 are formed using the insulation layer and the copper foil of the single-sided copper foil insulation board. For example, resist is patterned on the copper foil using a mask having a wiring pattern for the transmission path, exposed to light and developed and then, copper foil at an unnecessary portion is removed, so that a wiring layer for transmission path with a desired configuration (not shown) can be obtained on the insulation layer 202.

The insulation layer 204 and the GND layer 203 are formed using the insulation layer and the copper foil of the single-sided copper foil insulation board. For example, resist is patterned on the copper foil using a mask having a ground pattern and exposed to light and developed. Then, copper foil at an unnecessary portion is removed so as to obtain the GND layer 283*a* with a desired configuration. The multilayered board 284 can be formed by overlaying the aforementioned two single-sided copper foil insulation boards.

Next, the LSI device 182 to be provided on the multilayered board 284 and the antenna 181 to be provided on the side face of the casing are formed. For example, the antenna 181 and the LSI device 182 are formed separately and they are bonded to the multilayered board 284 and the side face of the casing, respectively. In the antenna 181, the GND layer 283*b*, the insulation layer 202*a*, the conductive power supply pattern 101, the conductive antenna-matching pattern 102, and the conductive antenna pattern 103 are formed using the double-sided copper foil insulation board. The conductive power supply pattern 101, the conductive antenna-matching pattern 102, and the conductive antenna pattern 103 are formed based on an asymmetrical configuration found out according to a pattern search method shown in FIGS. 8A to 10B. In the meantime, the conductive antenna-matching pattern 102 is formed at a portion between the conductive power supply pattern 101 and the conductive antenna pattern 103 at the same time and its configuration is searched and defined at the same time as the antenna pattern 3 is formed.

By using a mask having the conductive power supply pattern 101, the conductive antenna-matching pattern 102, and the conductive antenna pattern 103 under these conditions, resist is patterned on copper foil on a face of the double-sided copper foil insulation board and exposed to light and developed. Then, copper foil at an unnecessary portion is removed, so that the antenna 181 (the asymmetrical flat antenna 100) having the asymmetrical antenna pattern 103 as shown in FIG. 21 is obtained. In the copper foil portion on the other face of the double-sided copper foil insulation board, the GND layer 283*b* with a desired configuration is left. Consequently, the conductive antenna pattern 103 extending from the conductive power supply pattern 101 formed on the insulation layer 202*a*, which has an asymmetrical configuration with respect to the conductive power supply pattern 1, can be formed.

In this embodiment, the LSI device 182 is provided on the multilayered board 284. As the LSI device 182, a semiconductor chip type one or a package type one prepared for signal processing preliminarily is used. The LSI device 182 is physically adhered to the multilayered board 284 using adhesive agent. The LSI device 82 has a pad for antenna I/O. The pad and the transmission path 185 on the insulation layer 202 are connected (bonded) electrically to each other using a connection method with the contact hole, via hole, bump, wire or the like. The signal-processing board formed in this way is incorporated in the resin case 187 having a predetermined accommodation space. A terminal electrode portion of the transmission path 185 is formed at an antenna installation position on the side face of the resin case 187.

Next, the antenna 181 is adhered to a predetermined position of the resin case 187 using adhesive agent, for example. At this moment, the conductive antenna pattern 103 and the terminal electrode of the transmission path 185 are connected electrically to each other. For example, the conductive power supply pattern 101 of the antenna 181 and the terminal electrode portion are connected to each other through the contact hole or via hole. The interior of the contact hole, via hole or the like is filled with conductive material and treated with heating. Consequently, the signal-processing unit 900 that is provided with the LSI device 182 for signal processing on one face of the multilayered board 284 in the resin case 187 and the antenna 81 as the embodiments of the present invention on the side face of the resin case can be formed.

In the signal-processing unit 900 of this embodiment, when the antenna 181 and the LSI device 182 are connected to each other through the transmission path 185 to perform any signal processing, the asymmetrical flat antenna 100 or the like as the embodiments of the present invention is applied to the antenna 181.

Consequently, the signal-processing unit 900 can carry out the most efficient near distance wireless communication processing using the asymmetrical flat antenna 100 or the like operating under other condition than the far field, the bandwidth in reflection characteristic of which is improved about five times as compared with the rectangular patch antenna 10. Further, because in the antenna 181 to which the asymmetrical flat antenna 100 or the like is applied, the conductive antenna-matching pattern 102 which serves as a matching circuit for wiring impedance is provided at a portion between the conductive power supply pattern 101 and the conductive antenna pattern 103, the LSI device 182 and the antenna 181 can be connected directly to each other through the transmission path 185. As a result, a step of placing signal wire between the casings can be omitted and broadband information can be transmitted rapidly between the casings.

To the above signal-processing units 200-900 of the fourth-eleventh embodiments, the asymmetrical flat antenna 100 or the like as the embodiments of the present invention is applied. Thus, this can be used as a wireless interface when connecting the signal-processing board with a cable, connecting between the signal-processing boards or connecting the LSI device with a bus line.

When semiconductor integrated circuits are connected within the LSI device, the above-described wireless interface can be used. For example, by installing the first asymmetrical flat antenna 100 provided on one semiconductor integrated circuit and the second asymmetrical flat antenna 100 provided on the other semiconductor integrated circuit at a near distance within an identical semiconductor chip, wireless communication processing can be performed. As a consequence, deterioration of communication signal accompanying the multipath can be suppressed by directivity to some extent.

Further, when connecting the casings installed at a near distance, this signal-processing unit can be also used as wireless interface. For example, the signal-processing unit as the embodiments of the present invention having the first asymmetrical flat antenna 100 is installed on a first casing and the signal-processing unit as the embodiments of the present invention having the second asymmetrical flat antenna 100 is installed on a second casing, and then the asymmetrical flat antenna 100 of the first casing and the asymmetrical flat antenna 100 of the second casing are brought close to each other so as to establish a wireless communication path.

Therefore, broadband wireless communication processing can be executed between the first and second casings installed within a near distance. Further, if the first casing and the second casing are disposed at a near distance, broadband wireless communication processing between the first and second casings and connection with reduced quantity of cables between the casings can be performed and change-over of free signal-processing functions between the casings can be implemented.

Further, by installing the first asymmetrical flat antenna 100 provided on the signal-processing board and the second asymmetrical flat antenna 100 provided on the casing within a near distance, wireless communication path is established. Thus, broadband wireless communication processing can be executed between the signal-processing board and the casing provided within a near distance.

Consequently, by applying the signal-processing units as the embodiments of the present invention, not only wireless communication processing within the LSI device, wireless communication processing between the signal-processing boards or wireless communication processing between the casings can be selected appropriately, but also near distance wireless communication processing system which combines the selected wireless communication processing can be established.

Further, because the asymmetrical flat antenna 100 or the like as the embodiments of the present invention has broadband performance in other cases than the far field and is operated with a narrow band performance in the far field, influence of such an environment in which the antenna 100, the signal-processing board including the antenna 100 or the LSI device is substantially surrounded by metals and difficulty of installing the signal-processing board having the antenna 100 into the casing can be solved.

By using the asymmetrical flat antenna 100 or the like as the embodiments of the present invention with the signal-processing board, wireless signal-processing system can be implemented while maintaining freedom of exchange of the signal-processing board. Further, by using the asymmetrical flat antenna 100 or the like as the embodiments of the present invention with the LSI device, the arrangement of the LSI device and the exchange of the signal-processing board can be achieved in the electronic device so as to implement the wireless signal-processing system.

When the signal-processing units as the embodiments of the present invention are applied by connecting a communication cable between the antennas of the signal-processing boards if the connectors on both side of the communication cable being served as the antennas, wireless communication-processing system using the antennas of the signal-processing board and antenna connectors of the communication cable can be implemented while freedom of arrangement and change-over of the signal-processing board can be realized.

[Electronic Device]

The following will describe an electronic device using the signal-processing unit 200-900 having the asymmetrical flat antenna 100 or the like as the embodiments of the present invention.

Figure 23:
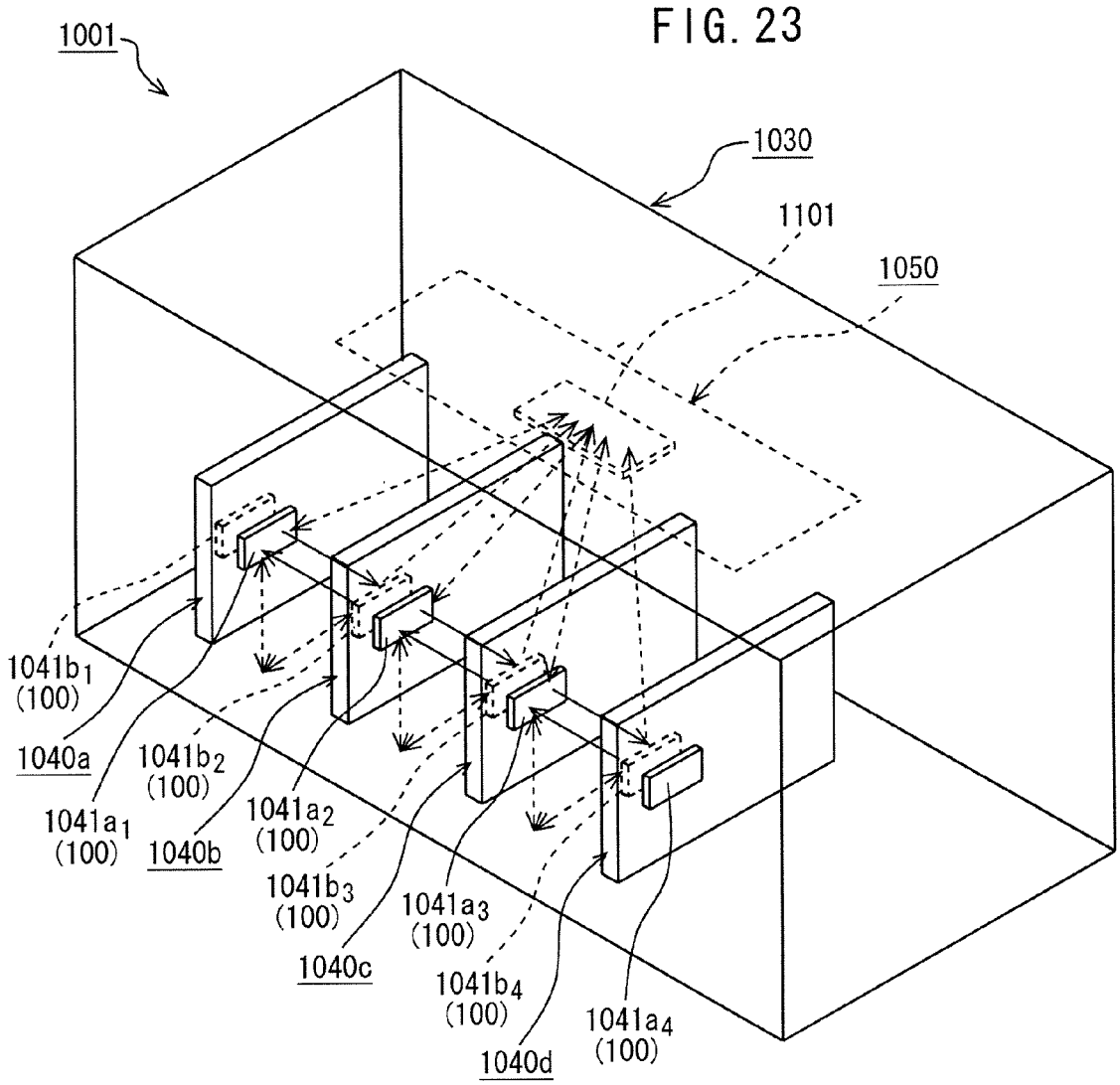
FIG. 23 is a perspective view of an electronic device 1001 as a twelfth embodiment of the invention to which the asymmetrical flat antennas 100 are applied, for showing a configuration thereof.

FIG. 23 shows a configuration of an electronic device 1001 as a twelfth embodiment of the invention to which the asymmetrical flat antennas 100 or the like are applied. In the electronic device 1001 of this embodiment, one or more signal-processing boards are disposed within the casing 1030 and each of the signal-processing boards is provided with an antenna having a predetermined ratio of bandwidth and broadband performance to execute any wireless communication processing between the respective signal-processing boards.

The electronic device 1001 shown in FIG. 23 constitutes an example of the near distance wireless-communication-processing system and is applicable to a personal computer, an image-processing device, a portable terminal device and the like. The near distance wireless-communication-processing system is operable under other condition than the far field when it is used with the two antennas, for example, antennas 1041*a*1, 1041*b*1 installed within a near distance. For example, as for the electronic device 1001, the four signal-processing boards 1040*a*-1040*d* are provided within the casing 1030.

The signal-processing unit 500 described in the seventh embodiment is used for the signal-processing boards 1040*a*-1040*d*. Of course, not only the signal-processing unit 500 but also any signal-processing units described in the fourth-sixth and eighth-eleventh embodiments may be used by combination thereof. The signal-processing boards 1040*a*-1040*d* are supported by the structure of the casing 1030. The signal-processing board refers to as a board having an antenna with broadband performance for signal processing or an electronic component mounting board which is constituted of any of the signal-processing units 200-900 equipped with the asymmetrical flat antenna 100 or the like as the embodiments of the present invention.

Electronic components such as an LSI device for signal processing of broadband information or narrow band information, resistor, capacitor, memory are installed on each of the signal-processing boards 1040*a*-1040*d*. The broadband information refers to as the signal whose information quantity is large so that it is difficult to transmit the signal as a small quantity and its real-time characteristic is demanded. For example, the broadband information includes data such as multi-media information containing data on video information and audio information, and computer image information. Further, the narrow band information refers to as information that may be necessary for synchronous processing of control signal and RF signal or meaningful information for signal processing despite its narrow transmission band, that is, information which has advantage in being transmitted (distributed) by wireless broadcasting method.

According to this embodiment, in the identical casing 1030, the first signal-processing board 1040*a* is provided with a first antenna 1041*a*1 having a ratio of bandwidth of at least 11% and broadband performance. The second first signal-processing board 1040*b* is also provided with a second antenna 1041*b*2 having a ratio of bandwidth of at least 11% and broadband performance. The asymmetrical flat antenna 100 or the like as the embodiments of the present invention is applied to each of the antennas 1041*a*1 and 1041*b*2.

The asymmetrical flat antenna 100 has the conductive power supply pattern 101 provided on the insulation layer 202*a*, the conductive antenna-matching pattern 102 extending from this power supply pattern 101, and the conductive antenna pattern 103 extending from the antenna-matching pattern 102 as shown in FIG. 18. The conductive antenna pattern 103 has an asymmetrical configuration with respect to the conductive power supply pattern 101. The conductive power supply pattern 101, the conductive antenna-matching pattern 102, and the conductive antenna pattern 103 are formed of copper foil or the like.

In the electronic device 1001, the antennas 1041*a*1, 1041*b*2 are disposed on the signal-processing boards 1040*a*, 1040*b* that are adjacent to each other at a short distance therebetween with the antennas 1041*a*1, 1041*b*2 being opposed to each other so that any wireless communication processing of broadband information is executed between the signal-processing boards 1040*a*, 1040*b*. The antennas 1041*a*1, 1041*b*2 are disposed symmetrically at places electromagnetically transparent from the signal-processing boards 1040*a*, 1040*b*. Such the antenna arrangement enables broadband wireless communication processing to be achieved. The antennas 1041*a*1, 1041*b*2 may be covered with material transparent electromagnetically. As a consequence, a large amount of broadband information can be transmitted at real time among the plurality of signal-processing boards 1040*a*-1040*d*, the LSI device and the signal-processing modules installed within a near distance in the casing 1030.

In this embodiment, antennas 1041*b*1, 1041*a*2 respectively corresponding to the first and second antennas 1041*a*1, 1041*b*2 are provided on the other opposing face of each of the signal-processing boards 1040*a*, 1040*b*.

Thus, if the right side of the casing 1030 is regarded as the front face of each of the signal-processing boards 1040*a*-1040*d*, the antenna 1041*a*1 is provided on the front face of the signal-processing board 1040*a* and the antenna 1041*b*1 is provided on the rear (other opposing) side of the signal-processing board 1040*a*. Likewise, the antenna 1041*a*2 is provided on the front face of the signal-processing board 1040*b* and the antenna 1041*b*2 is provided on the rear face thereof. The antenna 1041*a*3 is provided on the front face of the signal-processing board 1040*c* and the antenna 1041*b*3 is provided on the rear face thereof. The antenna 1041*a*4 is provided on the front face of the signal-processing board 1040*d* and the antenna 1041*b*4 is provided on the rear face thereof. In the meantime, the antenna 1041*b*1 on the rear face of the signal-processing board 1040*a* and the antenna 1041*a*4 on the front face of the signal-processing board 1040*d* may be omitted.

In the electronic device 1001, a control unit 1050 is disposed within the casing 1030, for example, on its top plate. The control unit 1050 is provided with a narrow band antenna 1110 capable of receiving and/or transmitting narrow band information. As well as the asymmetrical flat antenna 100 or the like as the embodiments of the present invention, a rectangular patch antenna, a mono-pole antenna and the like may be used for the narrow band antenna 1101. The control unit 1050 distributes control information which selects a wireless transmission system from that of the broadband information or that of narrow band information to each of the signal-processing boards 1040*a*-1040*d*. The respective signal-processing boards 1040*a*-1040*d* can select the wireless transmission system based on the control information distributed from the control unit 1050.

The following will describe operations of the electronic device 1001 with reference to FIG. 23. Arrows indicated with the solid line in FIG. 23 indicate the directions of flow of broadband information between the signal-processing boards 1040*a* and 1040*b*, between the signal-processing boards 1040*b* and 1040*c*, and between the signal-processing boards 1040*c* and 1040*d*, showing wireless communication method of the broadband information between the most adjacent signal-processing boards. According to this wireless communication method, if broadband information is transmitted/received beyond plural signal-processing boards, the signal-processing boards successively establish wireless communication by transmitting the broadband information to the signal-processing board most adjacent to them so that the broadband information can be transmitted to the signal-processing board to be received (broadband wireless communication).

For example, wireless communication processing of the broadband information is established between the signal-processing boards 1040*a* and 1040*b* with the antenna 1041*a*1 of the signal-processing board 1040*a* and the antenna 1041*b*2 of the signal-processing board 1040*b* being placed to oppose each other. Wireless communication processing of the broadband information is then established between the signal-processing boards 1040*b* and 1040*c* with the antenna 1041*a*2 of the signal-processing board 1040*b* and the antenna 1041*b*3 of the signal-processing board 1040*c* being placed to oppose each other. Further, wireless communication processing of broadband information is established between the signal-processing boards 1040*c* and 1040*d* with the antenna 1041*a*3 of the signal-processing board 1040*c* and the antenna 1041*b*4 of the signal-processing board 1040*d* placed to oppose each other.

Arrows indicated with the dotted line in FIG. 23 indicate the direction of flow of narrow band information between each of the signal-processing boards 1040*a*-1040*d* and the control unit 1050, showing wireless communication method of narrow band information. According to this wireless communication method, narrow band information is transmitted wirelessly to an antenna (not shown) installed at any place of each of the signal-processing boards 1040*a*-1040*d* or the antennas 1041*a*1-1041*a*4, 1041*b*1-1041*b*4 as the embodiments of the present invention by utilizing the narrow band performance in the far field of each of the antennas 1041*a*1-1041*a*4, 1041*b*1-1041*b*4 as the embodiments of the present invention and the narrow band antenna 1101 of the control unit 1050. Alternatively, the narrow band information is received wirelessly from the signal-processing boards 1040*a*-1040*d*. The narrow band information is distributed (transmitted) all at once from the narrow band antenna 1101 of the control unit 1050 toward the far field to the plurality of signal-processing boards 1040*a*-1040*d* (narrow band wireless communication).

In the electronic device 1001 of this embodiment, broadband information is transmitted only between the signal-processing boards positioned within a near distance using the broadband performance of the antennas 1041*a*1-1041*a*4, 1041*b*1-1041*d*4 (the asymmetrical flat antenna 100 or the like) as the embodiments of the present invention. The narrow band information transmitted from the narrow band antenna 1101 of the control unit 1050 provided at any place within the casing 1030 is received by the antennas 1041*a*1-1041*a*4, 1041*b*1-1041*b*4 (the asymmetrical flat antenna 100) of the signal-processing boards 1040*a*-1040*d*.

In the above-described operation, broadband information subjected to wireless communication processing is transferred from the signal-processing board 1040*a*-1040*b*-1040*c*-1040*d*, successively. This enables the wireless communication processing to be performed using the antennas 1041*a*1-1041*a*4, 1041*b*1-1041*b*4 of the signal-processing boards 40*a*-40*d* and by executing wireless communication at several times, the broadband information can be transmitted from an input end of the signal-processing board 1040*a* to an output end of the signal-processing board 1040*d* located at a far position.

The antennas 1041*a*1-1041*a*4, 1041*b*1-1041*b*4 operate as a broadband antenna in other than the far field and as a narrow band antenna in the far field. In such the configuration, because the conductive antenna pattern 103 having an asymmetrical configuration on the right and left sides is disposed on the signal-processing boards 1040*a*-1040*d*, deterioration of the reflection characteristic of the antennas 1041*a*1-1041*a*4, 1041*b*1-1041*b*4 can be suppressed by directivity to some extent.

Figure 24:
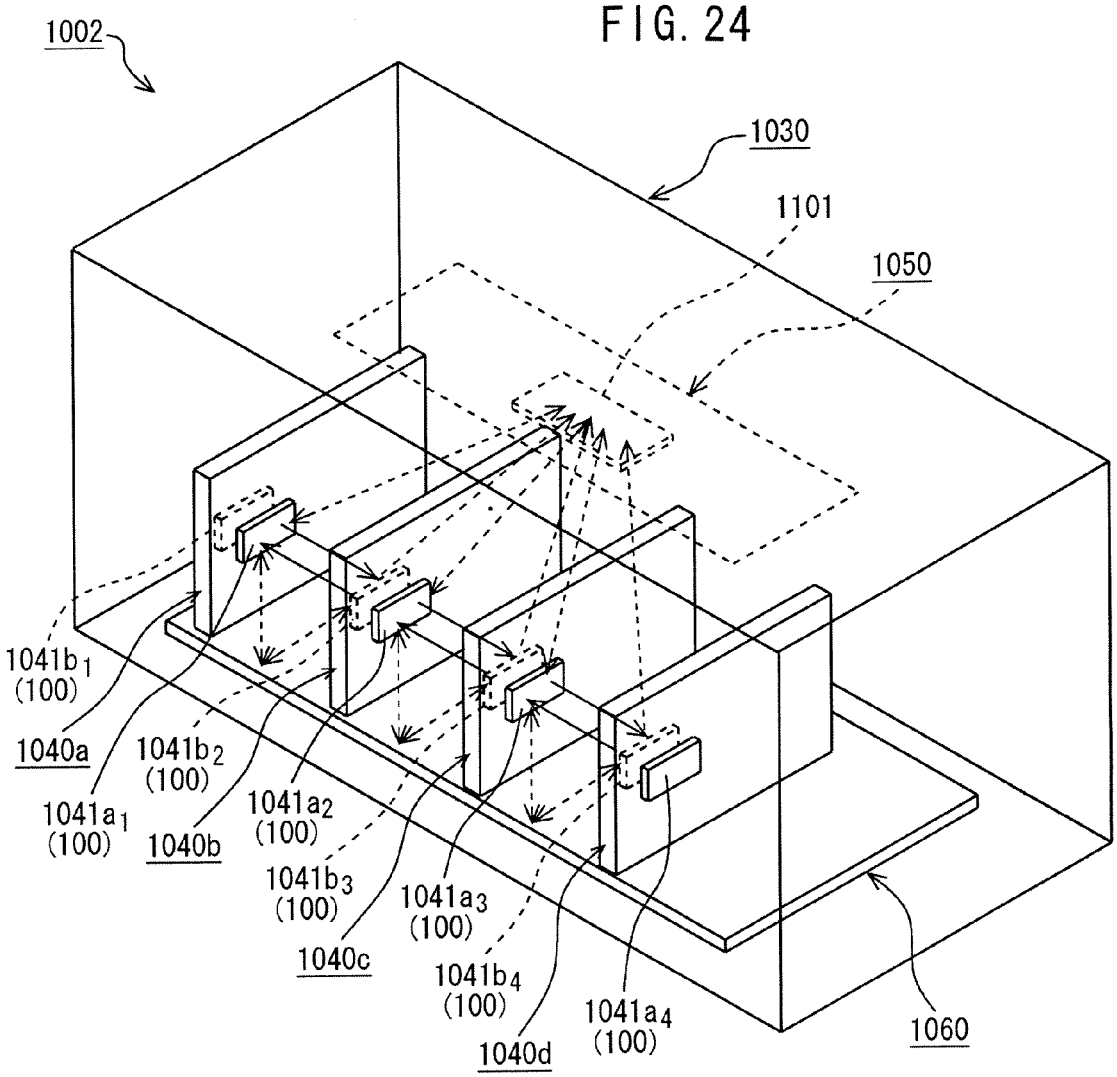
FIG. 24 is a perspective view of an electronic device 1002 as a thirteenth embodiment of the invention to which the asymmetrical flat antennas 100 are applied, for showing a configuration thereof.

FIG. 24 shows a configuration of an electronic device 1002 as a thirteenth embodiment of the invention to which the asymmetrical flat antennas 100 or the like are applied. In this embodiment, a mother board 1060 is built into an interior of the casing 1030 shown in FIG. 23 and the signal-processing boards 1040*a*-1040*d* are installed thereon. Because components having the same designation and reference numerals as the above twelfth embodiment have the same functions as these of them, description of which will be omitted.

The electronic device 1002 shown in FIG. 24 is provided with the mother board 1060, which constitutes an example of the control board, on the bottom portion of the casing 1030. The four signal-processing boards 1040*a*-1040*d* having the antennas 1041*a*1-1041*a*4, 1041*b*1-1041*b*4 can be loaded/unloaded. The signal-processing unit 500 described in the seventh embodiment of the invention is used for each of the signal-processing boards 1040*a*-1040*d*. Of course, not only the signal-processing unit 500 but also any signal-processing board described in the fourth-sixth embodiments and the eighth-eleventh embodiments may be used by combination. The mother board 60 is provided with slots (not shown) at a predetermined interval and the signal-processing boards 1040*a*-1040*d* are supported and fixed by these slots.

For example, the signal-processing boards 1040*a*-1040*d* are supported in a vertical condition with respect to the surface of the mother board 1060. This supporting method has an advantage in that the signal-processing boards 1040*a*-1040*d* can be exchanged more easily than a case in which they are supported and fixed by the structure of the casing 1030. Of course, this is not restricted to this example, but it may be so constructed that the LSI device provided with the antennas 1041*a*1-1041*a*4, 1041*b*1-1041*b*4 or the like can be loaded to/unloaded from the mother board 1060. The control unit described in the twelfth embodiment may be disposed on the mother board 1060.

In the electronic device 1002 of this thirteenth embodiment, the mother board 1060 is provided on the bottom portion of the casing 1030 and the mother board 1060 allows the signal-processing boards 1040*a*-1040*d*, the LSI device and the like to be exchanged freely. The signal-processing route can be changed easily and any signal-processing function in the signal-processing boards 1040*a*-1040*d*, the LSI device and the like can be selected freely. Consequently, the antenna provided signal-processing boards 1040*a*-1040*d*, the LSI device and the like can be used like a wireless connection plug for connecting the control unit 1050, the signal-processing boards 1040*a*-1040*d*, the LSI device and the like to one another.

Figure 25:
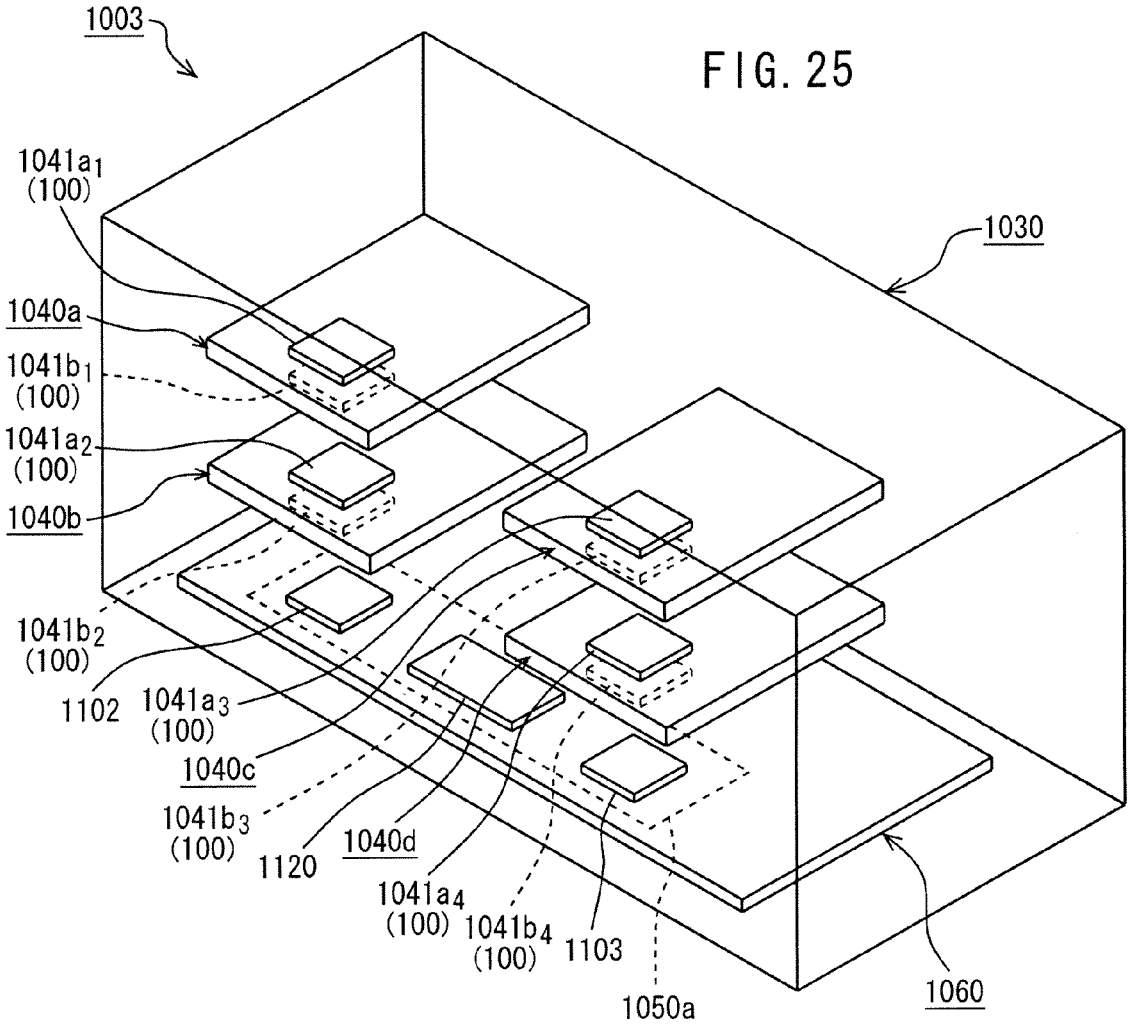
FIG. 25 is a perspective view of an electronic device 1003 as a fourteenth embodiment of the invention to which the asymmetrical flat antennas 100 are applied, for showing a configuration thereof.

FIG. 25 shows a configuration of an electronic device 1003 to which the fourteenth embodiment of the invention to which the asymmetrical flat antennas 100 or the like are applied. In this embodiment, instead of disposing the signal-processing boards 1040*a*-1040*d* in the right and left directions within the casing like the thirteenth embodiment, the signal-processing boards 1040*a*-1040*d* are divided into two groups and each group is disposed in a vertical direction thereof. In this embodiment, with respect to the mother board 1060 within the casing shown in FIG. 24, the signal-processing boards 1040*a*-1040*d* are installed with their parallel condition being maintained.

The four signal-processing boards 1040*a*-1040*d* having the antennas 1041*a*1-1041*a*4, 1041*b*1-1041*b*4 are installed detachably parallel to the mother board 1060 provided on the bottom portion of the casing 1030 in the electronic device 1003 shown in FIG. 25. The signal-processing unit 500 described in the seventh embodiment is used for each of the signal-processing boards 1040*a*-1040*d*. Of course, not only the signal-processing unit 500 but also any of the signal-processing units described in the fourth-sixth, eighth-eleventh embodiments may be used by combination. A board attachment mechanism (not shown) is provided on the mother board 1060. The board attachment mechanism is fixed to the structure thereof. Slots are provided at a predetermined interval in the board mounting mechanism and the signal-processing boards 1040*a*-1040*d* are supported and fixed by these slots. According to this fixing method, the two signal-processing boards 1040*a*, 1040*b* are supported by the board attachment mechanism to maintain their postures parallel to a surface of the mother board 1060.

The other two signal-processing boards 1040*c*, 1040*d* are supported by the board attachment mechanism to maintain their postures parallel to the surface of the mother board 1060. In the FIG. 25, interference between the signal-processing board 1040*a* and the signal-processing board 1040*c* or between the signal-processing board 1040*b* and the signal-processing board 1040*d* during broadband wireless communication is suppressed by the characteristic of the antenna as the embodiments of the present invention, so that broadband wireless communication between the signal-processing board 1040*a* and the signal processing board 1040*b* and between the signal-processing board 1040*c* and the signal-processing board 1040*d* is facilitated.

In this embodiment, the signal-processing units 200-700 described in the fourth-ninth embodiments can be applied to a control board 1050*a*. The mother board 1060 is provided with the control unit 1050 described in the twelfth embodiment as the control unit 1050*a*. The control unit 1050*a* is provided with two narrow band antennas 1102, 1103. The asymmetrical flat antenna 100 or the like as the embodiments of the present invention having narrow band performance in the far field is applied to each of the narrow band antennas 1102, 1103. By the control unit 1050*a*, narrow band information is transmitted wirelessly to the signal-processing boards 1040*a*-1040*d* or the narrow band information is received wirelessly from the signal-processing boards 1040*a*-1040*d*, by utilizing the narrow band performance in the far field of the asymmetrical flat antenna 100 or the like as the embodiments of the present invention and the narrow band performance in the far field of the antennas 1041*a*1-1041*a*4, 1041*b*1-1041*b*4 of the signal-processing boards 1040*a*-1040*d*.

For example, by the control unit 1050*a*, narrow band wireless communication processing is executed between the narrow band antenna 1102 connected to the LSI device 1120 and the antenna 1041*b*2 on the rear side of the signal-processing board 1040*b*. Further, the narrow band wireless communication processing is executed between the narrow band antenna 1103 connected to the LSI device 1120 and the antenna 1041*b*4 on the rear side of the signal-processing board 1040*d*.

In the electronic device 1003 of the fourteenth embodiment, the two pairs of the signal-processing boards 1040*a* and 1040*b*, 1040*c* and 1040*d* are provided parallel to the mother board 1060 on the bottom portion of the casing 1030 so that they can be loaded/unloaded freely to/from the board attachment mechanism.

Thus, because the signal-processing boards 1040*a*-1040*d* can be exchanged freely, the signal-processing route can be changed easily, so that the signal-processing functions of the signal-processing boards 1040*a*-1040*d* can be selected freely. As a consequence, the antenna provided signal-processing boards 1040*a*-1040*d* can be used like a wireless connecting plug for connecting between the control unit 1050*a* and each of the signal-processing boards 1040*a*-1040*d*.

Figure 26:
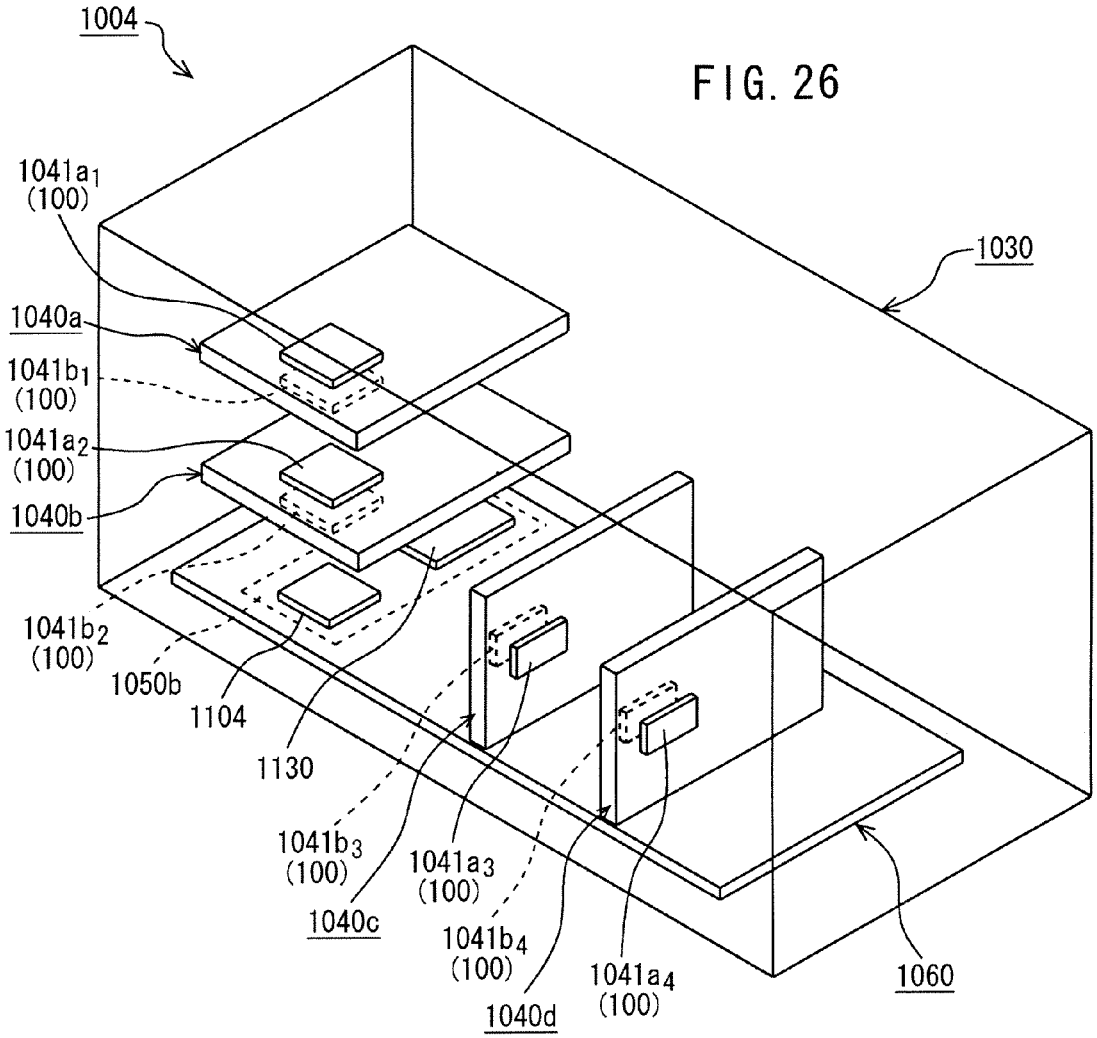
FIG. 26 is a perspective view of an electronic device 1004 as a fifteenth embodiment of the invention to which the asymmetrical flat antennas 100 are applied, for showing a configuration thereof.

FIG. 26 shows a configuration of an electronic device 1004 as a fifteenth embodiment of the invention to which the asymmetrical flat antennas 100 or the like are applied. In this embodiment, arrangement of the signal-processing boards 1040*c*, 1040*d* of the thirteenth embodiment in the right and left directions and arrangement of the signal-processing boards 1040*a*, 1040*b* of the fourteenth embodiment in a vertical direction are combined.

In the electronic device 1004 shown in FIG. 26, the four signal-processing boards 1040*a*-1040*d* having the antennas 1041*a*1-1041*a*4, 1041*b*1-1041*b*4 are provided detachably on the mother board 1060 provided on the bottom portion of the casing 1030. The signal-processing unit 500 described in the seventh embodiment is applied to each of the signal-processing boards 1040*a*-1040*d*. Of course, not only the signal-processing unit 500 but also any of the signal-processing units described in the fourth-sixth, eighth-eleventh embodiments may be used by combination. A board attachment mechanism (not shown) is provided on the left half of the mother board 1060. The board attachment mechanism is fixed to the structure thereof. By the board attachment mechanism, the signal-processing boards 1040*a*, 1040*b* are supported and fixed at a predetermined interval to maintain their posture parallel to the surface of the mother board 1060.

The other two signal-processing boards 1040*c*, 1040*d* are supported and fixed to slots provided at a predetermined interval on the right half of the mother board 1060. The signal-processing boards 1040*c*, 1040*d* are supported by the slots to maintain their posture perpendicular to the surface of the mother board 1060. That is, the signal-processing boards 1040*c*, 1040*d* are disposed at positions in which the unidirectionality of each of the antennas 1041*a*1, 1041*a*2, 1041*b*1, 1041*b*2 of the signal-processing boards 1040*a*, 1040*b* is perpendicular to the unidirectionality of each of the antennas 1041*a*3, 1041*a*4, 1041*b*3, 1041*b*4 of the signal-processing boards 1040*c*, 1040*d*.

Due to this arrangement, as in the fourteenth embodiment, interference between the signal-processing board 1040*a* and the signal-processing board 1040*c* and between the signal-processing board 1040*b* and the signal-processing board 1040*d* during broadband wireless communication is suppressed by the characteristic of the antennas as the embodiments of the present invention. This allows broadband wireless communication processing to be facilitated between the signal-processing board 1040*a* and the signal-processing board 1040*b* and between the signal-processing board 1040*c* and the signal-processing board 1040*d*.

The mother board 60 is provided with a control unit 1050*b* and the control unit 1050*b* is provided with a narrow band antenna 1104 and a LSI device 1130. The asymmetrical flat antenna 100 or the like as the embodiments of the present invention is applied to the narrow band antenna 1104. In this embodiment, by the control unit 1050*b*, narrow band wireless communication processing is executed between the narrow band antenna 1104 connected to the LSI device 1130 and the antenna 1041*b*2 on the rear side of the signal-processing board 1040*b*.

In the electronic device 1004 of the fifteenth embodiment, a pair of the signal-processing boards 1040*a* and 1040*b* are provided parallel to the mother board 1060 provided on the bottom portion of the casing 1030 and the signal-processing boards 1040*c*, 1040*d* are provided so that the directivity of each of the antennas 1041*a*3, 1041*a*4, 1041*b*3, 1041*b*4 thereof can be made perpendicular to the directivity of each of the antennas 1041*a*1, 1041*a*2, 1041*b*1, 1041*b*2 of the signal-processing boards 1040*a* and 1040*b*. The signal-processing boards 1040*a*-1040*d* can be loaded to/unloaded from the board attachment mechanism or the slots of the mother board freely.

Because the signal-processing boards 1040*a*-1040*d* can be exchanged freely, the signal-processing route can be changed easily and the signal-processing functions of the signal-processing boards 1040*a*-1040*d* can be selected freely. Consequently, the antenna provided signal-processing boards 1040*a*-1040*d* can be used like a wireless connecting plug for connecting between the control unit 1050*b* and the signal-processing boards 1040*a*-1040*d*. In the meantime, in this fifteenth embodiment, it is permissible to adopt a structure which omits the mother board 1060 described in the thirteenth and fourteenth embodiments.

Figure 27:
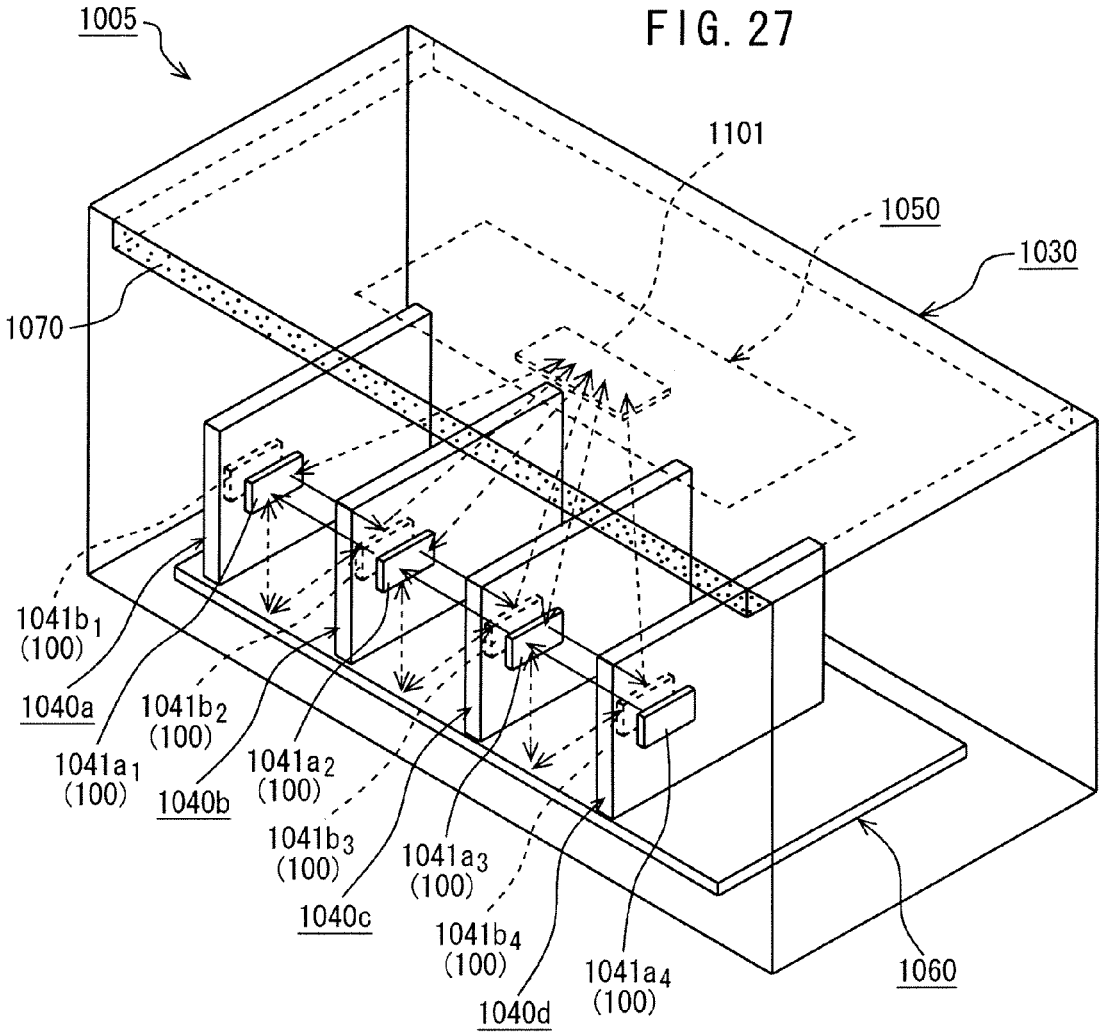
FIG. 27 is a perspective view of an electronic device 1005 as a sixteenth embodiment of the invention to which the asymmetrical flat antennas 100 are applied, for showing a configuration thereof.

FIG. 27 shows a configuration of an electronic device 1005 as a sixteenth embodiment to which the asymmetrical flat antennas 100 or the like are applied. In this embodiment, a radio wave absorption body 1070 is attached to the electronic device of the thirteenth embodiment in order to improve a quality of the wireless communication.

In the electronic device 1005 shown in FIG. 27, an radio wave absorption body 1070 is installed within the casing 1030 in which a plurality of the signal-processing boards 1040*a*-1040*d* having the antennas 1041*a*1-1041*a*4, 1041*b*1-1041*b*4 and/or the LSI device are provided. To each of the signal-processing boards 1040*a*-1040*d*, any of the signal-processing units described in the fourth-eleventh embodiments are used by combination. The radio wave absorption body 1070 is provided at a selected face in which radio wave absorption effect becomes maximum of the internal faces of the casing 1030. For example, the radio wave absorption body 1070 is installed to the top plate of the casing 1030. When the radio wave absorption body 1070 is installed to the top plate thereof, the maximum effect of absorbing radio wave can be obtained and because the top plate is a place which allows a maximum area to be secured in the inner faces of the casing 1030, the radio wave absorption effect can be exerted by installing the radio wave absorption body 1070 into a face of such the place.

In the meantime, a matching circuit device may be installed on a part of the inner face of the casing in which the radio wave absorption body 1070 is installed. As a consequence, broadband wireless communication and narrow band wireless communication can be achieved easily. This radio wave absorption body 1070 may be installed to the electronic device of the fourteenth embodiment or the fifteenth embodiment.

In this embodiment, the radio wave absorption body 1070 is installed to a portion (surrounding the periphery of the antenna) excluding an installation position of the narrow band antenna 1101 of the control unit 1050 in the casing 1030 shown in FIG. 27. To facilitate the wireless communication processing in the casing 1030, the radio wave absorption body 1070 may be substituted by a structure which satisfies the best matching condition in radio frequency band to be transmitted.

Thus, in the electronic device 1005 of the sixteenth embodiment, the radio wave absorption body 1070 is provided at the large area portion of the top plate of the casing 1030 in order to execute wireless communication within the casing so that this radio wave absorption body 1070 can achieve the broadband wireless communication and narrow band wireless communication easily and accurately.

Therefore, when broadband wireless communication is performed in the casing 1030, deterioration of the quality of transmission/reception of signal due to reflection, refraction, diffraction or the like by electromagnetic wave from electronic, electric, mechanical components can be suppressed. When the antennas as the embodiments of the present invention is disposed in an environment surrounded by metals, deterioration of the antenna characteristic is suppressed extremely so as to enable rapid information transmission processing.

To the electronic devices 1001-1005 of the twelfth-sixteenth embodiments, the signal processing units 200-900 as the embodiments of the present invention are respectively applied. The two antennas for example, the antennas 1041*a*1, 1041*b*2 are disposed with them being opposed to each other within a near distance. The asymmetrical flat antenna 100 or the like as the embodiments of the present invention is applied to each of the antennas.

Thus, the most efficient near distance wireless communication processing using the asymmetrical flat antenna 100 or the like operating under other condition than the far field can be achieved, and its reflection characteristic can be improved as compared with the rectangular patch antenna. Additionally, the step of placing signal wire between the signal-processing boards 1040*a* and 1040*b*, between the signal-processing boards 1040*b* and 1040*c*, and between the signal-processing boards 1040*c* and 1040*d* can be omitted and further, broadband information can be transmitted rapidly between the signal-processing boards 1040*a* and 1040*b*, between the signal-processing boards 1040*b* and 1040*c* or between the signal-processing boards 1040*c* and 1040*d*. Further, drop in communication quality due to the multipath of the antenna is improved. Influences on the antenna due to existence of components such as the electronic component and mechanical component at a near distance can be suppressed.

A user can use the casing 1030 repeatedly, thereby preventing him or her from possessing a plurality of the casings 1030 each of which constitute any of the electronic devices 1001-1005, and contributing to the environmental conservation. Upon design of the electronic device, wire layout step for the signal-processing boards 1040*a*-1040*d* can be reduced. Further, steps accompanying change of the wire layout after design can be reduced. Consequently, a user can meet a change in the signal-processing board after design smoothly.

A designer can develop a new signal-processing board using the signal-processing boards 1040*a*-1040*d* designed previously. For example, a new signal-processing board can be developed by combining the signal-processing boards 1040*a*-1040*d* designed previously with the new signal-processing boards 1040*a*-1040*d*.

Figure 28A:
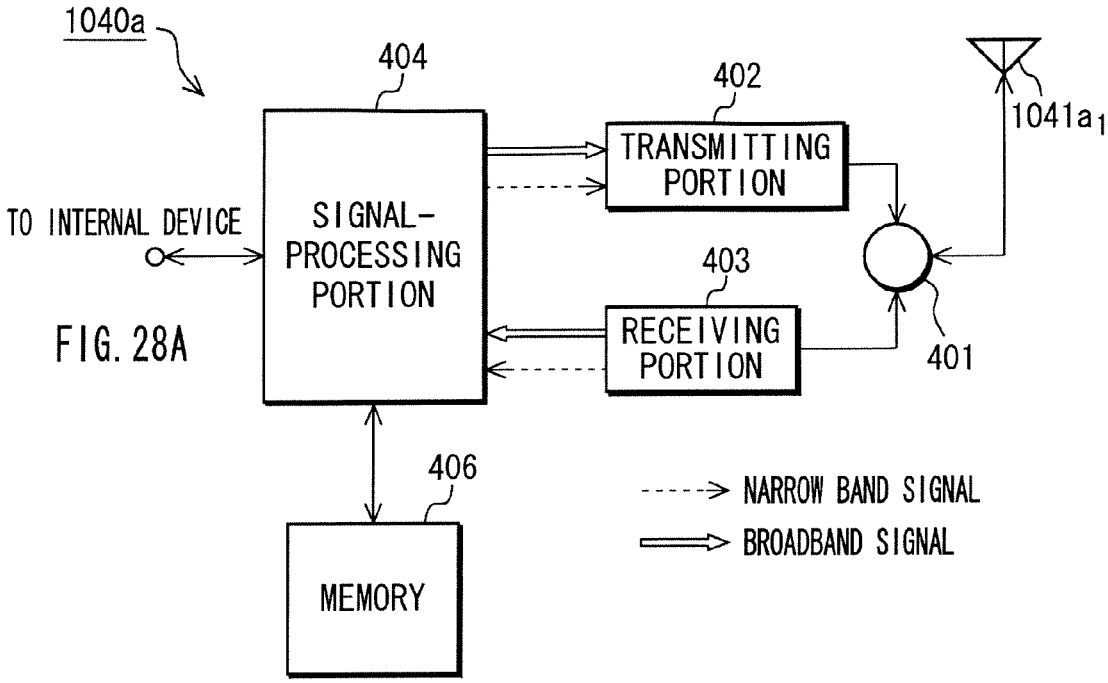
Figure 28B:
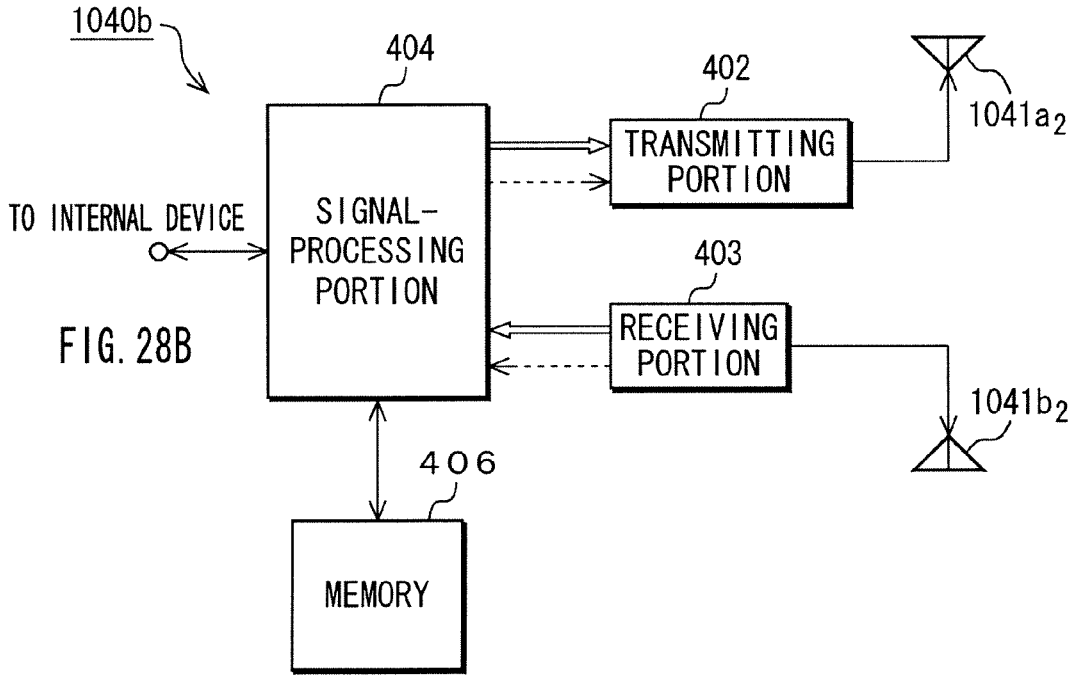

FIGS. 28A, 28B respectively show internal configurations of the signal-processing boards 1040*a*, 1040*b*. The signal-processing board 1040*a* shown in FIG. 28A constitutes the signal-processing unit and contains, for example, a shared device (antenna switch or the like) 401, a transmitting portion 402, a receiving portion 403, a signal-processing portion 404, and a memory 406 (memory unit).

The shared device 401 has three terminals and the antenna 41*a* is connected to a first terminal (not shown). The asymmetrical flat antenna 100 or the like as the embodiments of the present invention is applied to the antenna 1041*a*1. The antenna 1041*a*1 executes wireless communication processing of broadband information with the antenna 1041*b*2 of the signal-processing board 1040*b* located adjacent thereto using the broadband performance thereof. The broadband information includes signals whose information amount is large and which is difficult to transmit as a small amount and may be required to have real-time characteristic. For example, the broadband information includes multi-media information and the like containing data such as video information and audio information and computer image information.

Further, wireless communication processing of narrow band information is executed between the narrow band antenna 1101 of the control unit 1050 or the like and the antenna 1041*a*1 of the signal-processing board 1040*a*. The narrow band information includes information used in synchronous processing of the control signal and the RF signal and information meaningful for signal processing despite a narrow transmission band, that is, information which has advantage in being transmitted (distributed) by wireless broadcasting method.

In this embodiment, the transmitting portion 402 is connected to a second terminal of the shared device 401 and the receiving portion 403 is connected to a third terminal thereof. The signal-processing portion 404 is connected to the transmitting portion 402 and the receiving portion 403. The signal-processing portion 404 is connected to an internal device (not shown) through a signal transmission line. The signal-processing portion 404 processes, for example, video signal, audio signal and the like inputted from the internal device at the time of transmission of information and outputs broadband signal and narrow band signal to the transmitting portion 402. In FIG. 28A, an arrow of bold line indicates the broadband signal and an arrow of dotted line indicates the narrow band signal. Hereinafter, the broadband signal or broadband information is indicated with the arrow of bold line and the narrow band signal or narrow band information is indicated with the arrow of the dotted line. The transmitting portion 402 has a signal-multiplexing portion (not shown) and outputs a transmitting signal by superimposing (multiplexing) the broadband signal and the narrow band signal. Further, the transmitting portion 402 has a modulation portion which modulates the transmitting signal in a predetermined modulation form so as to transmit a modulation signal based on carrier of a predetermined frequency.

The receiving portion 403 connected to the aforementioned shared device 401 is provided with a demodulation portion (not shown) which receives a modulation signal carried based on carrier of the predetermined frequency and demodulates the received modulation signal according to a predetermined demodulation form when the information is received. The receiving portion 403 includes a signal-separating portion which separates the broadband signal (the broadband information) and the narrow band signal (the control information) from the received signal. The receiving portion 403 supplies the broadband signal and the narrow band signal to the signal-processing portion 404. The signal-processing portion 404, for example, filters the broadband signal (the broadband information) based on the narrow band signal (the control information) so as to output the video signal and the audio signal and the like to an internal device or a memory.

The memory 406 is connected to the signal-processing portion 404 so as to store the control information, the video information, the audio information and the like temporarily. As the memory 406, hard disk unit, optical magnetic recording disk unit, optical recording disk unit, tape recording unit and the like are available. These recording units have a larger capacity than the semiconductor memory 406 and a predetermined reading/writing speed.

The signal-processing board 1040*a* may be an LSI device which integrates the shared device 401, the transmitting portion 402, the receiving portion 403, the signal-processing portion 404 and the like into a semiconductor. This allows to be constituted the signal-processing board 1040*a* having the shared device 401 capable of being connected to the asymmetrical flat antenna 100 or the like as the embodiments of the present invention. The signal-processing board 1040*a* may be an asymmetrical flat antenna mounting LSI device, which is loaded with the asymmetrical flat antenna 100 or the like as the embodiments of the present invention as shown in FIG. 16.

The signal-processing board 1040*b* shown in FIG. 28B constitutes the signal-processing unit and contains the transmitting portion 402, the receiving portion 403, the signal-processing portion 404, and the memory 406 (memory unit). In this embodiment, the shared device 401 is omitted and the two antennas 1041*a*2, 1041*b*2 are connected to the transmitting portion 402 and the receiving portion 403, separately. The asymmetrical flat antenna 100 or the like as the embodiments of the present invention is applied to the antennas 1041*a*2, 1041*b*2.

The antenna 1041*a*2 executed wireless communication processing of broadband information with the antenna 1041*b*3 of the adjacent signal-processing board 1040*c* using the broadband performance thereof. Further, wireless communication processing of narrow band information is executed between the narrow band antenna 1101 of the control unit 1050 or the like and the antennas 1041*a*2, 1041*b*2 of the signal-processing board 1040*b*.

The transmitting portion 402 is connected to the antenna 1041*a*2. The transmitting portion 402 has a modulation portion which modulates the broadband information according to a predetermined modulation form and transmits the broadband information based on carrier of a predetermined frequency. The receiving portion 403 is connected to the antenna 1041*b*2. The receiving portion 403 has a demodulation portion which receives the broadband information carried by carrier of a predetermined frequency and demodulates the broadband information according to the predetermined demodulation form.

The signal-processing portion 404 is connected to the transmitting portion 402 and the receiving portion 403 and outputs the broadband information by filtering video information, audio information and the like based on control information. The memory 406 is connected to the signal-processing portion 404 so as to store control information, video information, audio information and the like temporarily. As the memory 406, hard disk unit, optical magnetic recording disk unit, optical recording disk unit, tape recording unit and the like are available. The signal-processing board 1040*b* may be an LSI device which integrates the transmitting portion 402, the receiving portion 403, the signal-processing portion 404 and the like into the semiconductor. Consequently, the signal-processing board 1040*b* which can be connected to the asymmetrical flat antenna 100 or the like as the embodiments of the present invention is constituted. Further, the signal-processing board 1040*b* may be an asymmetrical flat antenna mounting LSI device, which is loaded with the asymmetrical flat antenna 100 or the like as the embodiments of the present invention as shown in FIG. 16.

Figure 29A:
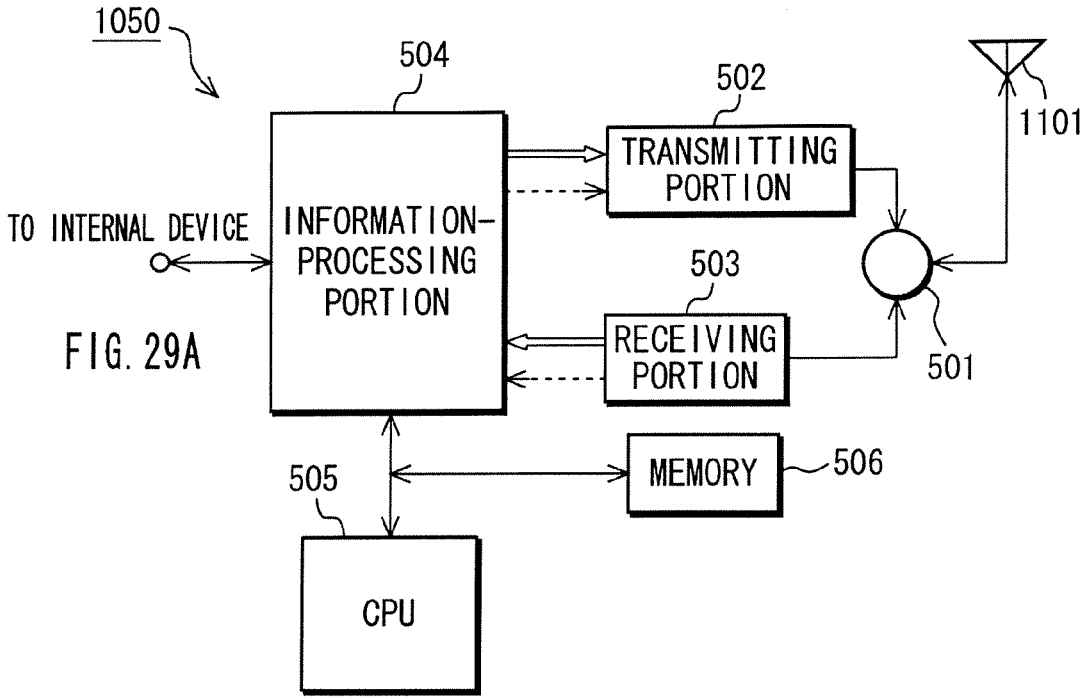
FIGS. 29A, 29B are block diagrams each for showing an inner configuration of the control unit 1050 and the signal-processing board 1040*e* with any control functions.
Figure 29B:
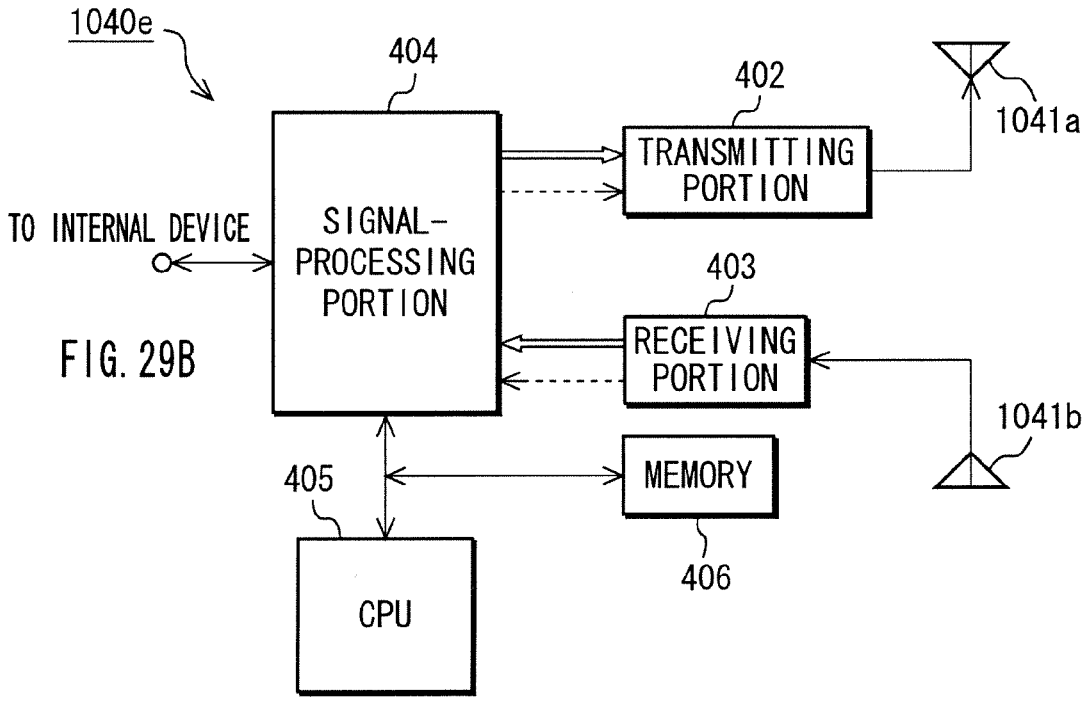

FIGS. 29A, 29B respectively show internal configurations of the control unit 1050 and the signal-processing board 1040*c* having a control function.

The control unit 1050 shown in FIG. 29A controls the antenna 1101 to transmit narrow band information to a plurality of signal-processing boards 1040*a*-1040*d* or the LSI devices wirelessly by utilizing the narrow band performance of the antenna as the embodiments of the invention operable as a narrow band antenna in the far field or the narrow band antenna such as dipole antenna, monopole antenna. For example, the control unit 1050 controls the antenna 1101 to transmit the narrow band information to the plurality of signal-processing boards 1040*a*-1040*d* or the LSI devices at the same time. This enables the narrow band information such as information on synchronization of the control signal and the RF signal or information meaningful for signal processing despite its narrow transmission band to be transmitted wirelessly between the control unit 1050 and each of the signal-processing boards 1040*a*-1040*b* or the LSI devices.

The control unit 1050 has, for example, a shared device 501, a transmitting portion 502, a receiving portion 503, a information-processing portion 504, a CPU 505, and a memory 506 (memory unit). The shared device 501 has three terminals and the antenna 1101 is connected to a first terminal (not shown) thereof. The asymmetrical flat antenna 100 or the like as the embodiments of the present invention is applied to the antenna 1101. The control unit 1050 controls the antenna 1101 to execute wireless communication processing of narrow band information between the control unit 1050 and each of the antennas of adjoining signal-processing boards 1040*a*-1040*d* by utilizing the narrow band performance of the antenna 1101.

The transmitting portion 502 is connected to a second terminal of the shared device 501. The transmitting portion 502 has a modulation function. The transmitting portion 502 modulates narrow band information according to a predetermined modulation form and transmits the narrow band information based on carrier of a predetermined frequency. The receiving portion 503 is connected to a third terminal of the shared device 501. The receiving portion 503 has a demodulation function. The receiving portion 503 receives the narrow band information carried by carrier of a predetermined frequency and demodulates the narrow band information according to the predetermined demodulation form.

The information-processing portion 504 is connected to the transmitting portion 502 and the receiving portion 503. The information-processing portion 504 edits band information based on control information and outputs broadband information by retrieval. The CPU 505 is connected to the information-processing portion 504 so as to specify signal-processing board(s) for executing the signal processing from the signal-processing boards 1040*a*-1040*d*. For example, the information-processing portion 504 divides the broadband information to block units and synthesizes additional information (hereinafter referred to as ID information) at the head of the broadband information divided to the block units. The ID information is control information for specifying signal-processing board(s) for filtering the broadband information from the signal-processing boards 1040*a*-1040*d*. The control information is header information for determining whether or not the signal processing is executed in any of the signal-processing boards 1040*a*-1040*d*.

In this embodiment, the CPU 505 controls the plurality of signal-processing boards 1040*a*-1040*d* or the LSI devices to execute parallel signal processing of the broadband information based on the ID information and the narrow band information. This enables the signal processing of broadband information to be accelerated by the parallel processing thereof with the plurality of signal-processing boards 1040*a*-1040*d* or the LSI devices.

By using utilizing the narrow band performance of the antenna 1101, the CPU 505 controls the signal-processing board, for example, the signal-processing board 1040*b*, or the LSI device on one side to process the broadband information based on the ID information and the narrow band information with the signal-processing board 1040*b* being synchronized with the signal-processing board, for example, the signal-processing board 1040*a*, or LSI device on the other side. For example, by utilizing the narrow band performance of the antenna 1101, the CPU 505 controls the signal-processing boards 1040*a* or the LSI device on an initial stage to receive the broadband information of each block synthesized with the ID information and controls the antenna 1101 to transmit the narrow band information to the plurality of signal-processing boards 1040*a*-1040*d* all at once, so as to acquire a processed result from the signal-processing board 1040*d* or LSI device on a final stage.

Further, by utilizing the narrow band performance of the antenna 1101, the CPU 505 controls the signal-processing boards 1040*a*-1040*d* or LSI devices to process the broadband information asynchronously based on the ID information and the narrow band information. For example, by utilizing the narrow band performance of the antenna 1101, the CPU 505 controls the signal-processing boards 1040*a*-1040*d* or LSI devices on each stage to process asynchronously the broadband information specified to the signal-processing board 1040*b* or the LSI device based on a processed result by the signal-processing board 1040*a* or the LSI device on a preceding stage and output a result processed by the signal-processing board 1040*b* or the LSI device to the signal-processing board 1040*c* or the LSI device on a next stage successively. This enables serial signal processing of the broadband information to be executed using the signal-processing boards 1040*a*-1040*d*.

Of course, the signal-processing board 1040*a*-1040*d* or the LSI devices on each stage may process the broadband information specified by the ID information and the narrow band information based on a synchronous signal. The CPU 505 may control the signal-processing board 1040*a*-1040*d* or the LSI device to execute an appropriate combination of synchronous signal processing, asynchronous signal processing, serial signal processing, and parallel signal processing on the broadband information.

In this example, the control unit 1050 is provided with an information-converting portion (not shown) in addition to the CPU 505 so as to convert the processed result acquired from the signal-processing board 1040*d* or the LSI device on the final stage to information ensuring real-time characteristic. For the information-converting portion, for example, a signal processor or the like is used so as to convert the broadband information to video information and audio information.

The memory 506 is connected to the information-processing portion 504 and the CPU 505 so as to store the control information, the broadband information and the like temporarily. As the memory 506, hard disk unit, optical magnetic recording disk unit, optical recording disk unit, tape recording unit and the like are available.

The control unit 1050 may be constituted as a microprocessor which integrates the shared device 501, the transmitting portion 502, the receiving portion 503, the information-processing portion 504, the CPU 505 and the like into semiconductor. Consequently, the control unit 1050 having the shared device 501 which can be connected to the asymmetrical flat antenna 100 or the like as the embodiments of the present invention is constituted. The control unit 1050 may be constituted as an asymmetrical flat antenna mounting type LSI device which is loaded with the asymmetrical flat antennas 100 or the like as the embodiments of the present invention as shown in FIG. 16. Such the device can contribute to loading of electronic components in high density for portable phone, game machine, portable terminal unit and the like.

FIG. 29B shows the signal-processing board 1040*e* with the control function as an example of the signal-processing unit. The signal-processing board 1040*e* contains the transmitting portion 402, the receiving portion 403, the signal-processing portion 404, the CPU 405, and the memory 406 (memory unit). In this board, the shared device 401 is omitted and the two antennas 1041*a*, 1041*b* are connected to the transmitting portion 402 and the receiving portion 403, separately. The asymmetrical flat antenna 100 or the like as the embodiments of the present invention is applied to each of the antennas 1041*a*, 1041*b*.

The antenna 1041*a* executes wireless communication processing of broadband information with the antenna 1041*b* of the adjoining signal-processing board 1040*a*, 1040*b*, 1040*c* or 1040*d* using the broadband performance thereof. Further, wireless communication processing of narrow band information is executed between the narrow band antenna 1101 of the control unit 1050 or the like and the antennas 1041*a*, 1041*b* of the signal-processing board 1040*e*.

The transmitting portion 402 is connected to the antenna 1041*a*. The transmitting portion 402 has a modulation portion which modulates broadband information according to a predetermined modulation form and transmits the broadband information based on carrier of a predetermined frequency. The receiving portion 403 is connected to the antenna 1041*b*. The receiving portion 403 has a demodulation portion which receives the broadband information carried by carrier of a predetermined frequency and demodulates the broadband information according to the predetermined demodulation form.

The signal-processing portion 404 is connected to the transmitting portion 402 and the receiving portion 403 and outputs broadband information by filtering video information, audio information and the like based on the control information. The CPU 405 is connected to the signal-processing portion 404 so as to specify signal-processing board(s) for executing the signal processing from the signal-processing boards 1040*a*-1040*e* and the like, including the signal-processing board 1040*a*.

In this board, the CPU 405 constitutes an information-determining portion which determines whether or not the broadband information transmitted based on the ID information and the narrow band information is processed. The ID information is control information to be added to the broadband information, for example, header information for determining whether or not the signal processing is executed. The memory 406 is connected to the signal-processing portion 404 and the CPU 405 so as to store the control information, the broadband information and the like temporarily. For example, the memory 406 stores the broadband information determined by the CPU 405 to be processed.

As the memory 406, hard disk unit, optical magnetic recording disk unit, optical recording disk unit, tape recording unit and the like are available. The signal-processing board 1040*e* may be constituted as a microprocessor which integrates the transmitting portion 402, the receiving portion 403, the signal-processing portion 404, the CPU 405 and the like into semiconductor (a single chip). Consequently, the signal-processing board 1040*e* with the control function which can be connected to the asymmetrical flat antenna 100 or the like as the embodiments of the present invention. Further, the signal-processing board 1040*e* may be an asymmetrical flat antenna mounting type LSI device which is loaded with the asymmetrical flat antenna 100 or the like as the embodiments of the present invention as shown in FIG. 16.

FIGS. 30A-30H show a processing example of broadband information D11. The broadband information D11 shown in FIG. 30A is handled by the signal-processing units 200-900 and the like as the embodiments of the present invention and divided to block units as shown in FIG. 30B before signal processing. The broadband information D11 includes video information, audio information or the like demanded for real-time characteristic and is inputted to the control unit 1050 of the mother board 1060 or directly to the signal-processing boards 1040*a*-1040*d*. In the control unit 1050, the CPU 505 divides the broadband information D11 to block units so as to obtain meaningful broadband information D12.

ID information 13 (addition information) shown in FIG. 30C is added to the meaningful broadband information D12 which has been divided into block units shown in FIG. 30B. The ID information D13 is control information which specifies, for example, signal-processing board(s) for filtering the meaningful broadband information D12 from the signal-processing boards 1040*a*-1040*d*. The control information includes flag information for determining whether or not signal processing is executed in any of the signal-processing boards 1040*a*-1040*d*. For example, when flag information=1, signal processing "required" is indicated and when flag information=0, signal processing "not required" is indicated. The CPU 505 synthesizes (binds) the ID information D13 at the head of the meaningful broadband information D12 which has been each divided into block units.

Meaningful broadband information block data D14 shown in FIG. 30D is formed by synthesizing the ID information D13 with the meaningful broadband information D12. The meaningful broadband information block is data unit which is processed in batch by each of the signal-processing boards 1040*a*-1040*d*. The ID information D13 is synthesized at the head of the meaningful broadband information D12 during signal processing and controlled.

Meaningful broadband information block data D14*a* with the ID information shown in FIG. 30E is obtained when the signal processing ends. The data D14*a* after the signal processing ends is transmitted, for example, from the signal-processing board 1040*d* at the final stage to the control unit 1050 of the mother board 1060.

The ID information D13*a* shown in FIG. 30F is separated from the data D14*a* of the meaningful broadband information block after the signal processing ends. When the CPU 505 of the control unit 1050 controls the information-processing portion 504, the ID information D13*a* is separated from the data D14*a*. The meaningful broadband information D12*a* shown in FIG. 30G is obtained when the ID information D13*a* is separated from the data D14*a*.

The meaningful broadband information D12*a* after the ID information is separated is converted to information whose real-time characteristic is secured by the information-converting portion controlled by the CPU 505. Broadband information D11*a* shown in FIG. 30H is information whose real-time characteristic is secured. The information-converting portion converts the meaningful broadband information D12*a* to the broadband information D11*a* such as video information, audio information and the like. This enables the signal-processing boards 1040*a*-1040*d* to process the meaningful broadband information D12.

Figure 31:
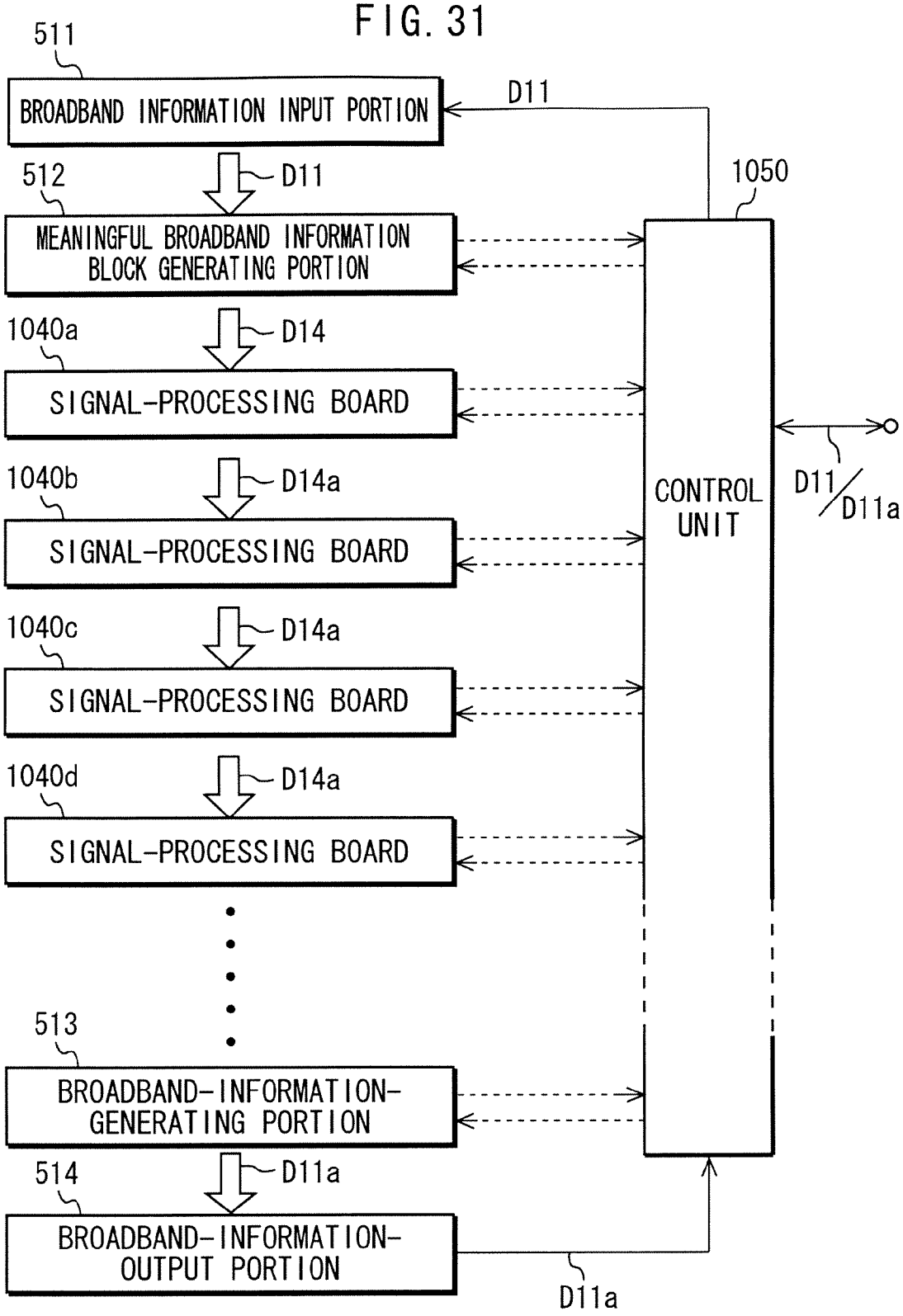
FIG. 31 is a flowchart for showing an example of serial processing of the broadband information D11.

FIG. 31 is a flowchart for showing an example of serial processing of the broadband information D11. This example shows serial processing of the meaningful broadband information block data D14 and flow of narrow band information signal. This signal-processing procedure is realized by the signal-processing boards 1040*a*, 1040*b*, 1040*e* described in FIGS. 28A, 18B, 29B and a processing example shown in FIGS. 34A-37.

In the serial-processing example of the broadband information D11 shown in FIG. 31, for example, the broadband information D11 is inputted to a broadband information input portion 511 from the control unit 1050 of, for example, the mother board 1060. The broadband information D11 at this time is thrown into the control unit 1050 from a control apparatus on a higher level. The broadband information D11 is video information, audio information and the like demanded for real-time characteristic and serially inputted to the control unit 1050 or directly to the signal-processing boards 1040*a*-1040*d*.

The broadband information D11 is outputted from the broadband information input portion 511 to a meaningful broadband information block generating portion 512. In the meaningful broadband information block generating portion 512, the broadband information D11 shown in FIG. 30A is divided to the block units as shown in FIG. 30B before the signal processing based on the narrow band information. The narrow band information is subjected to narrow band wireless communication processing between the meaningful broadband information block generating portion 512 and the control unit 1050.

The ID information D13 (addition information) shown in FIG. 30C is added to the meaningful broadband information D12 which has been divided to block units. The meaningful broadband information block generating portion 512 outputs the meaningful broadband information block data D14 added with the ID information D13 to the signal-processing board 1040*a* using the asymmetrical flat antenna 100 or the like as the embodiments of the present invention.

The meaningful broadband information block data D14 is processed by the signal-processing board 1040*a* based on the narrow band information and the ID information D13. The narrow band information is subjected to narrow band wireless communication processing between the signal-processing board 1040*a* and the control unit 1050. In the signal-processing board 1040*a*, the meaningful broadband information D12 in the meaningful broadband information block data D14 shown in FIG. 30D is filtered based on the narrow band information.

At this time, the ID information D13 is synthesized at the head of the meaningful broadband information D12 and controlled. After filtering, the data D14 turns to the meaningful broadband information block data D14*a* shown in FIG. 30E. After signal processing, the data D14*a* is transmitted wirelessly from the signal-processing board 1040*a* to the signal-processing board 1040*b* using the asymmetrical flat antenna 100 or the like as the embodiments of the present invention.

The signal-processing board 1040*b* processes the meaningful broadband information block data D14 based on the narrow band information and the ID information D13 like the signal-processing board 1040*a*. The narrow band information is subjected to narrow band wireless communication processing between the signal-processing board 1040*b* and the control unit 1050. In the signal-processing board 1040*b*, the meaningful broadband information D12 in the meaningful broadband information block data D14 shown in FIG. 30D is filtered based on the narrow band information. The signal-processing board 1040*b* transmits the meaningful broadband information block data D14*a* after signal processing to the signal-processing board 1040*c* using the asymmetrical flat antenna 100 or the like as the embodiments of the present invention.

The signal-processing board 1040*c* processes the meaningful broadband information block data D14 based on the narrow band information and the ID information D13 like the signal-processing board 1040*b*. The narrow band information is subjected to narrow band wireless communication processing between the signal-processing board 1040*c* and the control unit 1050. In the signal-processing board 1040*c*, the meaningful broadband information D12 in the meaningful broadband information block data D14 shown in FIG. 30D is filtered based on the narrow band information. The signal-processing board 1040*c* transmits the meaningful broadband information block data D14*a* after signal processing to the signal-processing board 1040*d* using the asymmetrical flat antenna 100 or the like as the embodiments of the present invention.

The signal-processing board 1040*d* processes the meaningful broadband information block data D14 based on the narrow band information and the ID information D13 like the signal-processing board 1040*c*. The narrow band information is subjected to narrow band wireless communication processing between the signal-processing board 1040*d* and the control unit 1050. In the signal-processing board 1040*d*, the meaningful broadband information D12 in the meaningful broadband information block data D14 shown in FIG. 30D is filtered based on the narrow band information.

The signal-processing board 1040*d* transmits the meaningful broadband information block data D14*a* after signal processing to a signal-processing board on a next stage using the asymmetrical flat antenna 100 or the like as the embodiments of the present invention. Likewise, broadband wireless communication processing is executed between the signal-processing boards using the asymmetrical flat antenna 100 or the like as the embodiments of the present invention and the data D14*a* after signal processing is transmitted wirelessly from the signal-processing board on the final stage to a broadband-information-generating portion 513.

The broadband-information-generating portion 513 separates the ID information 13*a* shown in FIG. 30F from the meaningful broadband information block data D14*a* after signal processing based on the narrow band information. The narrow band information is subjected to narrow band wireless communication processing between the broadband-information-generating portion 513 and the control unit 1050. If the ID information D13*a* is separated from the data D14*a*, the meaningful broadband information D12*a* shown in FIG. 30G is obtained. The meaningful broadband information D12*a* is outputted from the broadband-information-generating portion 513 to a broadband information output portion 514.

The broadband information output portion 514 converts the meaningful broadband information D12*a* after the ID information is separated to information whose real-time characteristic is secured. The broadband information output portion 514 converts the meaningful broadband information D12*a* to the broadband information D11*a* such as video information and audio information. This enables the meaningful broadband information D12 to be processed by the signal-processing boards 1040*a*-1040*d*.

Thus, the broadband information D11 subjected to wireless communication processing is transmitted to the signal-processing boards 1040*a*-1040*b*-1040*c*-1040*d* . . . successively using the asymmetrical flat antenna 100 or the like as the embodiments of the present invention. By executing the broadband wireless communication processing a plurality of times, the broadband information D11 can be transmitted from an input end of the signal-processing board 1040*a* to an output end of a signal-processing board located at a far position. In the meantime, the broadband information input portion 511, the meaningful broadband information block generating portion 512, the broadband-information-generating portion 513 and the broadband information output portion 514 may be included in the information-processing portion 504 in the control unit 1050.

Figure 32:
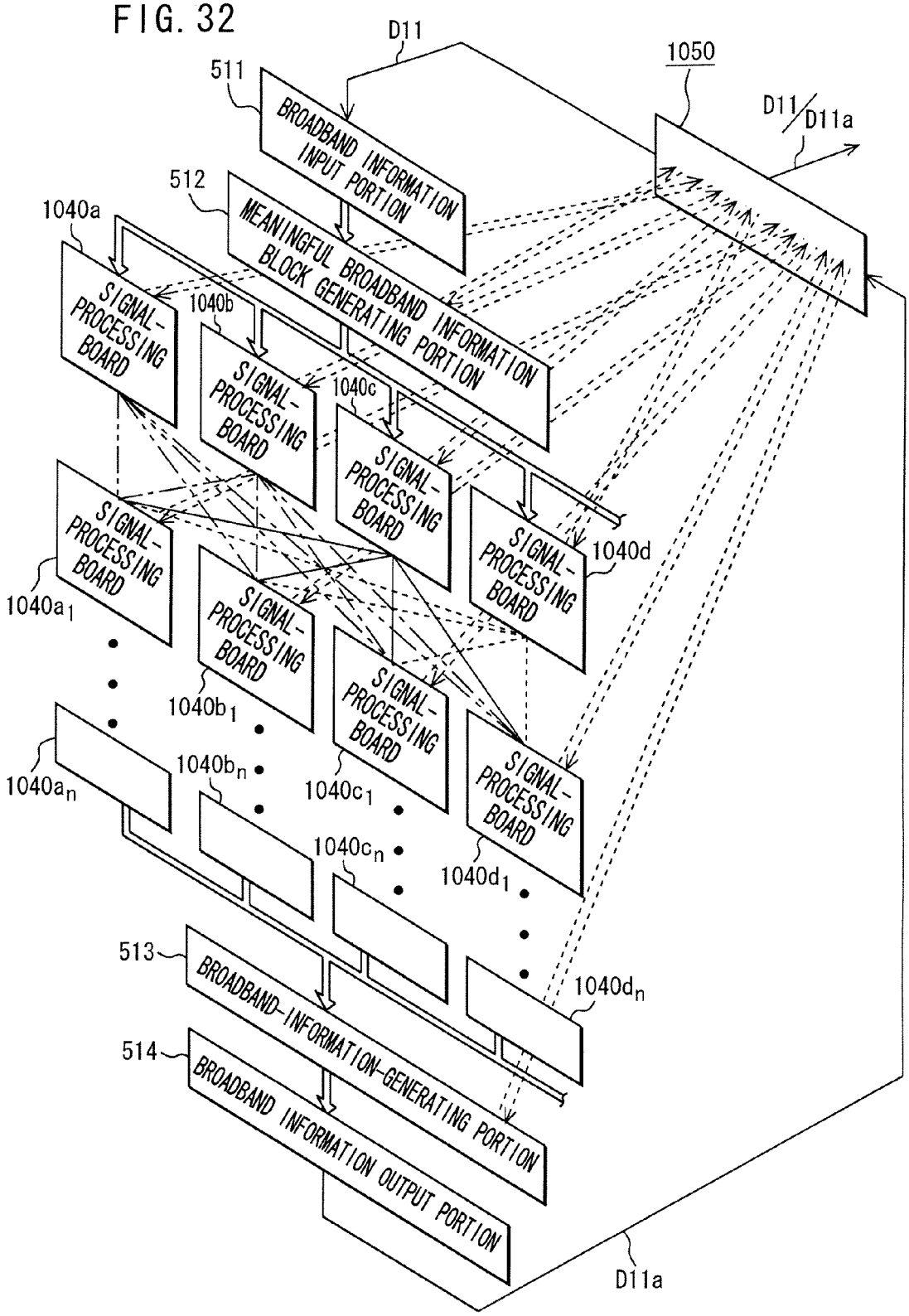
FIG. 32 is a flowchart for showing an example of parallel processing of the broadband information D11.

FIG. 32 is a flow chart for showing an example of parallel processing of the broadband information D11. This example shows condition of processing the meaningful video information block data D14 in parallel asynchronously and flow of narrow band information in the plural signal-processing boards 1040*a*-1040*d* and the signal-processing boards 1040*a*1-1040*d*1. This signal-processing procedure is achieved in configurations of the signal-processing boards 1040*a*, 1040*b*, 1040*e* and the control unit 1050 described in FIGS. 28A, 28B, 29A, and 29B and the processing examples shown in FIG. 34A-FIG. 37.

In the parallel processing example of the broadband information D11 shown in FIG. 32, the broadband information D11 is inputted from the control unit 1050 of the mother board 1060 to the broadband information input portion 511. At this time, the broadband information D11 is thrown into the control unit 1050.

The broadband information D11 is outputted from the broadband information input portion 511 to the meaningful broadband information block generating portion 512. In the meaningful broadband information block generating portion 512, the broadband information D11 shown in FIG. 30A is divided to the block units as shown in FIG. 30B before the signal processing based on the narrow band information. The narrow band information is subjected to narrow band wireless communication processing between the meaningful broadband information block generating portion 512 and the control unit 1050. The ID information D13 (addition information) shown in FIG. 30C is added to the meaningful broadband information D12 which has been divided into block units.

The meaningful broadband information block generating portion 512 transmits the meaningful broadband information block data D14 added with the ID information D13 to the signal-processing boards 1040*a*, 1040*b*, 1040*c*, 1040*d*, . . . all at once using the asymmetrical flat antenna 100 or the like as the embodiments of the present invention. The ID information D13 is used to synchronize the data D14 at that time. ASK modulation, TDMA (time division multiple access), FDMA (frequency division multiple access), CDMA (code division multiple access) and the like are used to transmit signals in parallel to the signal-processing boards 1040*a*, 1040*b*, 1040*c*, 1040*d* and the like.

The meaningful broadband information block data D14 is subjected to parallel signal processing with the signal-processing boards 1040*a*, 1040*b*, 1040*c*, 1040*d* and the like based on the narrow band information and the ID information D13. The narrow band information is subjected to narrow band wireless communication processing between the signal-processing board 1040*a* and the control unit 1050, between the signal-processing board 1040*b* and the control unit 1050, between the signal-processing board 1040*c* and the control unit 1050, between the signal-processing board 1040*d* and the control unit 1050, and the like. Although the narrow band information has been transmitted using the antennas as embodiments of the present invention, an antenna special for the narrow band information may be provided within each of the signal-processing boards 1040*a*-1040*d* separately. The storage quantity of the meaningful video information block data D14 and the narrow band information may be set dynamically with the narrow band information and the ID information D13 as key information.

In the signal-processing board 1040*a*, the meaningful broadband information D12 in the meaningful broadband information block data D14 shown in FIG. 30D is filtered based on the narrow band information. The signal-processing board 1040*a* stores the meaningful broadband information D12 and the narrow band information and the like of some blocks in the memory 406 thereof. For example, the meaningful video information block data D14 of some blocks stored in the signal-processing board 1040*a* is subjected to signal processing one by one in the LSI device, electronic component, mechanical component or the like. At this time, the signal processing of the meaningful broadband information D12 is executed asynchronously with the ID information D13 and the narrow band information as key information.

The ID information D13 is synthesized at the head of the meaningful broadband information D12 and controlled. The data D14 after filtering turns to the meaningful broadband information block data D14*a* shown in FIG. 30E. The data D14*a* after the signal processing ends is transmitted wirelessly from the signal-processing board 1040*a* to any one of the signal-processing boards 1040*a*1, 1040*b*1, 1040*c*1, 1040*d*1 and the like on lower level or all the signal-processing boards 1040*a*1, 1040*b*1, 1040*c*1, 1040*d*1 and the like using the asymmetrical flat antenna 100 or the like as the embodiments of the present invention. At this time, the self-other determination function of the signal-processing broad 1040*e* is used and if no signal-processing board is specified, the data D14*a* is transmitted to an adjacent signal-processing board. In the meantime, the same signal processing as in the aforementioned signal-processing board 1040*a* is performed in the signal-processing boards 1040*b*, 1040*c*, 1040*d*, and the like.

In the signal-processing boards 1040*a*1-1040*d*1 on the lower level, for example, the signal-processing board 1040*a*1, the meaningful broadband information D12 in the meaningful broadband information block data D14 shown in FIG. 30D is filtered based on the narrow band information. The narrow band information is subjected to narrow band wireless communication processing between the signal-processing board 1040*a*1 and the control unit 1050. The signal-processing board 1040*a*1 stores the meaningful broadband information D12, the narrow band information and the like of some blocks in the memory 406 thereof. For example, the meaningful video information block data D14 of some blocks stored in the signal-processing board 1040*a*1 is subjected to signal processing successively in the LSI device, electronic component, mechanical component or the like. At that time, the signal processing of the meaningful broadband information D12 is executed asynchronously with the ID information D13 and the narrow band information as key information.

The ID information D13 is synthesized at the head of the meaningful broadband information D12 during signal processing and controlled. The data D14 after filtering turns to the data D14*a* of the meaningful broadband information block shown in FIG. 30E. The data D14*a* after the signal processing ends is wirelessly transmitted from the signal-processing board 1040*a*1 to any one of the signal-processing boards 1040*a*2, 1040*b*2, 1040*c*2, 1040*d*2 and the like, which are not shown, or all the signal-processing boards 1040*a*2, 1040*b*2, 1040*c*2, 1040*d*2 and the like by using the asymmetrical flat antenna 100 or the like as the embodiments of the present invention.

At this time, the self-other determination function of the signal-processing board 1040*e* is used and if no signal-processing board is specified, the data D14*a* is transmitted to an adjacent signal-processing board. In the meantime, the same signal processing as that of the aforementioned signal-processing board 1040*a*1 is executed in each of the signal-processing boards 1040*b*1, 1040*c*1, 1040*d*1 and the like. The narrow band information is subjected to narrow band wireless communication processing between the signal-processing board 1040*b*1 and the control unit 1050, between the signal-processing board 1040*c*1 and the control unit 1050, between the signal-processing board 1040*d*1 and the control unit 1050 and the like.

The data D14*a* after the signal processing is transmitted wirelessly from the signal-processing boards 1040*an*-1040*mn* on the final stage of the signal-processing board array with m columns and n rows to the broadband-information-generating portion 513. The broadband-information-generating portion 513 separates the ID information D13*a* shown in FIG. 30F from the data D14*a* after the signal processing based on the narrow band information. The narrow band information is subjected to narrow band wireless communication processing between the broadband-information-generating portion 513 and the control unit 1050. If the ID information D13*a* is separated from the data D14*a*, the meaningful broadband information D12*a* shown in FIG. 30G is obtained. The meaningful broadband information D12*a* is outputted from the broadband-information-generating portion 513 to the broadband information output portion 514.

The broadband information output portion 514 converts the meaningful broadband information D12*a* after the ID information is separated to information whose real-time characteristic is secured. The broadband information D11*a* shown in FIG. 30H is information whose real-time characteristic is secured. The broadband information output portion 514 converts the meaningful broadband information D12*a* to the broadband information D11*a* such as video information and audio information. Consequently, the meaningful broadband information D12 can be processed in parallel with the signal-processing board array 1040*a*-1040*mn*. In the meantime, the broadband information input portion 511, the meaningful broadband information block generating portion 512, the broadband-information-generating portion 513, and the broadband information output portion 514 may be included in the information-processing portion 504 of the control unit 1050.

FIGS. 33A-33H show a processing example of the video information D21. This example takes a case where the broadband information is video information D21 to be inputted from outside. The broadband information shown in FIG. 33A is handled by the signal-processing unit 200-900 and the like as the embodiments of the present invention and is divided to field units as shown in FIG. 33B before the single processing. The video information D21 is demanded for real-time characteristic and inputted to the control unit 1050 of the mother board 1060 or directly to the signal-processing boards, for example, the boards 1040*a*-1040*d*. In the control unit 1050, the CPU 505 divides the video information D21 to field units so as to obtain meaningful video information D22.

The ID information D23 (addition information) shown in FIG. 33C is added to the meaningful video information D22 which has been divided to field units as shown in FIG. 33B. The ID information D23 is control information for specifying signal-processing board(s), for example, for filtering the meaningful video information D22 from the signal-processing boards 1040*a*-1040*d*. The control information includes flag information for determining whether or not the signal processing is executed in any of the signal-processing boards 1040*a*-1040*d*.

For example, when the flag information=1, signal processing "required" is indicated and when the flag information=0, signal processing "not required" is indicated. The CPU 505 synthesizes (binds) the ID information D23 at the head of the meaningful broadband information D22 which has been each divided to field units. In this way, the inputted video information is divided to each field and the ID information is added to the head of each field so as to form a single meaningful video information block. The ID information may be added thereto within a blanking period contained in ordinary video information.

The meaningful broadband information block data D24 shown in FIG. 33D is formed by synthesizing the ID information D23 with the meaningful broadband information D22. The meaningful broadband information block is data unit which is processed in batch by the signal-processing boards 1040*a*-1040*d*. The meaningful video information block added with the ID information is distributed to the plurality of signal-processing boards 1040*a*-1040*d* all at once passing through the adjacent signal-processing boards 1040*a*-1040*b*-1040*c*-1040*d*. When it is determined that signal processing on a given signal-processing board with the narrow band information and ID information D23 as key information is carried out, the signal processing is executed in the meaningful video information block.

The meaningful video information block added with the ID information D23 is processed by the signal-processing boards 1040*a*-1040*d*. The meaningful video information block is administrated with the ID information D23 being synthesized at the head of the meaningful video information of each field unit during signal processing. For example, the ID information D23 includes information which is generated as a result of the signal processing in the signal-processing boards 1040*a*-1040*d* in addition to the control signal and field number. If it is determined that any signal processing on a given signal-processing board with the narrow band information and ID information D23 as key information is not specified, the signal processing on the given meaningful video information block is not performed. The narrow band information includes the control signal and the information which is generated as a result of signal processing in the signal-processing boards 1040*a*-1040*d*.

The data D24*a* of the meaningful video information block with the ID information shown in FIG. 33E is obtained when the signal processing ends. The data D24*a* after the signal processing ends is transferred from the signal-processing board 1040*d* on the final stage to the control unit 1050 of the mother board 1060. The ID information D23*a* shown in FIG. 33F is separated from the data D24*a* of the meaningful video information block after the signal processing ends. The ID information D23*a* is separated from the data D24*a* when the CPU 505 controls the information-processing portion 504 in the control unit 1050. The meaningful video information D22*a* shown in FIG. 33G is obtained when the ID information D23*a* is separated form the data D24*a*.

The meaningful video information D22*a* after the ID information is separated is converted to information whose real-time characteristic is secured by the information-converting portion controlled by the CPU 505. The video information D21*a* shown in FIG. 33H is information whose real-time characteristic is secured. The information-converting portion converts the meaningful video information D22*a* to the video information D21*a* such as video information and audio information. This enables the meaningful video information D22 to be processed with the signal-processing boards 1040*a*-1040*d*.

The following will describe an example of the signal processing in the control unit 1050 and the signal-processing boards 1040*a*-1040*e* with reference to FIG. 34A-FIG. 37.

Figures 34A, 34B:
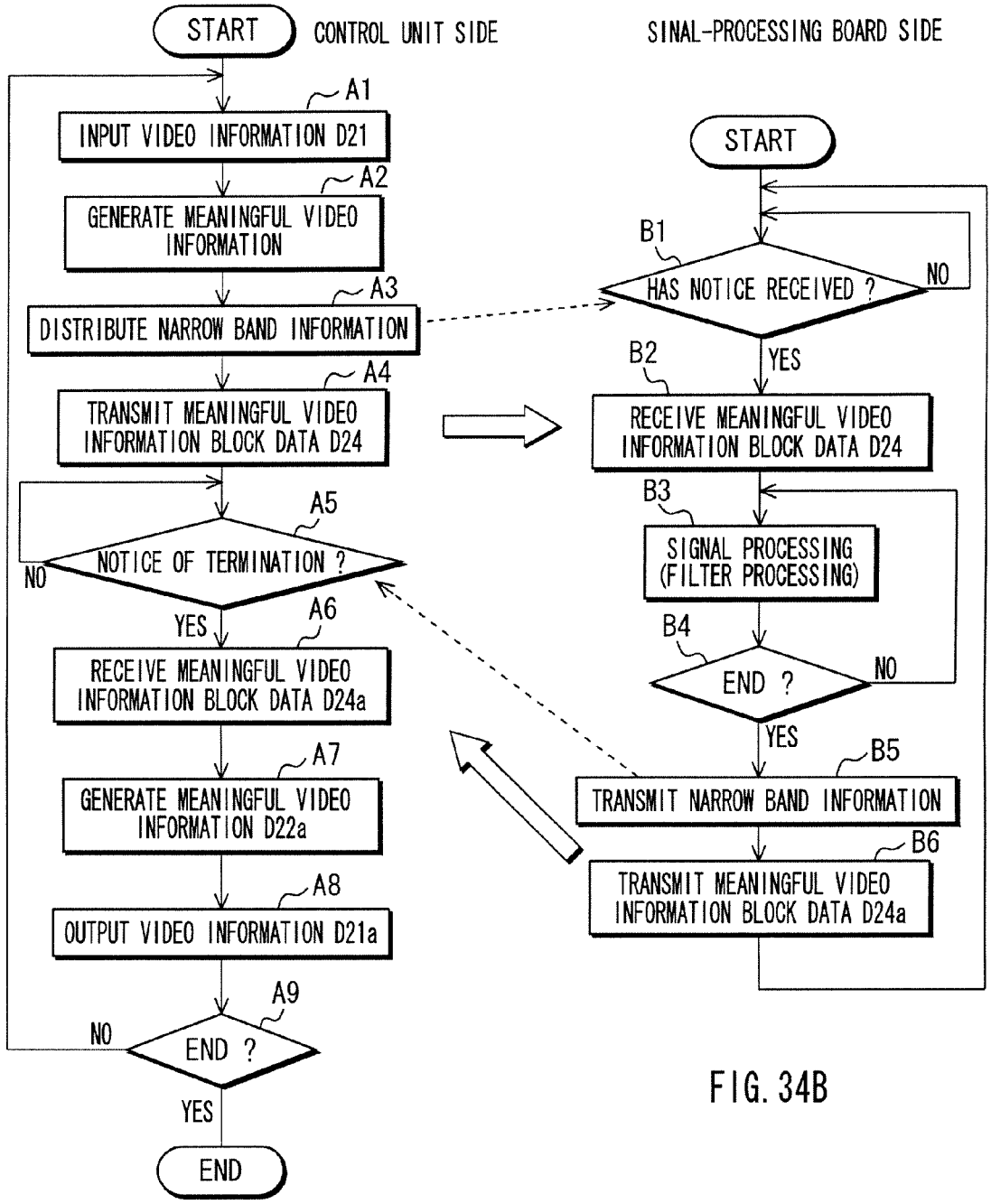
FIGS. 34A, 34B are flowcharts each for showing an example of wireless communication between the control unit 1050 and each of the signal-processing boards 1040*a*-1040*d;*

FIGS. 34A and 34B are flowcharts each for showing an example of wireless communication between the control unit 1050 and the signal-processing boards 1040*a*-1040*d*.

In this example, the control unit 1050 provided with the narrow band antenna 1101 and the signal-processing boards 1040*a*-1040*d* having the antennas 1041*a*, 1041*b* with a ratio of bandwidth of 11% or more are installed to oppose each other within a short distance so as to execute wireless communication processing among the control unit 1050 and each of the signal-processing boards 1040*a*-1040*d*. The meaningful video information D22 of each field with the ID information D23 synthesized is inputted to the signal-processing board 1040*a* on an initial stage while the narrow band information is transmitted to the plurality of signal-processing boards 1040*a*-1040*d* all at once so as to acquire a processed result from the signal-processing board 1040*d* on the final stage. In the following figures, an arrow of bold line indicates broadband wireless communication and an arrow of dotted line indicates narrow band wireless communication.

Under these wireless communication conditions, the control unit 1050 allows the video information D21 to be input from outside in step A1 of the flowchart shown in FIG. 34A. The video information D21 shown in FIG. 33A is demanded for real-time characteristic. Then, the meaningful video information D22 is generated in step A2 in the control unit 1050. At this time, the CPU 505 allows the video information D21 to be divided into each field and the ID information D23 shown in FIG. 33C to be added to the head of the meaningful information D22 which has been each divided to field as shown in FIG. 33B.

The ID information D23 is control information for specifying, for example, signal-processing board(s) for filtering the meaningful video information D22 from the signal-processing boards 1040*a*-1040*d*. The control information includes flag information for determining whether or not the signal processing is executed in any of the signal-processing boards 1040*a*-1040*d*. For example, when the flag information=1, signal processing "required" is indicated and when flag information=0, signal processing "not required" is indicated. The meaningful video information block data D24 shown in FIG. 33D is formed by synthesizing the ID information D23 with the meaningful video information D22. In the meantime, the ID information may be added thereto within a blanking period contained in ordinary video information.

In step A3, the control unit 1050 allows the narrow band information to be distributed to the signal-processing boards 1040*a*-1040*d* all at once. At this time, the narrow band information is transmitted wirelessly to the plurality of signal-processing boards 1040*a*-1040*d* using the narrow band performance of the antenna which acts as the narrow band antenna 1101 in the far field. Consequently, the control information and the like can be transmitted to the plurality of signal-processing boards 1040*a*-1040*d* all at once.

After that, in step A4, the control unit 1050 allows the meaningful video information block data D24 added with the ID information D23 to be transmitted to each of the signal-processing boards 1040*a*-1040*d*. At this time, the meaningful video information block data D24 is distributed to the plurality of signal-processing boards 1040*a*-1040*d* all at once passing through the adjacent signal-processing boards 1040*a*-1040*b*-1040*c*-1040*d* using the antennas thereof (asymmetrical flat antenna 100 or the like as the embodiments of the present invention).

On the other hand, each of the signal-processing boards 1040*a*-1040*d* receives narrow band information distributed from the control unit 1050 in step B1 of the flowchart shown in FIG. 34B. The contents of the narrow band information include a notice notifying that the meaningful video information block data D24 will be transmitted. After that, the signal-processing boards 1040*a*-1040*d* recognizes the notice of transmitting the meaningful video information block data D24 and the procedure proceeds to step B2.

In the step B2, for example, the signal-processing board 1040*a* receives the meaningful video information block data D24 and stores that data D24 in the memory 406 thereof. Next, in step B3, the signal-processing board 1040*a* reads the meaningful video information block data D24 out of the memory 406 based on the ID information D23 and the narrow band information so that an object signal processing, for example, filter processing is performed. The ID information D23 is synthesized at the head of the meaningful video information D22 of each field and controlled. For example, the ID information D23 includes information generated as a result of signal processing in the signal-processing boards 1040*a*-1040*d* in addition to the control signal and field number.

Other signal-processing boards 1040*b*-1040*d* execute parallel signal processing of the meaningful video information block data D24 added with the ID information D23. For example, the signal-processing board 1040*b* processes the meaningful video information D22 based on the ID information D23 and the narrow band information with the signal-processing board 1040*b* being synchronized with the other signal-processing board 1040*a*. Of course, without being limited to this, the signal-processing board can process the meaningful video information D22 asynchronously based on the ID information D23 and the narrow band information. The signal-processing boards 1040*a*-1040*d* can process any appropriate combination of synchronous signal processing, asynchronous signal processing, serial signal processing, and parallel signal processing of the video information D21.

In step B4, the respective signal-processing boards 1040*a*-1040*d* determine whether or not any object signal processing therefor has been terminated. Whether or not the object signal processing is terminated is determined by detecting an end of flag or the like. If the signal processing has not yet terminated, the procedure returns to step B3 in which the object signal processing is continued. If the signal processing has already terminated, the procedure proceeds to step B5 in which the signal-processing boards 1040*a*-1040*d* notify notice of signal-processing termination to the control unit 1050 in the form of narrow band information. The narrow band information includes information generated as a result of signal processing in the control unit 1050 and the signal-processing boards 1040*a*-1040*d* and the like.

On the other hand, in step A5, the control unit 1050 stands by for the notice of signal-processing termination. If it receives the notice of signal-processing termination from all of the signal-processing boards 1040*a*-1040*d*, the procedure proceeds to step A6. A processed result of the meaningful video information D22 specified by the signal-processing board 1040*b* on a given stage based on the processed result of the signal-processing board 1040*a* on a previous stage is transmitted wirelessly in sequence to the signal-processing board 1040*c* on a preceding stage using the asymmetrical flat antennas as embodiments of the present invention to output.

Because in step B6 shown in FIG. 34B, the meaningful video information block data D24*a* after signal processing is transmitted from the signal-processing board 1040*d* to the control unit 1050, the control unit 1050 receives the meaningful video information block data D24*a* after the signal processing in step A6 shown in FIG. 34A. At this time, the control unit 1050 receives and obtains the meaningful video information data D24*a* added with the ID information shown in FIG. 33E from the signal-processing board 1040*d* on the final stage.

The control unit 1050 creates the meaningful video information D22*a* in step A7. For example, the ID information D23*a* shown in FIG. 33F is separated from the meaningful video information block data D24*a* after the signal processing. The ID information D23*a* is separated from the data D24*a* when the CPU 505 in the control unit 1050 controls the information-processing portion 504. When the ID information D23*a* is separated from this data D24*a*, the meaningful information D22*a* shown in FIG. 33G is obtained.

Then, in step A8, the CPU 505 allows the obtained meaningful video information D22*a* (processed result) to be converted to video information D21*a* whose real-time property is secured and the video information D21*a* to be output. For example, the meaningful video information D22*a* after the ID information is separated is converted to the information whose real-time property is secured as shown in FIG. 33H by the information-converting portion controlled by the CPU 505. The information-converting portion converts the meaningful video information D22*a* to the video information D21*a*. As a consequence, the video information D21*a* obtained by processing the meaningful video information D22 by the signal-processing boards 1040*a*-1040*d* can be outputted. After that, in step A9, the CPU 505 determines the signal-processing termination. For example, if power off information is detected, the signal processing is ended. Unless the power off information is detected, the procedure returns to the step A1 in which the above-described signal processing is continued.

Figure 35:
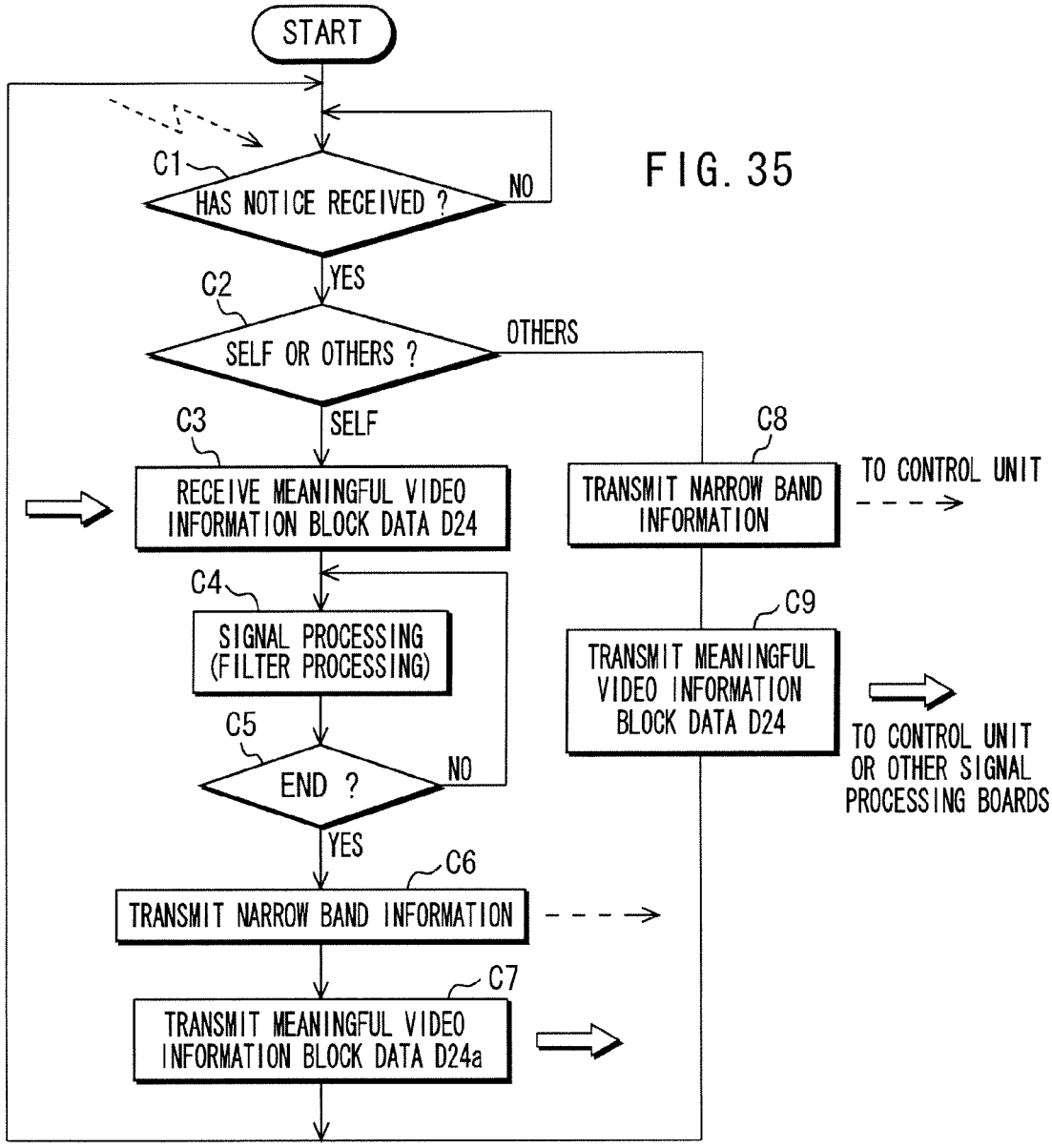
FIG. 35 is a flowchart for showing an example of wireless communication in the signal-processing board 1040*e* with any determination functions.

FIG. 35 is a flowchart for showing an example of wireless communication in the signal-processing board 1040*e* with any determination functions. In this example, the signal-processing board 1040*e* is provided with the CPU 405 shown in FIG. 29B, which determines whether or not the signal-processing board 1040*e* is specified based on the meaningful video information block data D24*a*. If the given signal-processing board 1040*e* is not specified based on this determination result, the meaningful video information block data D24*a* is transmitted to other signal-processing boards 1040*a*-1040*d*.

With this as signal-processing condition, the signal-processing board 1040*e* with the determination functions receives the narrow band information distributed from the control unit 1050 in step C1 of the flowchart shown in FIG. 35 using the narrow band performance of the asymmetrical flat antenna 100 or the like. The contents of the narrow band information include a notice in advance saying that the meaningful video information block data D24 will be transmitted. After that, the signal-processing board 1040*e* recognizes the notice of transmission of the meaningful video information block data D24 and the procedure proceeds to step C2.

In step C2, the signal-processing board 1040*e* determines whether the meaningful video information block data D24 aims at the given signal-processing board 1040*e* (to self) or other signal-processing boards 1040*a*, 1040*b*, 1040*c*, 1040*d* (to others) based on the narrow band information. The determination at this time is carried out based on information included in the narrow band information, for example, information for "specifying the signal-processing board 1040*e*" or the like.

If it is determined that the signal-processing board 1040*e* has been not yet specified based on this determination result, the procedure proceeds to step C8 without executing the signal processing of the meaningful video information block data D24 and the signal-processing board 1040*e* notifies the narrow band information to the control unit 1050. The contents of the narrow band information in this case include "the meaningful video information block data D24 does not aim at the given signal-processing board 1040*e* but other signal-processing boards 1040*a*, 1040*b*, 1040*c*, 1040*d*" or the like (self-other determination function).

In step C9, the signal-processing board 1040*e* transmits the meaningful video information block data D24 to the other signal-processing boards 1040*a*, 1040*b*, 1040*c*, 1040*d* using the asymmetrical flat antenna 100 or the like. If it is determined that the data D24 aims at "the given signal-processing board 1040*e*" in the step C2, the procedure proceeds to step C3. In the step C3, the signal-processing board 1040*e* receives the data D24 using the asymmetrical flat antenna 100 or the like. At this time, the meaningful video information block data D24 is stored in the memory 406.

After that, the procedure proceeds to step C4 in which the signal-processing board 1040*e* executes signal processing of the video information D21 based on the narrow band information and the ID information D23. At this time, the signal-processing board 1040*e* reads the meaningful video information block data D24 out of the memory 406 so as to perform an object signal processing, for example, filter processing. The ID information D23 is synthesized at the head of the meaningful video information D22 of each field during signal processing and controlled. The ID information D23 includes information generated as a result of the signal processing in the signal-processing boards 1040*a*-1040*d* in addition to the control signal and field number.

In step C5, the signal-processing board 1040*e* detects whether or not an object signal processing is ended. Whether or not the object signal processing is ended is determined by detecting an end of flag or the like of the data D24. Unless the signal processing is ended, the procedure returns to step C4 in which the object signal processing is continued. If the signal processing is ended, the procedure proceeds to step C6 in which the signal-processing board 1040*e* notifies the signal-processing termination to the control unit 1050 in narrow band information form therefor. After that, in step C7, the meaningful video information block data D24*a* after signal processing is transmitted from the signal-processing board 1040*e* to the control unit 1050. Consequently, the signal-processing board 1040*e* can process the meaningful video information D22 based on the self-other determination function.

In the meantime, the same processing as the processing procedure in the flowchart shown in FIG. 34B is carried out in the signal-processing boards 1040*a*-1040*d* supplied with the meaningful video information block data D24. A different signal processing is executed in the signal-processing boards 1040*a*-1040*d* with the narrow band information and the ID information D23. If each of the plurality of signal-processing boards 1040*e* has a determination function, whether or not the meaningful video information block data D24 is necessary for signal processing of itself using the narrow band information and the ID information D23 as key information and the meaningful video information D22 is processed based on the self-other determination processing.

Figure 36:
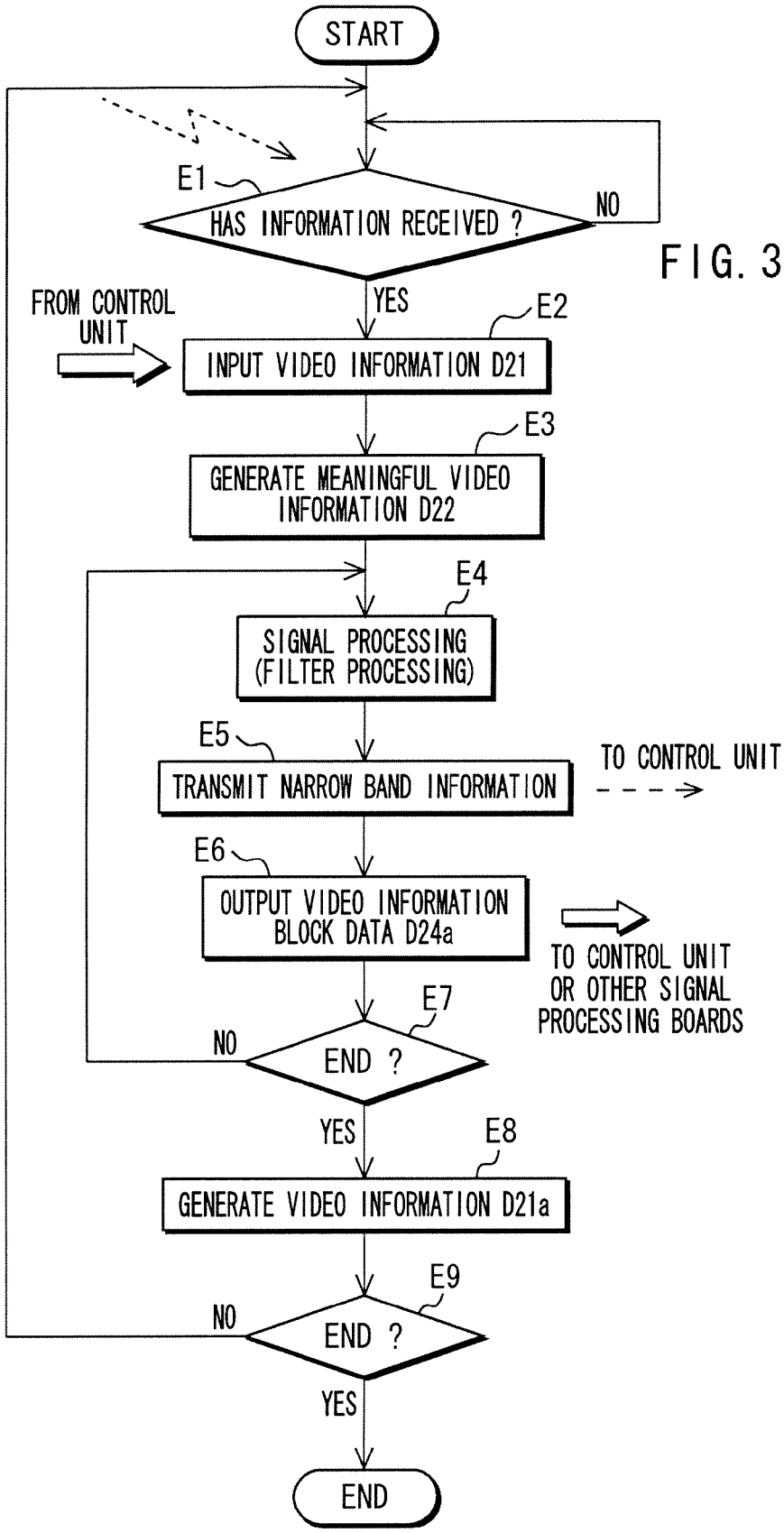
FIG. 36 is a flowchart for showing an example of wireless communication in the signal-processing board 1040*e*-1 with any control functions.

FIG. 36 is a flowchart for showing an example of wireless communication in the signal-processing board 1040*e*-1 with any control functions. In this example, the signal-processing board 1040*e* shown in FIG. 28B includes generation function of the meaningful video information block and generation output function of the video information and the signal-processing board 1040*e*-1 executes the generation processing of the meaningful video information block and the generation output processing of the video information. In this example, at the same time when the signal processing of the video information D21*a* is ended, the video information D24*a* is transmitted and after that, the signal processing end determination processing is carried out and the video information D21*a* is created.

With these as signal-processing condition, the signal-processing board 1040*e*-1 receives the narrow band information distributed from an information distribution destination in step E1 of the flowchart shown in FIG. 36. The contents of the narrow band information include a notice in advance saying that the video information D21 will be transmitted. The information distribution destination is the control unit 1050 or other signal-processing board or the like. After that, the signal-processing board 1040*e*-1 recognizes the notice of transmission of the video information D21 and then, the procedure proceeds to step E2.

In the step E2, the signal-processing board 1040*e*-1 receives the video information D21 and stores the video information D21 in the memory 406. Next, the signal-processing board 1040*e*-1 reads the video information D21 out of the memory 406 based on the ID information D23 and the narrow band information in step E3 and generates the meaningful video information D22. At this time, the CPU 405 allows the video information D21 to be divided to field units and the ID information D23 shown in FIG. 33C is added to the head of the meaningful video information D22 after divided to each field unit shown in FIG. 33B.

The ID information D23 is control information for specifying signal-processing board(s) for subjecting the meaningful video information D22 to filter processing from the signal-processing boards 1040*a*-1040*d*. The control information includes flag information for determining whether or not the signal processing is executed in any of the signal-processing boards 1040*a*-1040*d*. For example, when flag information=1, it indicates that the signal processing is "required" and when flag information=0, it indicates that the signal processing is "not required". By synthesizing the ID information D23 with the meaningful video information D22, the meaningful video information block data D24 shown in FIG. 33D is formed. In the meantime, the ID information may be added thereto within a blanking period included in ordinary video information.

After that, the procedure proceeds to step E4 in which the signal-processing board 1040*e*-1 performs an object signal processing, for example, filter processing or the like. The ID information D23 is synthesized at the head of the meaningful video information D22 of each field unit during the signal processing and controlled. After the signal processing of the video information D21 is ended, the procedure proceeds to step E5 in which the signal-processing board 1040*e*-1 notifies signal-processing termination to a communication destination. At this time, the signal-processing board 1040*e*-1 converts the signal-processing termination to narrow band information and notifies it to, for example, the control unit 1050 and the like using the narrow band performance of the asymmetrical antenna 100 or the like as the embodiments of the present invention. The narrow band information includes information generated as a result of the signal processing in the control unit 1050, the signal-processing board 1040*e*-1 and the like.

In step E6, the signal-processing board 1040*e*-1 outputs the video information D21. At this time, the video information D24*a* is outputted to the control unit 1050 or other signal-processing boards 1040*a*-1040*d* using the asymmetrical flat antennas as the embodiments of the present invention. Consequently, the video information D24*a* can be transmitted from the signal-processing board 1040*e*-1 to other signal-processing boards 1040*a*-1040*d*.

Then, in step E7, the signal-processing board 1040*e*-1 detects whether or not an object signal processing is ended. Whether or not the object signal processing is ended is determined by detecting an end of flag or the like. Unless the signal processing is ended, the procedure returns to step E4 in which the object signal processing is continued. If the signal processing is ended, the procedure proceeds to step E8 in which the signal-processing board 1040*e*-1 generates the video information D21*a* from the meaningful video information block data D24*a* after the signal processing.

For example, the ID information D23*a* shown in FIG. 33F is separated from the meaningful video information block data D24*a* after the signal processing. The ID information D23*a* is separated from the data D24*a* when the CPU 405 controls the signal-processing portion 404. When the ID information D23*a* is separated from this data D24*a*, the meaningful video information D22*a* shown in FIG. 33G is obtained.

The CPU 405 allows the meaningful video information D22*a* (processed result) to be converted to information D21*a* whose real-time property is secured and the video information D21*a* to be output. For example, the meaningful video information D22*a* after the ID information is separated is converted to information shown FIG. 33H whose real-time property is secured by the information-converting portion controlled by the CPU 405. The information-converting portion converts the meaningful video information D22*a* to the video information D21*a*. This enables the signal-processing board 1040*e*-1 to generate the video information D21*a* obtained by processing the video information D21.

After that, in step E9, the CPU 405 determines that the signal processing is ended. For example, when power off information is detected, the signal processing is ended. Unless the power off information is detected, the procedure returns to step E1 in which the above described signal processing is continued. Consequently, the signal-processing board 1040*e*-1 can execute the generation processing of the meaningful video information block and the generation output processing of the video information, so that the video information D211 can be transmitted using the asymmetrical flat antennas as the embodiments of the present invention.

Figure 37:
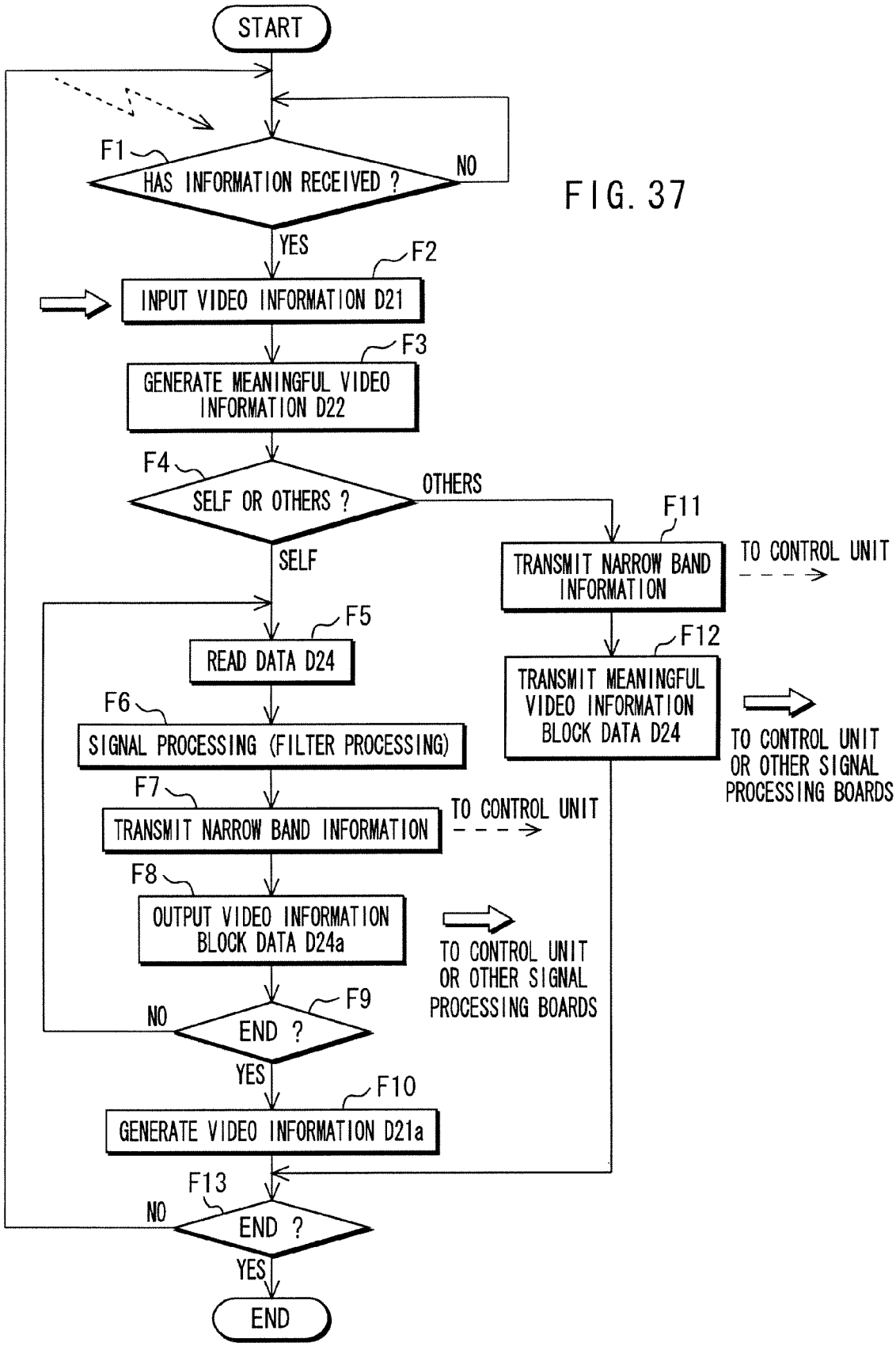
FIG. 37 is a flowchart for showing an example of wireless communication in the signal-processing board 1040*e*-2 with any control determination functions.

FIG. 37 is a flowchart for showing an example of wireless communication in the signal-processing board 1040*e*-2 with any control determination functions.

In this example, the signal-processing board 1040*e* shown in FIG. 29B includes the generation function of the meaningful video information block, self-other determination function, and the generation output function of the video information and the signal-processing board 1040*e*-2 performs the generation processing of the meaningful video information block, self-other determination processing, and generation output processing of video information.

With these as signal-processing condition, the signal-processing board 1040*e*-2 receives the narrow band information distributed from an information distribution destination in step F1 of the flowchart shown in FIG. 37. The contents of the narrow band information include a notice in advance saying that the video information D21 will be transmitted. The information distribution destination is the control unit 1050 or other signal-processing board or the like. After that, the signal-processing board 1040*e*-2 recognizes the notice of transmission of the video information D21 and then, the procedure proceeds to step F2.

In step F2, the signal-processing board 1040*e*-2 receives the video information D21 and stores the video information D21 in the memory 406. Next, the given signal-processing board 1040*e*-2 reads the video information D21 out of the memory 406 based on the ID information D23 and the narrow band information in step F3 and generates the meaningful video information D22. At this time, the CPU 405 allows the video information D21 to be divided to field units and the ID information D23 shown in FIG. 33C to be added to the head of the meaningful video information D22 after divided to each field unit shown in FIG. 33B.

The ID information D23 is control information for specifying signal-processing board(s) that subject(s) the meaningful video information D22 to, for example, filter processing from the signal-processing boards 1040*a*-1040*d*. The control information includes flag information for determining whether or not the signal processing is executed in any of the signal-processing boards 1040*a*-1040*d*. For example, when flag information=1, it indicates that the signal processing is "required" and when flag information=0, it indicates that the signal processing is "not required". By synthesizing the ID information D23 with the meaningful video information D22, the meaningful video information block data D24 shown in FIG. 33D is formed. In the meantime, the ID information may be added hereto within a blanking period included in ordinary video information.

In step F4, the signal-processing board 1040*e*-2 determines whether the meaningful video information block data D24 aims at the given signal-processing board 1040*e*-2 (to self) or other signal-processing boards 1040*a*, 1040*b*, 1040*c*, 1040*d* (to others) based on the narrow band information. The determination at this time is carried out based on information included in the narrow band information, for example, information for "specifying the signal-processing board 1040*e*-2" or the like.

If it is determined that the signal-processing board 1040*e*-2 is not specified based on this determination result, the procedure proceeds to step F11 without executing the signal processing of the meaningful video information block data D24 and the signal-processing board 1040*e*-2 notifies the narrow band information to the control unit 1050. The contents of the narrow band information in this case include "the meaningful video information block data D24 does not aim at the given signal-processing board 1040*e*-2 but other signal-processing boards 1040*a*, 1040*b*, 1040*c*, 1040*d*" or the like (self-other determination function). In step F12, the signal-processing board 1040*e*-2 transmits the meaningful video information block data D24 to the other signal-processing boards 1040*a*, 1040*b*, 1040*c*, 1040*d* using the asymmetrical flat antenna 100 or the like.

If in step F4, it is determined that the data D24 aims at "the given signal-processing board 1040*e*-2", the procedure proceeds to step F5 in which the data D24 is read out of the memory 406. Then, the procedure proceeds to step F6 in which the signal-processing board 1040*e*-2 executes an object signal processing, for example, filter processing or the like. The ID information D23 is synthesized at the head of the meaningful video information D22 of each field unit during the signal processing and controlled.

After the signal processing such as the filter processing of the above-described video information D21 is ended, the procedure proceeds to step F7 in which the signal-processing board 1040*e*-2 notifies signal-processing termination to a communication destination. At this time, the signal-processing board 1040*e*-2 converts the signal-processing termination to narrow band information form and notifies it to, for example, the control unit 1050 using the narrow band performance of the asymmetrical flat antennas as the embodiments of the present invention, monopole antenna and the like. The narrow band information includes information generated as a result of signal processing in the control unit 1050, the signal-processing board 1040*e*-2 and the like. In step F8, the signal-processing board 1040*e*-2 outputs (transmits) the video information D24*a*. At this time, the video information D24*a* is transmitted to the control unit 1050 or the other signal-processing boards 1040*a*-1040*d* using the asymmetrical flat antennas as the embodiments of the present invention.

After that, in step F9, the signal-processing board 1040*e*-2 detects whether or not an object signal processing is ended. Whether or not the object signal processing is ended is determined by detecting an end of flag or the like. Unless the signal processing is ended, the procedure proceeds to step F10 in which the signal-processing board 1040*e*-2 generates the video information D21*a* from the meaningful video information block data D24*a* after the signal processing.

For example, the ID information D23*a* shown in FIG. 33F is separated from the meaningful video information block data D24*a* after the signal processing. The ID information D23*a* is separated from the data D24*a* when the CPU 405 controls the signal processing portion 404. When the ID information D23*a* is separated from this data D24*a*, the meaningful video information D22*a* shown in FIG. 33G is obtained.

The CPU 405 allows the meaningful video information D22*a* (processed result) to be converted to information D21*a* whose real-time property is secured and the video information D21*a* to be output. For example, the meaningful video information D22*a* after the ID information is separated is converted to information whose real-time property is secured by the information-converting portion controlled by the CPU 405. The information-converting portion converts the meaningful video information D22*a* to the video information D21*a*. Consequently, the signal-processing board 1040*e*-2 can generate the video information D21*a* obtained by processing the video information D21.

After that, in step F13, the CPU 405 determines that the signal processing is ended. For example, when power off information is detected, the signal processing is ended. Unless the power off information is detected, the procedure returns to step F1 in which the above described signal processing is continued. Consequently, the signal-processing board 1040*e*-2 can execute the generation processing of the meaningful video information block, the self-other determination processing, and the generation output processing of video information, so that the video information D21*a* can be transmitted using the asymmetrical flat antennas as the embodiments of the present invention.

According to the electronic device of the twelfth-sixteenth embodiments, the antennas 1041*a*, 1041*b* maintaining connection easiness with the LSI device, and having a ratio of bandwidth of 11% or more and broadband characteristic are provided on the signal-processing boards 1040*a*-1040*d*. On this premise, wireless communication processing is carried out between the antennas 1041*a*, 1041*b* as the embodiments of the present invention and the signal-processing boards 1040*a*-1040*d* opposing the former at a near distance. The antennas 41*a*, 41*b* can be operated as an ordinary narrow band antenna in the far field and perform wireless communication within the casing 1030 of electronic device using the antenna characteristic achieved by possessing a matching circuit in the antenna pattern 103.

In the above examples, if the antennas 1041*a*, 1041*b* are disposed to oppose each other at a short distance, communication path can be established between the signal-processing boards 1040*a*-1040*d* disposed within a near distance in the casing 1030, so that the video information D21 can be transmitted from the signal-processing board 1040*a* to the signal-processing board 1040*b* by broadband wireless communication, the video information D21 can be transmitted from the signal-processing board 40*b* to the signal-processing board 40*c* by broadband wireless communication, and the video information D21 can be transmitted from the signal-processing board 40*c* to the signal-processing board 40*d*. Thus, a large amount of information can be transmitted at real time between the signal-processing boards 1040*a*-1040*d*.

Additionally, the signal-processing boards 1040*a*-1040*d* can be installed at a high density without placing signal wire within the casing 1030. Consequently, a user is released from troubles in placing wires and introduces and builds up new information-signal-processing system easily. Further, deterioration of the quality of transmission/reception signals accompanying multipath can be suppressed, thereby making it possible to transmit and receive information rapidly within the casing 1030. Further, narrow band wireless communication processing can be carried out with the control unit 1050 in a far field in a condition in which the signal-processing boards 1040*a*-1040*d* are disposed within a near distance in an electronic device.

Although, in twelfth-sixteenth embodiments, a case where the control units 1050*a* and the like are installed on the mother board 1060 separated from the signal-processing board 500 and the like has been described, the present invention is not restricted to this. It is permissible to mount the signal-processing board 1040*e* with control functions as shown in FIG. 29B which constitutes a small control unit by adding the control functions of the control units 1050*a* and the like to each of the signal-processing board 500 and the like so that they are operated in cooperation with each other by cooperative control. With such structure, the signal-processing boards are operated therebetween even if the control units 1050*a* and the like are not present on the mother board 1060. In this case, it is permissible to adopt a structure in which the control units 1050*a* and the like are mounted on the mother board 1060.

Because meaningful broadband information block like the data D14 is formed by dividing the broadband information as shown in FIGS. 30A-30H to meaningful broadband information and adding the ID information thereto, the meaningful broadband information may be processed by burying command information for the signal processing (job, task, operand or the like). In this case, the function of the signal-processing board 500 and the like changes if the data D14 of the meaningful broadband information reaches the signal processing portions 404, 504. Consequently, configuration not requiring the control units 1050*a* and the like can be established.

The present invention is preferably applicable to a video image processing unit, information processing unit and the like using antennas for communication within the casing 1030, which performs two-wave resonance type antenna activities having unidirectionality and broadband performance for a near distance and narrow band performance for a far distance. It should be understood by those skilled in the art that various modifications, combinations, sub-combinations and alterations may occur depending on design requirements and other factors insofar as they are within the scope of the appended claims or the equivalents thereof.

What is claimed is:

1. An asymmetrical flat antenna, comprising:

an insulation layer;

a conductive power supply pattern provided on the insulation layer and extending along a central axis; and a conductive antenna pattern extending from the power supply pattern, including first and second portions extending away from said central axis in opposing directions to said central axis, said first and second portions having multiple graduated step increments in width, relative to respective non-zero base widths of said first and second portions proximate to said central axis, in a direction parallel to the central axis as said first and second portions respectively extend away from said central axis, each of said step increments increasing width by a same amount, said conductive antenna pattern being provided on the insulation layer, and said first and second antenna portions of said conductive antenna pattern having an asymmetrical configuration with respect to the power supply pattern.

2. The asymmetrical flat antenna according to claim 1, wherein an antenna-matching pattern with a predetermined configuration to impedance match a device connected to said power supply pattern is provided at a portion between the conductive antenna pattern and the conductive power supply pattern.

3. The asymmetrical flat antenna according to claim 1, wherein the insulation layer provided under the conductive antenna pattern includes an insulation sub-layer and a conductive grounding sub-layer.

4. A method of manufacturing an asymmetrical flat antenna, said method comprising:

forming an insulation layer;

forming a conductive power supply pattern on the insulation layer along a central axis; and forming a conductive antenna pattern extending from the conductive power supply pattern on the insulation layer, including first and second portions extending away from said central axis in opposing directions to said central axis, said first and second portions having multiple graduated step increments in width, relative to respective non-zero base widths of said first and second portions proximate to said central axis, in a direction parallel to said central axis as said first and second portions respectively extend away from said central axis, each of said step increments increasing width by a same amount, and said first and second portions of said conductive antenna pattern having an asymmetrical configuration with respect to the conductive power supply pattern.

5. The method according to claim 4, further comprising:

forming an antenna-matching pattern with a predetermined configuration to impedance match a device connected to said power supply pattern at a portion between the conductive antenna pattern and the conductive power supply pattern.

6. The method according to claim 4, further comprising:

forming a semiconductor integrated circuit device on the insulation layer adjacent to the conductive antenna pattern; and connecting the conductive antenna pattern and the semiconductor integrated circuit device to each other through a transmission path.

7. The method according to claim 4, wherein the forming an insulation layer includes:

forming an insulation layer under the conductive antenna pattern; and forming an conductive grounding layer under the insulation layer.

8. A signal-processing unit that performs signal processing, said signal-processing unit comprising an asymmetrical flat antenna, the asymmetrical flat antenna including:

an insulation layer, a conductive power supply pattern provided on the insulation layer and extending along a central axis, and a conductive antenna pattern extending from the power supply pattern, including first and second portions extending away from said central axis in opposing directions to said central axis, said first and second portions having multiple graduated step increments in width, relative to respective non-zero base widths of said first and second portions proximate to said central axis, in a direction parallel to said central axis as said first and second portions respectively extend away from said central axis, each of said step increments increasing width by a same amount, said conductive antenna pattern being provided on the insulation layer, and said first and second portions of said conductive antenna pattern having an asymmetrical configuration with respect to the power supply pattern.

9. The signal-processing unit according to claim 8, further comprising:

a signal-processing device connected to the asymmetrical flat antenna to perform the signal processing, wherein the signal-processing device includes any one of a signal-processing board and a semiconductor integrated circuit device.

10. The signal-processing unit according to claim 8 wherein an antenna-matching pattern with a predetermined configuration to impedance match a device connected to the power supply pattern is provided at a portion between the conductive antenna pattern and the conductive power supply pattern.

11. The signal-processing unit according to claim 8, wherein a semiconductor integrated circuit device is provided on the insulation layer adjacent to the antenna pattern; and wherein the conductive antenna pattern and the semiconductor integrated circuit device are connected to each other through a transmission path.

12. The signal-processing unit according to claim 8, wherein the insulation layer provided under the conductive antenna pattern includes a conductive grounding sub-layer.

13. The signal-processing unit according to claim 12, wherein the insulation layer provided under the conductive antenna pattern further includes:

an insulation sub-layer that is provided under the conducting grounding sub-layer; and a wiring layer that is provided under the insulation sub-layer.

14. The signal-processing unit according to claim 12, wherein the insulation layer provided under the conductive antenna pattern further includes:

an insulation sub-layer that is provided under the grounding sub-layer; and a semiconductor integrated circuit layer that is provided under the insulation sub-layer.

15. The signal-processing unit according to claim 12, further comprising a signal-processing device connected to the asymmetrical flat antenna to perform the signal processing, wherein the asymmetrical flat antenna is provided on one face of the insulation layer;

wherein the signal-processing device is provided on another face of the insulation layer opposite said one face; and wherein the signal-processing device and the asymmetrical flat antenna are connected to each other through any one of a transmission path and a contact hole.

16. The signal-processing unit according to claim 12, further comprising:

a signal-processing device connected to the asymmetrical flat antenna to perform the signal processing, wherein the asymmetrical flat antenna includes a first asymmetrical flat antenna and a second asymmetrical flat antenna;

wherein the first asymmetrical flat antenna and the signal-processing device are provided on one face of the insulation layer;

wherein the second asymmetrical flat antenna is provided on another face of the insulation layer opposite said one face;

wherein the signal-processing device and the first asymmetrical flat antenna are connected to each other through a transmission path; and wherein the signal-processing device and the second asymmetrical flat antenna are connected to each other through a contact hole.

17. The signal-processing unit according to claim 12, further comprising:

a signal-processing device that is connected to plural asymmetrical flat antennas that are provided on the insulation layer to perform the signal processing, wherein the plural asymmetrical flat antennas are respectively connected to the signal-processing device through transmission paths.

18. The signal-processing unit according to claim 12, further comprising:

a signal-processing device connected to the asymmetrical flat antenna to perform the signal processing, wherein the asymmetrical flat antenna includes an asymmetrical flat antenna for reception and an asymmetrical flat antenna for transmission;

wherein the asymmetrical flat antennas for reception and transmission are provided on the insulation layer;

wherein the signal-processing device is connected to each of the asymmetrical flat antennas for reception and transmission;

wherein the asymmetrical flat antenna for reception is connected to an input side of the signal-processing device through a branching circuit and a transmission path; and wherein the asymmetrical flat antenna for transmission is connected to an output side of the signal-processing device through a synthesizing circuit and a transmission path.

19. The signal-processing unit according to claim 12, further comprising:

a signal-processing device connected to the asymmetrical flat antennas to perform the signal processing, wherein the asymmetrical flat antenna includes plural asymmetrical flat antennas for reception and plural asymmetrical flat antennas for transmission, both of said plural asymmetrical flat antennas for reception and transmission being provided on the insulation layer;

wherein the plural asymmetrical flat antennas for reception are connected to an input side of the signal-processing device through a branching circuit and transmission paths; and wherein the plural asymmetrical flat antennas for transmission is connected to an output side of the signal-processing device through a synthesizing circuit and transmission paths.

20. The signal-processing unit according to claim 12, further comprising:

a signal-processing device provided on the insulation layer; and a casing enclosing the insulation layer, wherein the asymmetrical flat antenna is provided on one face of the casing; and wherein the asymmetrical flat antenna is connected to the signal-processing device through a transmission path.

* * * * *